United States Patent [19]

Yamakawa et al.

[11] Patent Number: 4,811,052

[45] Date of Patent: Mar. 7, 1989

[54] CONTROL DEVICE FOR CONTROL OF MULTI-FUNCTION CONTROL UNITS IN AN IMAGE PROCESSING APPARATUS

[75] Inventors: Tadashi Yamakawa, Yokohama; Kazutoshi Shimada; Yoshitaka Ogino, both of Kawasaki, all of Japan

[73] Assignee: Canon Kabushiki Kaisha, Tokyo, Japan

[21] Appl. No.: 893,915

[22] Filed: Aug. 6, 1986

[30] Foreign Application Priority Data

| | | | |
|---|---|---|---|
| Aug. 8, 1985 | [JP] | Japan | 60-175302 |
| Aug. 8, 1985 | [JP] | Japan | 60-175303 |
| Aug. 8, 1985 | [JP] | Japan | 60-175304 |
| Aug. 8, 1985 | [JP] | Japan | 60-175305 |
| Nov. 19, 1985 | [JP] | Japan | 60-257546 |
| Nov. 19, 1985 | [JP] | Japan | 60-257547 |

[51] Int. Cl.[4] ..... G03G 15/00

[52] U.S. Cl. ..... 355/14 C; 364/200

[58] Field of Search ..... 355/14 R, 14 C, 14 CU; 364/131-134, 136, 518, 200 MS File

[56] References Cited

U.S. PATENT DOCUMENTS

| | | | |
|---|---|---|---|
| 4,212,057 | 7/1980 | Devlin et al. | 364/134 X |
| 4,283,773 | 8/1981 | Daughton et al. | 364/900 |
| 4,314,334 | 2/1982 | Daughton et al. | 355/14 C X |
| 4,338,023 | 7/1982 | McGibbon | 355/14 SH |
| 4,404,628 | 9/1983 | Angelo | 364/200 |
| 4,509,851 | 4/1985 | Ippolito et al. | 355/14 C |
| 4,523,274 | 6/1985 | Fukunaga et al. | 364/200 |
| 4,539,637 | 9/1985 | DeBruler | 364/200 |
| 4,588,284 | 5/1986 | Federico et al. | 355/14 C X |
| 4,608,661 | 8/1986 | Sasaki | 364/131 X |

FOREIGN PATENT DOCUMENTS

| | | | |
|---|---|---|---|
| 0103851 | 3/1984 | European Pat. Off. . | |
| 0106567 | 4/1984 | European Pat. Off. . | |
| 0104887 | 4/1984 | European Pat. Off. . | |
| 0109337 | 5/1984 | European Pat. Off. . | |
| 2539260 | 7/1984 | France . | |
| 54-36941 | 3/1979 | Japan | 355/14 C |
| 58-100149 | 6/1983 | Japan | 355/14 C |
| 59-67557 | 4/1984 | Japan | 355/14 CU |
| 60-149058 | 8/1985 | Japan | 355/14 R |

OTHER PUBLICATIONS

Patent Abstracts of Japan, vol. 9, No. 2 (P-325)(1725), 8th Jan. '85; & JP-A-59 151 161 (Toshiba K.K.), 29-0-8-1984.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A control device in an image processing apparatus comprises a central operation processing unit and a plurality of operation control units controlled by the central operation processing unit, controlling a plurality of process means of the image processing apparatus and operating in parallel. Timer means for measuring the time for determining the control timing of the process means is provided in each of the plurality of operation control units.

16 Claims, 56 Drawing Sheets

| MODE NO | OBJECTIVE TO BE CONTROLLED | CONTROL CONTENTS |
|---|---|---|
| 0 | TONER SUPPLY | CHECK RESIDUAL TONER IN DEVELOPING ASSEMBLY AND SUPPLY TONER |
| 1 | NO PAPER | CHECK PRESENCE/ABSENCE OF PAPER CASSETTE AND PAPER IN CASSETTE |
| 2 | TONER DISCHAGE | CHECK DISCHARGED TONER |
| 3 | MAGNIFICATION CHANGE LENS | MOVE ZOOM LENS IN MAGNIFICATION CHANGING |
| 4 | SCANNER HP | CHECK SCANNER HP BEFORE COPY |
| 5 | SCANNER | MOVE SCANNER IN COPY |
| 6 | PAPER FEED a | DRIVE PAPER FEED ROLLER WHEN PAPER FEED a SIDE IS DESIGNATED IN COPY |
| 7 | PAPER FEED b | DRIVE PAPER FEED ROLLER WHEN PAPER FEED b SIDE IS DESIGNATED IN COPY |
| 8 | RESIST | DRIVE RESIST ROLLER |
| 9 | BLANK EXPOSURE | DRIVE 192-DOT BLANK LED |

FIG. 42

CONTROL DEVICE FOR CONTROL OF MULTI-FUNCTION CONTROL UNITS IN AN IMAGE PROCESSING APPARATUS

BACKGROUND OF THE INVENTION

1. Field of the Invention

This invention relates to a control device in an image processing apparatus for controlling the execution timing of the sequence of a plurality of process means which execute image formation.

2. Description of the Related Art

Along with the development of microcomputers, the imaging forming loads heretofore controlled by a relay sequence circuit or a logic circuit comprising a combination of ICs have come to be realized by the program control of the microcomputer.

The respective image forming loads which should originally be parallel-controlled have become time-divisionally controlled by program control as microcomputerization has advanced, and parallel control has been realized.

However, time-divisional control by program is not suited for control in which high-speed responsiveness is required. Therefore, the control of such parts has been accomplished with by making a microcomputer correspond to a load or by adding a hardware circuit for exclusive use.

These will be described by taking a copying apparatus as an example.

FIG. 2 of the accompanying drawings shows the construction of a copying apparatus to which the present invention is applicable. An original is slit-illuminated by original illuminating means 100 such as a fluorescent lamp, and the image of the original is formed on a photosensitive drum 108 by a zoom lens 107. The light reflected then from the original is directed to the photosensitive drum 108 via a first mirror 101, a second mirror 102, a third mirror 103, the zoom lens 107, a fourth mirror 104, a fifth mirror 105 and a sixth mirror 106.

The original illuminating means 100 and the first mirror 101 are moved in the direction of the arrow in synchronism with the rotation of the photosensitive drum 108 in the direction of the arrow. At one half of the speed of the original illuminating means and the first mirror, the second mirror 102 and the third mirror 103 are moved in the direction of the arrow. This results in the length of the optic axis 109 being constant.

After the first mirror 101 has been moved by an amount corresponding to the length of the original, the first mirror is reversed and returns to its initial position. The design is such that the position of the leading edge of the original and the basic position of the first mirror can be detected by a leading edge sensor 110 and a scan home position sensor 111, respectively.

Around the photosensitive drum 108, there are provided a primary charger 112, a blank exposure illuminator 113, a developing device 114, a transfer charger 115, a separator 116, a cleaner 117 and a residual charge, eliminator 118. An electrostatic latent image formed by the potential variation caused by the intensity of light of the imaged point of the slit-exposed original is developed and the developed image is transferred to copying paper. The copying paper is discharged by conveying means 119 through a fixing device 120.

Sheets of copying paper are held in an upper cassette 121 or a lower cassette 122, and a sheet of copying paper is picked up by a paper feed roller 123 or a paper feed roller 124 and is temporarily stopped at the position of a resist roller 125.

The first mirror 101 is moved in the direction of the arrow, the time when the leading edge portion of the original is imaged is detected by the leading edge sensor 110, the time during which the imaging position of the photosensitive drum 108 rotates to the position of the transfer charger 115 is measured and time adjustment is effected so that the leading edge of the copying paper at this time is also moved to the position of the transfer charge 115. Whereafter, the resist roller 125 is rotated to thereby effect alignment of the image on the copying paper.

An instrument controlling microcomputer has heretofore been used to control the operation of the above-described copying apparatus.

For example, Model 8049 or 8051 produced by Intel, Inc. corresponds to said microcomputer. For simplicity, the conventional control circuit concerned with the control of the scanning of the optical system and the feeding of copying paper is extracted and shown in FIG. 3 of the accompanying drawings.

In FIG. 3, reference numeral 201 designates the instrument controlling microcomputer. The instrument controlling microcomputer 201 is connected to RAM 202 and ROM 203 through an external bus. Within the microcomputer 201, CPU 210, RAM 211, input port 212, output port 213 and programmable oscillator 214 are connected together through an internal bus 215.

A signal SHP is input to the port A0 of the input port 212 from the scan home position sensor 110 through an input buffer 220, a signal ST is input to the port A1 of the input port 212 from the leading edge sensor 111 through an input buffer 221, and a signal PREG is input to the port A2 of the input port 212 from a paper sensor 126 immediately before being input to the resist roller 215 through an input buffer 222.

The signal SHP is 1 when the original illuminating means 100 is in its basic position, and is 0 when the original illuminating means 100 is not in its basic position, and the signal ST changes from 0 to 1 when the original illuminating means 100 arrives at a position for imaging the leading edge of the original, and is 0 when the original illuminating means 100 is in the other position. The signal PREG is 1 when the copying paper is immediately before the resist roller 125, and is 0 when the copying paper is not.

The original illuminating means 100, the first mirror 101, the second mirror 102 and the third mirror 103 are driven by a DC motor M2. To carry out a stageless magnification change, the reduction or enlargement in the main scan direction is accomplished the zoom lens 107 and the reduction or enlargement in the subsidiary scan direction is carried out with the original scanning speed changed. For this speed adjustment, the DC motor M2 is controlled by the microcomputer 201 through a scan motor controller 230. Port C0 is the output terminal of the programmable oscillator 214 and compares the oscillation frequency thereof with a scan speed target, thereby controlling the DC motor M2. The speed of revolution of the motor is detected from an encoder E, and it is fed back, whereby the scan motor controller 230 controls the speed of the motor M2 so that the motor M2 is kept at a speed conforming to a speed control signal Fs. By setting the signal FW of port B0 to 1, the motor is revolved in such a direction that the original illuminating means 100, etc. are moved forward. By setting the signal RV of port B1 to 1, the motor is revolved in such a direction that the original illuminating means 100, etc. are reversed and by setting the signal BRK of port B2 to 1, a brake is applied.

A signal MM is put out from port B3 which is connected to a main motor M1 through a main motor driver 231. The main motor is used to move driving portions except the scan system, such as the photosensitive drum 108, paper feed rollers 123, 124 and resist roller 125. When the signal MM is set to 1, the main motor M1 rotates at a constant speed, and when the signal MM is set to 0, the main motor M1 is stopped. Signals PIC1 and PIC2 are put out from ports B4 and B5 which are connected to clutches CL1 and CL2, respectively, through hammer drivers 240 and 241. Clutches CL1 and CL2 control the rotation and stoppage of the paper feed rollers 123 and 124, respectively, and when the signals PIC1 and PIC2 are set to 1, the paper feed rollers are rotated, and when the signals PIC1 and PIC2 are set to 0, the paper feed rollers are stopped.

A signal REG is put out from port B6 which is connected to a clutch CL3 through a hammer driver 242. The clutch CL3 controls the rotation and stoppage of the resist roller 125, and by setting the signal REG to 1, the resist roller 125 is rotated, and by setting the signal REG to 0, the resist roller 125 is stopped.

Besides these, there are numerous objects of control of the copying apparatus such as rotating stopping of the developing device, application of a developing bias, application of a voltage to each charger, ON and OFF of the residual charge eliminator, driving of the zoom lens, and display of the operation unit and key input control. The description of these objects of control is omitted herein.

An example of the program by which CPU 210 is operated in such a construction, and by which the copying apparatus is controlled, is shown in FIG. 4 of the accompanying drawings.

At step S301, the initial values of the variables of RAM 202 and internal RAM 211 are substituted into the copying apparatus to thereby effect the initial setting of the copying apparatus.

At step S302, the display of the operation panel and processing of the key input are executed. Analysis of the operator's instruction is executed, and display thereof, and display of the condition of the copying apparatus, are executed.

At step S303, control of the electrophotographic process of the chargers, the developing devices, etc. is executed.

At step S304, control of the supply of copying paper is executed.

At step S305, control of the scanning of the original illuminating means, etc. is executed in synchronism with the supply of copying paper.

At step S306, a stepping motor used to move the zoom lens is driven, whereafter the program returns to step S302 and these processings are repeated.

In so controlling the copying apparatus, execution is effected with a plurality of processings being time-divided.

In such a case, if the original illuminating means passes the position of the leading edge of the original when the operation display processing is being executed, the time of detection of the position of the leading edge of the original is delayed until the turn of the scan system processing comes, whereby the time of starting of the rotation of the resist roller 125 is delayed and thus, the image position on the copying paper may deviate in a forward direction. Therefore, it has been necessary to input the detection of the position of the leading edge of the original to an interruption input terminal and applying an interruption signal to CPU 210. CPU 210 is forcibly informed of the position of the leading edge of the original and the time of starting of the rotation of the resist roller 125 is calculated from that time.

In the foregoing, an example in which a deviation of several ms adversely affects the operation of the instrument has been shown, but generally, control cannot be accomplished by the method in which the program proceeds to the next step after the processing of step S302 to step S306 have been completed. Particularly, steps S303–S305 originally progress concurrently and therefore, concurrent processing become necessary. Accordingly, either operating steps S302–S306 under the basic program such as a real time monitor program or describing steps S303 to S305 in a single program must be selected. In the former system, the time required for the change-over of the processing of each step, namely, the overhead, is great and the utilization efficiency of CPU is reduced. In the latter system, the program becomes complicated and along with the increase in the amount of programming by the improved performance of the control instrument, misprogramming increases and very much time is required for the program.

Even in the case of the former system in which real time monitoring is utilized to effect time-divisional processing, if an attempt is made to effect control of the stepping motor, etc. by a program, noise may be produced unless the program is actuated every predetermined period of time. Therefore, such a program must be executed by constant time interruption processing or the like and, due also to an increase in such interruption processing, the other processes are made to wait for the time during which processing of a high priority is executed in 210. Thus, high-speed parallel processing cannot be realized, and control of the stepping motor and scanning motor is entrusted to another microcomputer. The overhead is increased by the exchange of information between the microcomputers and the change-over of the program being frequently effected under the real time monitor. Thus, the rate at which the CPU effects the processing other than the original control operation becomes high and correspondingly, the amount of hardware becomes large, causing an increased cost.

Further, interruption processing which is used to enhance the responsiveness or the structure of the program is made into a special form, whereby the program becomes debug and more complicated and the time of program debug increased, which leads to an increased general development cost.

SUMMARY OF THE INVENTION

The present invention has been made in view of the above-described example of the prior art.

One aspect of the present invention is to provide a control device in an image processing apparatus which can process a plurality of control objects at higher accuracy and higher speed.

Another aspect of the present invention is to provide a control device in an image processing apparatus which can simplify the hardware and easily permits the designing of the software to be accomplished.

A further aspect of the present invention provides a control device in an image processing apparatus which comprises a central processing control unit and a plurality of operation control units controlled by said central processing control unit and operating in parallel and in which a timer function for counting time is provided in each of said operation control units.

A still further aspect of the present invention is a control device in an image processing apparatus which comprises a central operation processing unit, a plurality of operation control units controlled by said operation processing unit, an input and output unit receiving as inputs the state signals from a plurality of process means, and a common bus for connecting said plurality of operation control units to said input and output unit.

An additional aspect of the present invention is a control device in an image processing apparatus in which a plurality of operation control units are provided and each of the operation control units is allotted to each recording medium and effects monitoring and control of each recording medium.

Yet another aspect of the present invention is a control device which controls an image processing apparatus by counting a clock signal common to a main control unit and a plurality of subcontrol units.

Still another aspect of the present invention is a control device in an image processing apparatus in which a plurality of subcontrol units are substantially of the same circuit construction and are operated by substantially the same control program.

Other objects of the present invention will become apparent from the accompanying drawings and the following detailed description.

BRIEF DESCRIPTION OF THE DRAWINGS

FIGS. 26C, 26C-1, 26C-2 and 26C-3 show a copy processing flow chart.

FIG. 35A, 35A-1 and 35 A-2 are a block diagram showing the circuit construction.

FIG. 42 shows control modes.

DESCRIPTION OF THE PREFERRED EMBODIMENTS

[First Embodiment]

Figure 1:
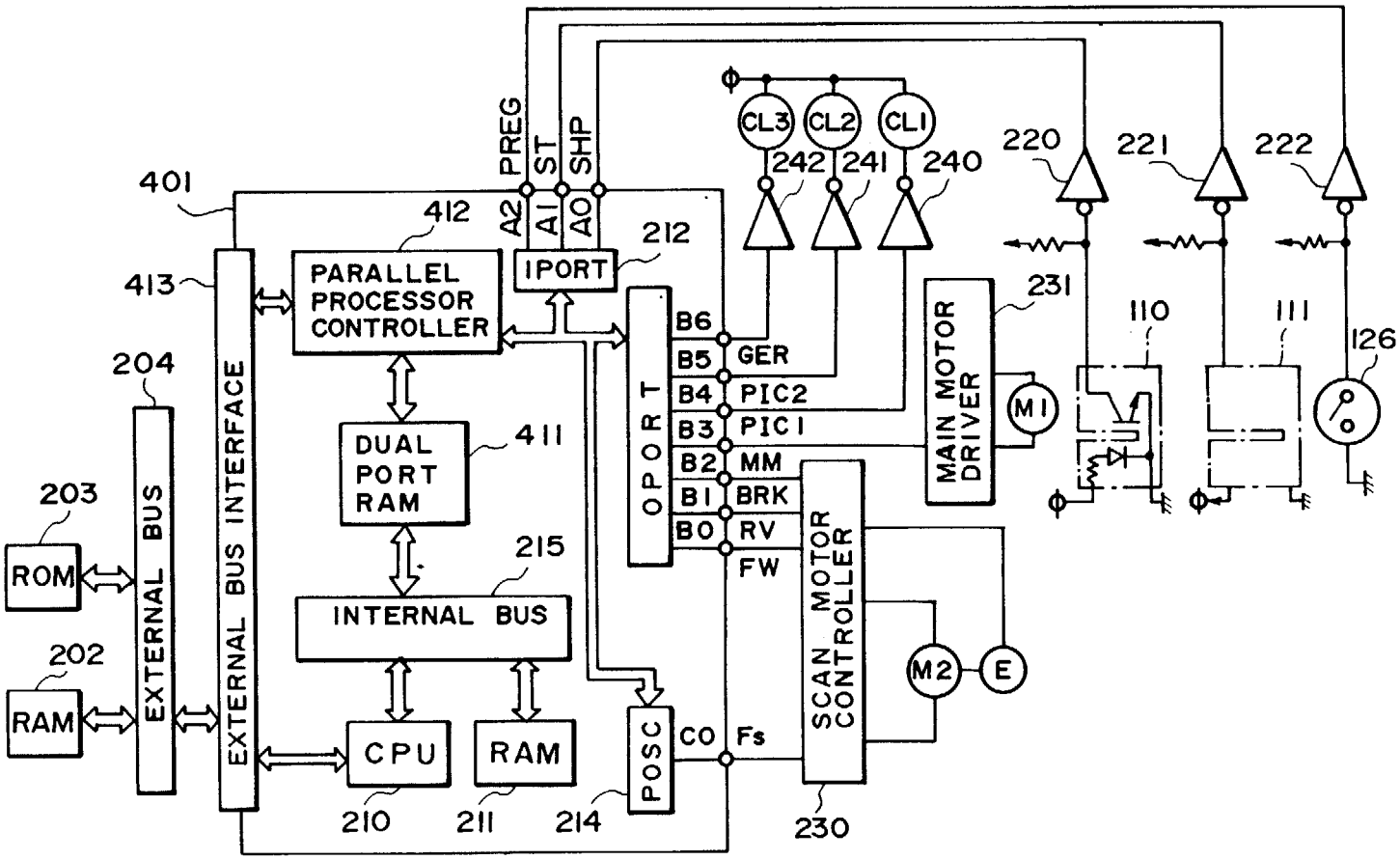
FIG. 1 is a diagram of the control circuit of a copying apparatus according to an embodiment of the present invention.

FIG. 1 diagrammatically shows the control circuit of a copying apparatus according to an embodiment of the present invention. In FIG. 1, reference numeral designates an instrument controlling microcomputer constructed on one chip. Heretofore, the internal RAM of CPU 210, I/O port, etc. have been connected to an internal bus 215, whereas a parallel processor controller 412 is connected to the internal bus 215 through a dual port RAM 411. Also, an input port 212, an output port 213 and a programmable oscillator 214 are connected to the parallel processor controller 412.

The dual port RAM 411 can read and write from CPU 210 and can also read and write from the parallel processor controller 412. The register areas of a plurality of processors are allotted to the dual port RAM 411, and the parallel processor controller 412 executes the processing of a plurality of processors in conformity with the values of the register areas of these processors.

As viewed from CPU 210, RAM 211 is addressed at 128 bytes from address 00H to address 7FH (according to decimal number, 127 addresses, but as far as the address is concerned, it is shown in hexadecimal number H hereinafter), and the dual port RAM 411 is addressed at 128 bytes from address 80H to address FF.

Here, the 8 bytes from address 80H to address 87H is defined as a register for processor 0 and the 8 bytes from address 88H to address 8FH is defined as a register for processor 1. Likewise, each 8 bytes from address B8H to address BFH are defined as registers for processor 2 to processor 7. Of the areas of 8 bytes allotted for each processor, the rearmost 2 bytes are utilized as a program counter. For example, in the case of processor 1, address 8EH is the most significant 8 bits of the program counter and address 8FH is the least significant 8 bits of the program counter. The parallel processor controller 412 is adapted to fetch the data of each 2 bytes for processor 0 to processor 7, total 16 bits, as the instruction data, and the program counter increments by 2 each. By doing so, the least significant bits of the program counter, i.e., bit H0 to bit H7 in processor 0 to processor 7, are defined as the bit for hold designation, and the design is such that when this bit is 1, fetching and execution of the instruction of the corresponding processor are not effected.

Also, address COH to address FFH of the dual port RAM 411 are defined as a memory area used in common by processors 0–7.

The definition of the memory space as described above is done and the parallel processor controller 412 executes the processing of the successive processors in time division, whereby the plurality of independent processors effect parallel operations under the control of CPU 210.

A description will hereinafter be given an example in which the controlling microcomputer 401 is constructed with a Model 8051 of Intel, Inc. as the CPU 210.

Figure 5:
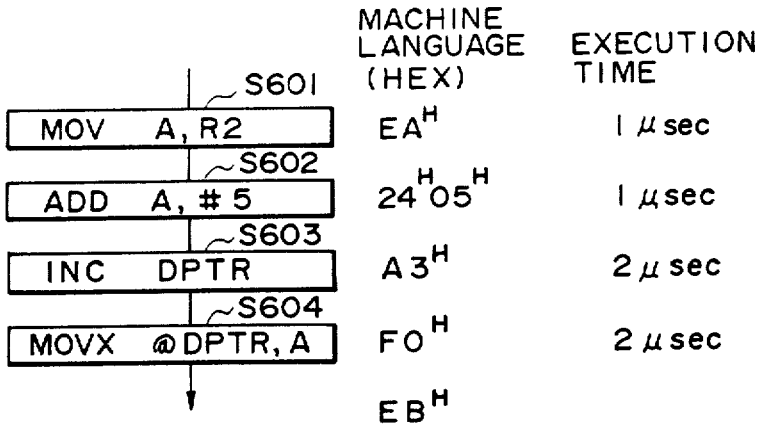
FIG. 5 shows an example of the control program.
Figure 6:
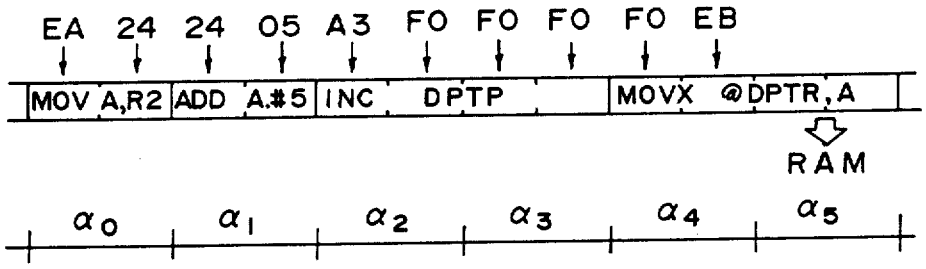
FIG. 6 shows the execution timing of the program of FIG. 5.

CPU 210 is an 8-bit machine and the instruction thereof is of a variable length of 1 to 3 bytes. In the case of the basic clock of 12 MHz, 1 μsec is a unit of execution, and every instruction requires a time integer times as long as 1 μsec. Also, the fetching of the instruction is effected twice during 1 μsec, and the reading and writing of the RAM area is effected once during 1 μsec. Where, for example, an instruction of a length of 1 byte is to be fetched at this time, the instruction is fetched during the first half of 1 μsec and the execution thereof is started and the next instruction is fetched during the second half of 1 μsec, but the instruction data fetched during the second half is discarded and again, an instruction is fetched and executed during the first half of the next 1 μsec. That is, whatever may be the length of the instruction, or whatever may be the execution time, external bus access is executed at integer times 1 μsec. For example, the program as shown in FIG. 5 is executed in the manner as shown in FIG. 6.

At step S601, the content of a register 2 is moved to register A, and at step S602, 5 is added to the content of register A, whereafter at step S603, the content of a data pointer register is incremented, and at step S604, the content of register A is written into the RAM addressed by the data pointer register. The machine language is a of total 5 bytes, i.e., EAH, 24H, 05H, A3H and F0H, where 1 byte is represented by a two-figure hexadecimal number. Steps S601 and S602 provide an execution time of 1 μsec, and steps S603 and S604 provide an execution time of 2 μsec. The state of the bus access is as shown in FIG. 6. During the first half of a period α0, the instruction EAH of step S601 is fetched, and during the second half of the period α0, the instruction 24H of step S602 is fetched. This 24H is disregarded and is again fetched during the first half of the next period α1, and 05H is fetched during the second half of said period α1, and execution is also effected during the period α1. During the first half of a period α2, the instruction A3H of step S603 is fetched, but the execution thereof requires 2 μsec and therefore, during the second half of the period α2 and during a period α3, that is, three times, the instruction FOH of step S604 is fetched, but all is disregarded. During the first half of a period α4, FOH is again fetched and during the second half of the period α4, the next instruction is fetched. At step S604, the writing into RAM is effected and therefore, during a period α5, instruction fetch is not effected, but the external bus is used for the writing of RAM data.

Each of the periods α0–α5 is 1 μsec when a clock of 12 MHz is used.

The instruction set in the parallel processor controller 412 is of a fixed length of 2 bytes. Thus, the fetch of one instruction can be accomplished in the execution unit time (1 μsec) of CPU 210.

In this manner, the design is such that CPU 210 and the parallel processor controller 412 time-divisionally utilize ROM 202 connected to the external bus 204 through a external bus interface 413.

Figure 7:
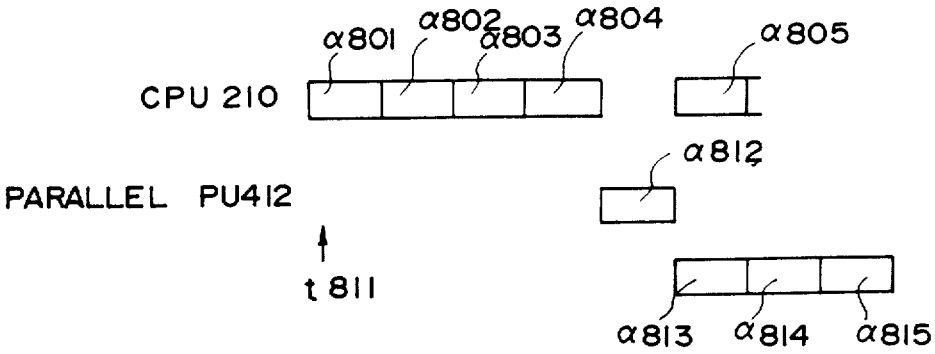
FIG. 7 shows the operational relation between CPU 210 and a parallel processor controller 412.

One of the instructions of CPU 210 which requires the longest execution time is of 4 μsec. Accordingly, once the fetch of this instruction is effected by CPU 210, the external bus 204 is exclusively possessed by CPU 210 for 4 μsec. Thus, even if the parallel processor controller 412 demands instruction fetch during this time, execution is delayed for 4 μsec. This state is shown in FIG. 7.

Assuming that CPU 210 has begun to effect the execution of an instruction which takes 4 μsec when the parallel processor controller 412 is about to effect instruction fetch at time t811, CPU 210 exclusively possesses the external bus interface 413 during periods α801, α802, α803 and α804. During a period α812, the demand of the parallel processor controller 412 is accepted, the external bus interface 413 is exclusively possessed and 2 bytes of an instruction for one of the parallel processors is fetched. During the next period α805, CPU 210 exclusively possesses the external bus interface 413. Assuming that a maximum of 3 μsec is required to execute an instruction by the parallel processor controller 412, 8 μsec is required in the worst case from the time after the parallel processor controller effects the instruction fetch demand at time t811 until execution periods α813, α814 and α815 are terminated. So, by making the design such that always, every 8 μsec, the parallel processor controller 412 gives out an instruction fetch demand, the external bus 204 is used for the parallel processors once per 8 μsec and CPU 210 uses the remaining 7 μsec.

Figure 8:
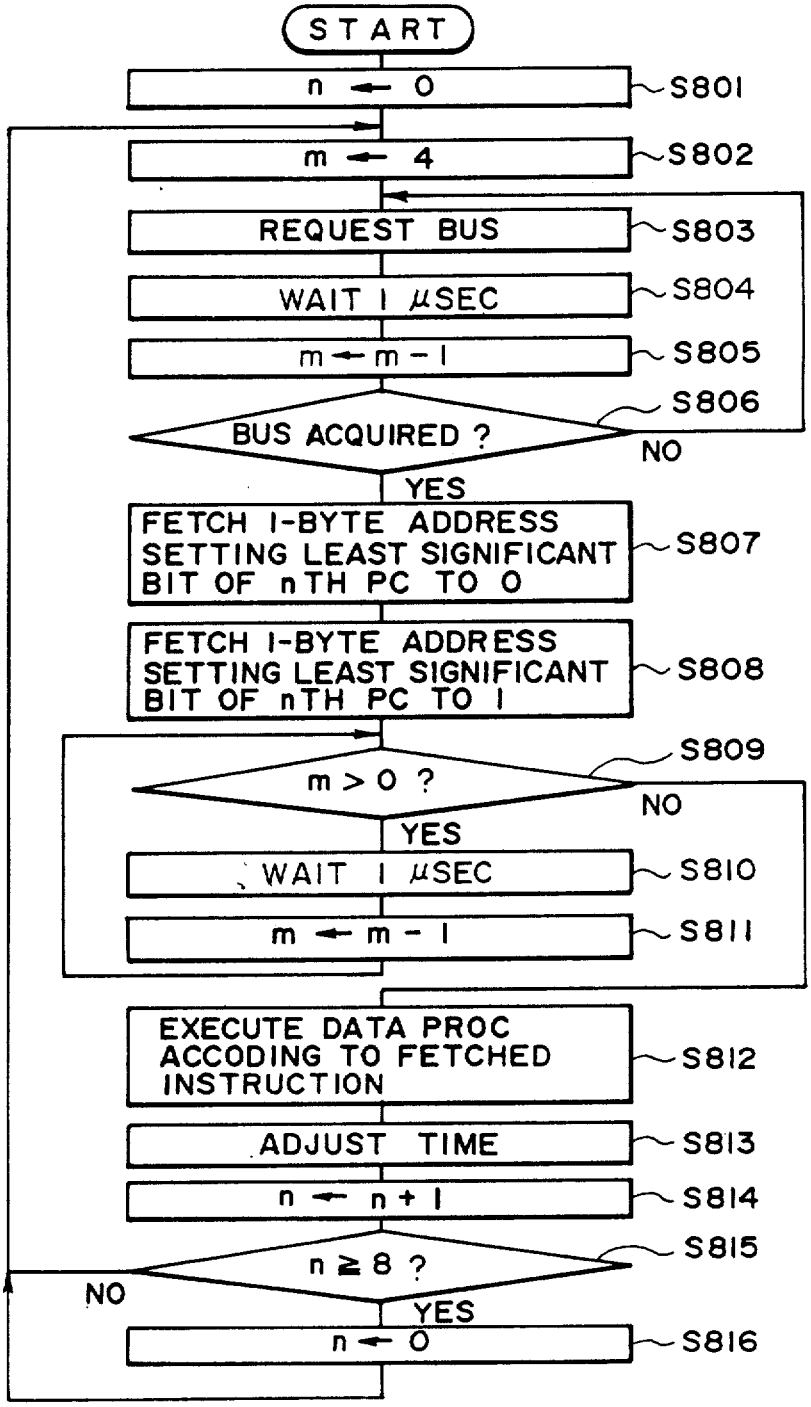
FIG. 8 shows the flow chart of the basic operation of the parallel processor controller 412.

FIG. 8 shows a flow chart of the basic operation of the parallel processor controller 412. At the start of execution, at step S801, the processor number n is rendered into 0 to time-divisionally parallel-process the processors 0 to 7 of the parallel processor controller 412. At step 802, the number m of the remaining periods during which the bus is not used is initialized the 4 to calculate the time frame during which an instruction is fetched. At step S803, a request for the use of the bus is provided to the external bus interface 413, and at step S804, the execution is delayed for 1 μsec. At step S805, the number m of the remaining periods during which the bus is not used is decremented by 1. At step S806, whether the period for using the bus has come is determined and, if CPU 210 is using the bus, the program returns to step S803 and this step is repeated, and when the bus is allotted to the parallel processor controller 412, the program proceeds to step S807. At step S807, the high-rank byte of the instruction is fetched from the external memory with the least significant bit of the program counter of the processor n set to 0 as the address. For example, when n is 0, 2 bytes of the addresses 86H and 87H of the dual port RAM 411 are used as the value of the program counter. When n is 1, addresses 8EH and 8FH are used. That is, for the nth processor PROCn, the address (80H+8×n+6) is used as the high-rank byte of the program counter and the address (80H+8×n+7) is used as the low-rank byte of the program counter.

In order to fetch the leading byte of the instruction, the least significant bit is set to 0 and 1-byte fetch is effected. At step S808, the least significant bit is set to 1 and the second byte of the instruction is fetched. In this manner, at steps S807 and S808, the external bus 204 is utilized for 1 μsec, and 2 bytes of the instruction data for the processor n are fetched. At step S809, the number m of the remaining periods during which the bus is not used is watched, and steps S810 and S811 are repeated until m equals 0. At step S810, the execution is delayed for 1 μsec, and at step S,811, m is decremented by 1. By doing this, 5 μsec is accurately spent until step S812 comes, and moreover, for 1 μsec of these 5 μsec, the bus is exclusively possessed at the interval of utilization of the bus by CPU 210, and the instruction fetch for the parallel processor processing can be effected. At step S812, the operation between the memories of the dual port RAM 411 or between the input and output ports is executed in accordance with the fetched instruction data. When the least significant bit of the program counter of the processor n is 1, the fetched instruction is disregarded and no execution is effected, and when said least significant bit is 0, the value of said program counter is incremented by 2 before the execution is effected, thereby preparing for the next instruction fetch. At step S813, the execution is delayed for a time corresponding to the time required at step S812, and an adjustment is made so as to spend 3 μsec at steps S812, S813, S814, S815 and S816. At step S814, the processor number n is incremented by 1 to advance a processor to be processed at the next step. At step S815, whether the processor number n has exceeded the maximum processor number is judged, and when it has exceeded the maximum processor number, the processor number n is set back to 0 and the program returns to step S802, whereafter the above-described processing is repeated.

By the operation as described above, the parallel processor controller 412 causes eight processors, i.e., processor 0 to processor 7, to execute time-divisionally and thus, can control the eight processors which execute one instruction in an apparent 64 μsec.

A description will now be given of the instruction of the processors 0–7 executed at step S812. The length of the instruction is a fixed length of 16 bits. The instruction can be classified into the following four: the byte operation in which the operation between eight registers allotted to the respective processors and the memory space of 7 bits is performed, the immediate byte operation in which the operation between the registers and the data of 7 bits is performed, the bit operation in which the operation between a particular bit and any bit of the 7-bit memory space is performed, and the jump operation in which the relative address branch-off of 10 bits is set in conformity with conditions.

The address spaces of the dual port RAM 411 and the I/O ports 212 and 213 will now be described.

The dual port RAM 411 is accessible by both of CPU 210 and parallel processor controller 412. Here, the address as viewed from each processor is called the local address, and the address as viewed from the parallel processor controller 412 is called the global address.

The address 00H to the address 07H of the local address correspond to the memory spaces for registers of the dual port RAM 411 allotted to the respective processors. The address 08H to the address 47H of the local address correspond to the remaining areas of the dual port RAM 411, i.e., the address COH to the address FFH of the global address. The address 48 to the address 7F of the local address correspond to the I/O port.

In this manner, the register space, the memory space, the memory space and the I/O port space can be mapped on the same address space.

A description will hereinafter be given of an example of the case where an electric instrument is controlled by the use of a processor of the architecture as described above.

Figure 2:
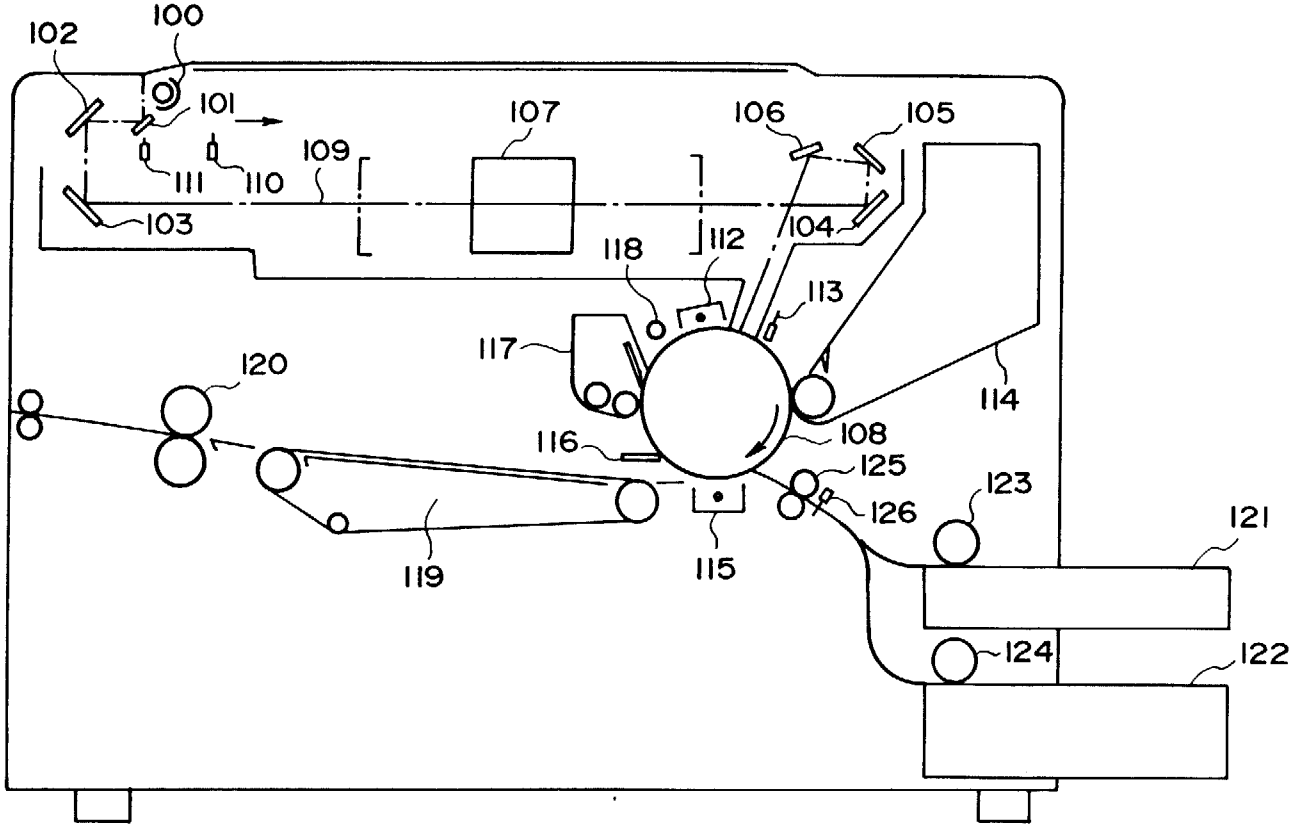
FIG. 2 is a cross-sectional view of a copying apparatus to which the present invention can be applied.
Figure 9:
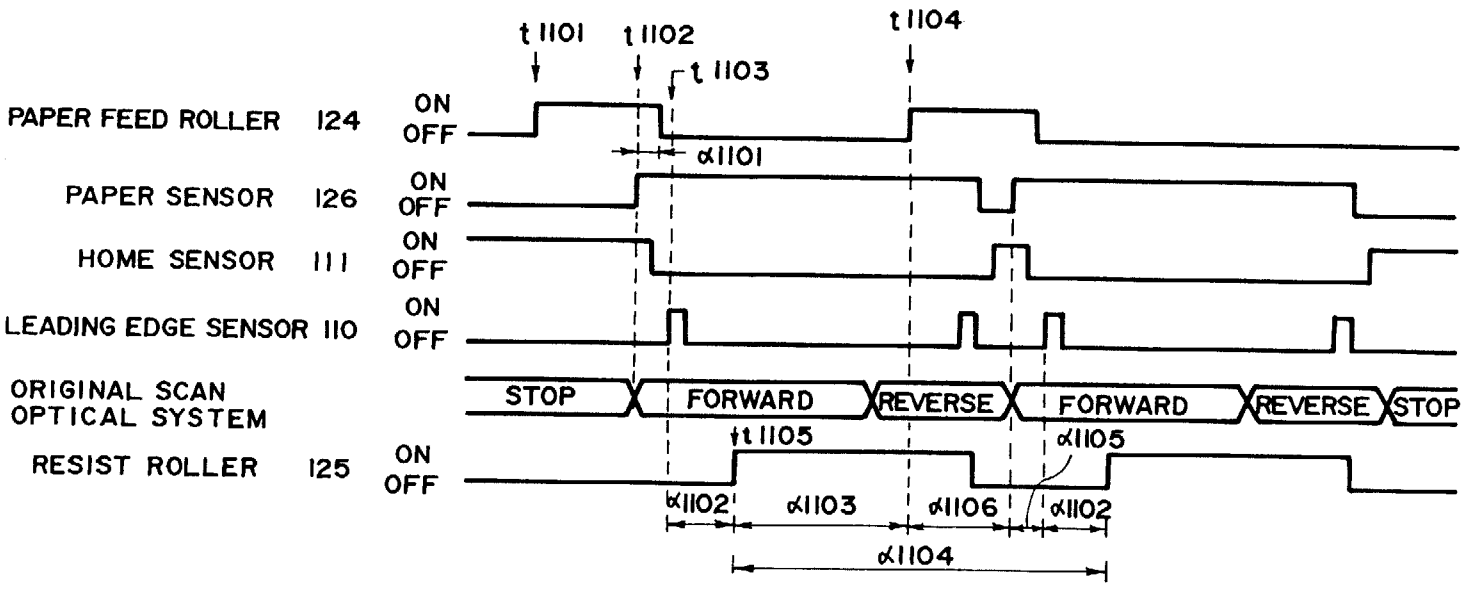
FIG. 9 shows the timing regarding the paper supply of the FIG. 2 copying apparatus.

FIG. 9 shows a timing chart regarding the paper supply system of the copying apparatus shown in FIG. 2. This example represents the control timing in which two-sheet copying is effected When paper supply is to be effected from a lower cassette 122, a port B5 is set to "1" at time t1101 and a clutch CL2 is engaged, whereby a paper feed roller 124 is rotated and the copying apparatus is picked up. At time t1102, paper is detected by a paper sensor 126 and, after a time α1101, the port B5 is set to "0" and the paper feed roller 124 is stopped. During this time α1101, the copying paper arrives at a resist roller 125 and waits for the start of rotation of the resist roller 125. On the other hand, at time t1102, the paper is detected, whereby the original scanning is started That is, the optical system moves forward At time t1103, it is known by a leading edge sensor 110 that the leading edge of the original has been imaged on a photosensitive drum 108, and after the time t1103, in a time α1102 which is the time when the imaged position arrives at the transfer position, minus the time when the copying paper arrives at the transfer position after the resist roller 125 is rotated, a port B6 is set to "1" and a clutch CL3 is engaged, whereby rotation of the resist roller 125 is started.

Where a plurality of sheets of copies is to be obtained as in this example, if the original scan optical system is moved forward by an amount corresponding to the length of the original and then is moved back to the home position and thereafter paper feed is started, the time till the next copying will become long. To prevent this, at time t1104, the feeding of the next paper is started. This timing occurs in a time α1103 after the time when the resist roller 125 has been switched on, and this time α1103 is the copying time α1104 per sheet, minus the time α1102, the time α1106 from after the paper feed roller has started to be driven until the paper sensor is again switched on and the time α1105 required for the original scan optical system to arrive at the leading edge sensor from the home position. The time α1104 is determined by the size of the copying paper. This minimum value is the reciprocal original scanning time. Also, the time α1105 is determined in conformity with the magnification change rate.

Figure 10:
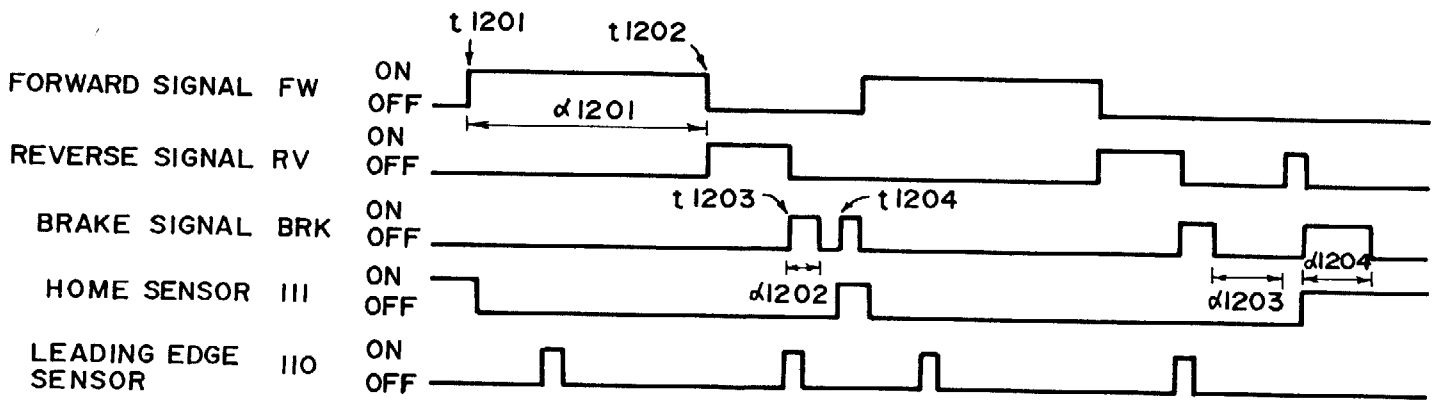
FIG. 10 shows the timing regarding the original scan system of the co apparatus.

On the other hand, the original scanning is controlled by supplying to a scan motor controller 230 a signal FS of a frequency corresponding to the scanning speed from a port CO and a forward signal FW, a reverse signal RV and a brake signal BRK from ports B0, B1 and B2, respectively. The timing chart for this control is shown in FIG. 10.

When forward movement is to be effected, the velocity of forward movement is determined by the then copying magnification and therefore, the programmable oscillator 214 is so set as to effect oscillation of a frequency corresponding thereto, whereafter the reverse signal RV and the brake signal BRK are set to "0" and the forward signal FW is set to "1", and then forward movement is started. This takes place at time t1201. At time t1202 after a time α1201 during which the original scan optical system is moved forward by an amount corresponding to the length of the original, the forward signal is set to "0" and the velocity of reverse movement is set in the programmable oscillator 214, and the reverse signal is set to "1". When the leading edge sensor 110 has sensed the leading edge signal, that is, at time t1203, the reverse signal is set to "0" and the brake signal BRK is set to "1" for a time α1202. Thereafter, the original scan optical system is moved back by inertia, and at time t1204 when the optical system has been returned to the home position by the home position sensor 111, the brake signal BRK is set to "1". The brake signal BRK is then set to "0" to effect copying of the second sheet, whereafter the velocity of forward movement is set and the forward signal FW is set to "1", and the above-described control is repeated The second half of FIG. 10 shows an example of the case where the scan system is stopped and does not arrive at the home position after the setting of the brake signal BRK which takes place after the leading edge sensor 110 senses the position of the scan system during its reverse movement That is, when the scan system does not arrive at the home position within a time α1203 after the brake signal BRK has been set back to "0", a low velocity is set and the reverse signal RV is set to "1", whereby the scan system is slowly moved back until the home position is detected, and when the home position is detected, the reverse signal RV is set to "0" and the brake signal BRK is set to "1". After a maximum time α1204, the brake signal BRK is set to "0".

As described above, the control of the original scan optical system and the paper supply system is considerably complicated.

In the present embodiment, a processor PROCO in the parallel processor control 412 is allotted to the control of the paper supply system including the paper feed roller, the resist roller, etc. and another processor PROC1 is allotted to the control of the original scan optical system such as the forward signal FW, and CPU 210 sets the data to these processors and monitors the operation of the processors, thereby effecting the control of the copying apparatus.

Figure 11B:
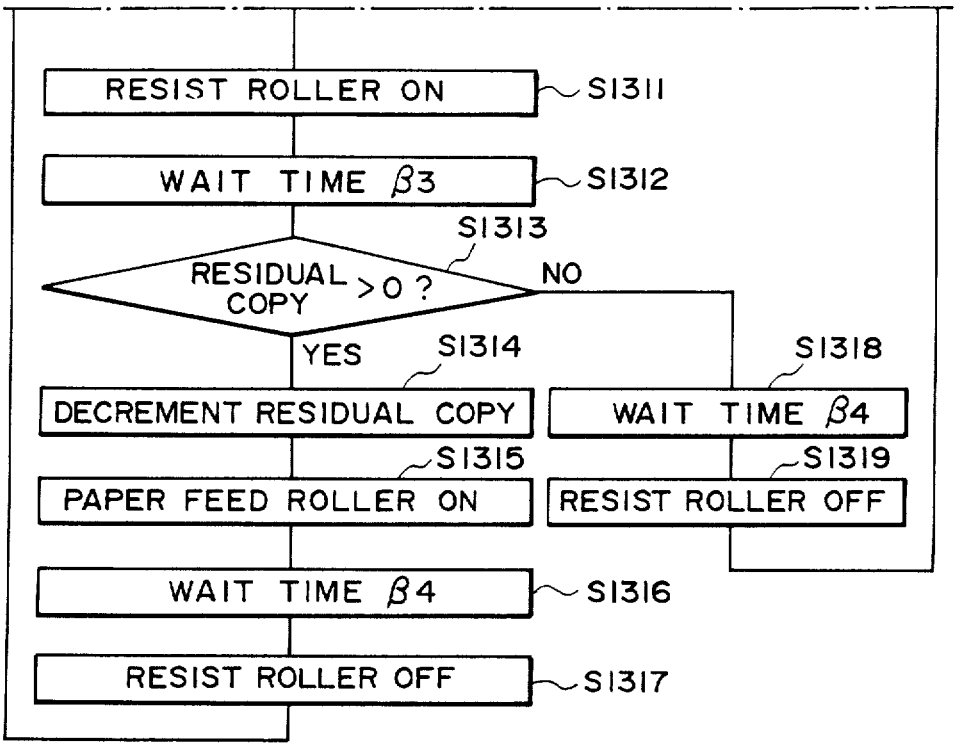
FIGS. 11, 11A and 11B show flow chart of a paper feed system.
Figure 11:
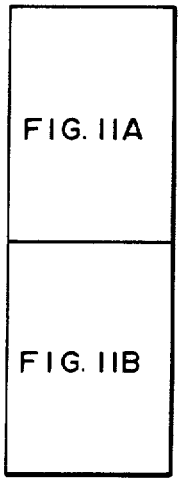
Figure 11A:
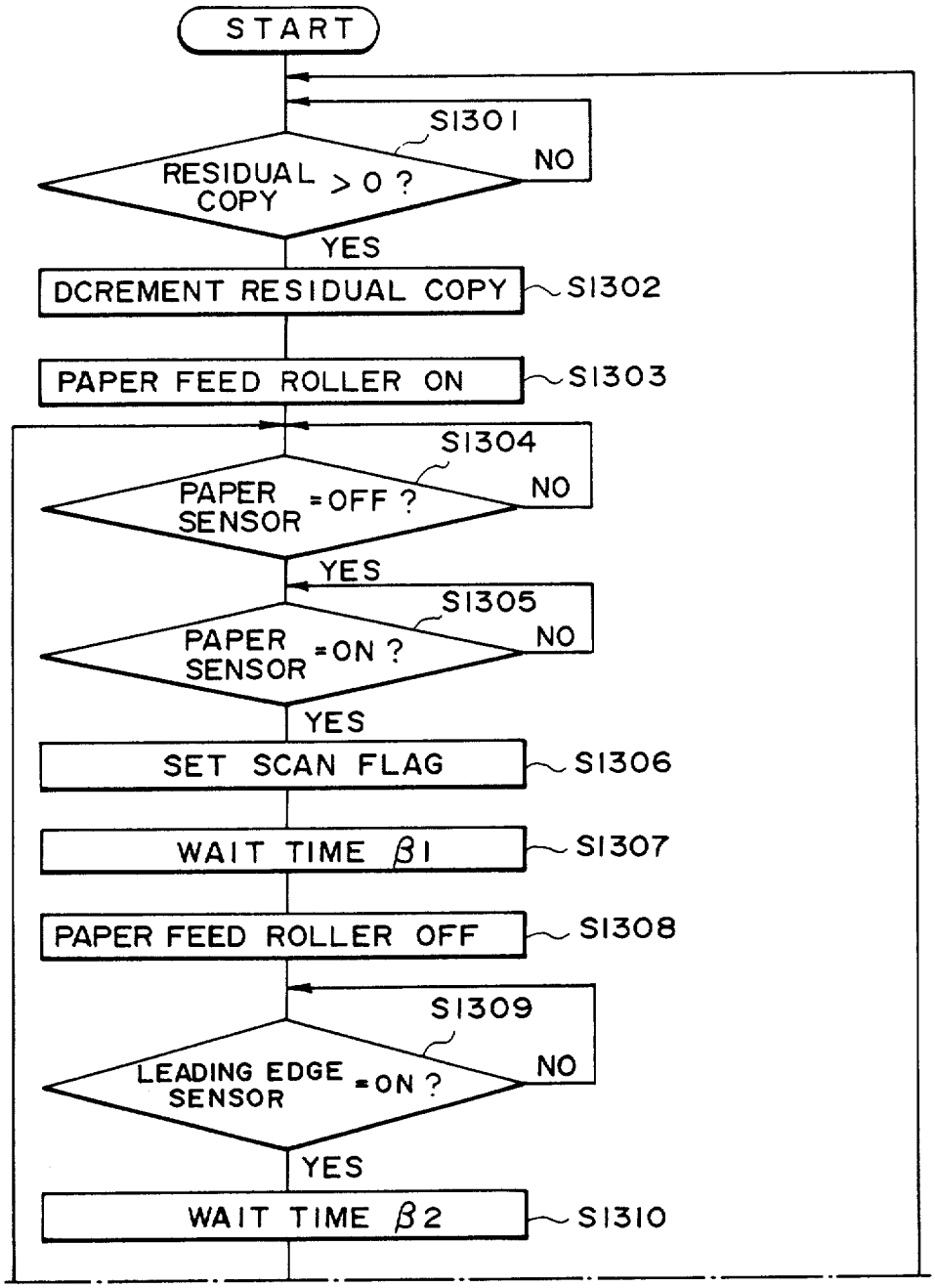

FIG. 11 shows a flow chart of an example of the control program of the paper supply system effected by the processor PROCO. When execution is started, whether there is a number N of residual copies is checked at step S1301, and step S1301 is repeated until the number N of residual copies becomes 1 or more.

Figure 12:
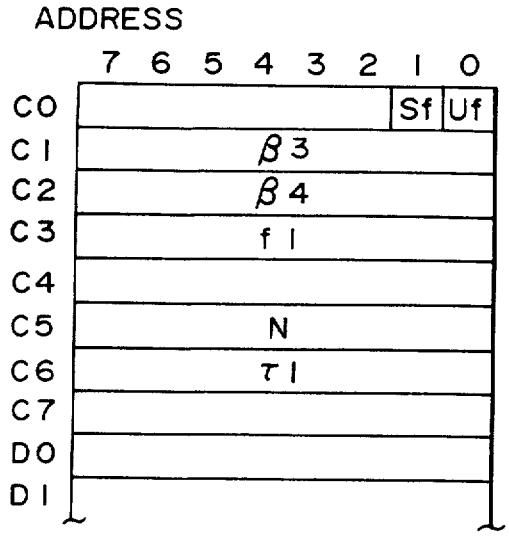
FIG. 12 shows the memory map of a dual port RAM 411.

In FIG. 12, there is shown an example of the memory map of the memory areas of the dual port RAM 411.

Figure 13:
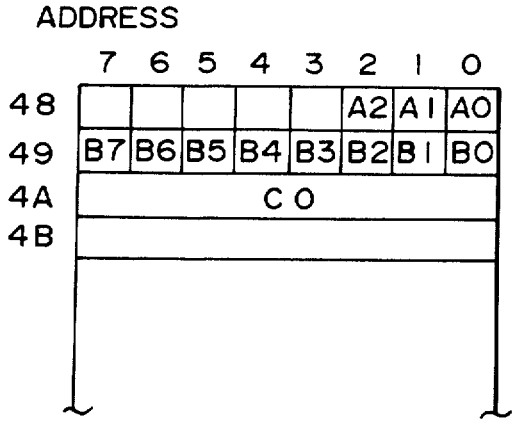
FIG. 13 shows the area of an I/O port.

As regards the number N of residual copies, the value N is set at the address C5H of the global address by CPU 210. When the operator has designated the start of copying by means of a copy start button or the like, CPU 210 writes into the address C5H the number of copies defined at that point of time. At step S1302, the number of residual copies is decremented by 1. At step S1303, flag Uf, i.e., the 0th bit of the address CO of the global address is checked, and when it is 1, selection of the upper cassette is judged, and when it is 0, selection of the lower cassette is judged and correspondingly thereto, the paper feed roller 123 or the paper feed roller 124 starts to be rotated. For example, when flag Uf is 1, a port B4 is set to 1, whereby the upper paper feed roller 123 is rotated. This can be realized by setting the fourth bit of the address 49H of the area of the I/O port shown in FIG. 13. This may be done by the use of the instruction for bit operation.

At step S1304, the paper sensor check is continued until the paper sensor 126 is switched off, and when the paper sensor 126 is switched off, step S1305 is repeated until the paper sensor 126 is switched on. This is done by taking into account a case where the trailing end of a paper sheet being copied before the paper sheet being fed touches the paper sensor 126.

At step S1306, scan flag Sf is set to designate the start of the forward movement of the original scan optical system. Flag Sf is allotted to the first bit of the address COH of the global address.

At step S1307, the program waits for a predetermined time β1. The instruction executing time is constant even in the parallel processors as previously described and therefore, the program is made such that the register is used as a counter to count up or count down and the program proceeds to the next step when a certain value is assumed, and the waiting time can be adjusted by the initial value of that register used as a counter. This time β1 is a time corresponding to the time α1101 in FIG. 9. At step S1308, the paper feed roller is switched off. In this case, watching the flag Uf, the corresponding port B4 or port B5 may be set to "0" or both of the ports B4 and B5 may be set to "0".

At step S1309, the program waits until the leading edge sensor 110 becomes switched on, whereafter at step S1310, the program waits for a time β2, and at step S1311, rotation of the resist roller 125 is started. The time β2 corresponds to the time α1102 in FIG. 9. At step S1312, the program waits for a time β3, and subsequently, whether the next paper supply should be effected is checked. The time β3 corresponds to the time α1103 in FIG. 9. At step S1313, the number N of residual copies is examined and, when copying is still needed, the program proceeds to step S1314, and when the necessary paper supply is terminated, that is, when the number of residual copies is 0, the program proceeds to step S1318. At step S1314, the number N of residual copies is decremented by 1 and the program prepares for the next paper supply, and at step S1315, processing similar to that of step S1303 is effected and paper supply is started. At step S1316, the program waits for a time $\beta 4$, and at step S1317, rotation of the resist roller 125 is stopped. The time $\beta 4$ is the time obtained by dividing the size of the paper fed in the direction of movement by the peripheral speed of the photosensitive drum 108, minus the time $\beta 3$, plus some surplus time.

The program then proceeds to steps S1314–S1317, and when a continuous copying process is to be effected, the program returns to step S1304 and the above-described processing is repeated. When the feeding of the last paper sheet is completed, the program branches off from step S1313 to step S1318 and returns to the initial step via step S1319, and the above-described processing is repeated from step S1301. The processings of steps S1318 and S1319 are similar to those of steps S1316 and S1317. Of the times $\beta 1$, $\beta 2$, $\beta 3$ and $\beta 4$ in the above-described processing, the times $\beta 1$ and $\beta 2$ are of a fixed length and the times $\beta 3$ and $\beta 4$ are varied by the magnification change rate and the size of the copying paper. Therefore, the times $\beta 3$ and $\beta 4$ are set at the addresss C1H and C2H of the global address before CPU 210 sets the number of residual copies at the address C5H of the global address.

The processing of the original scan optical system will now be described.

Figures 14, 14C:
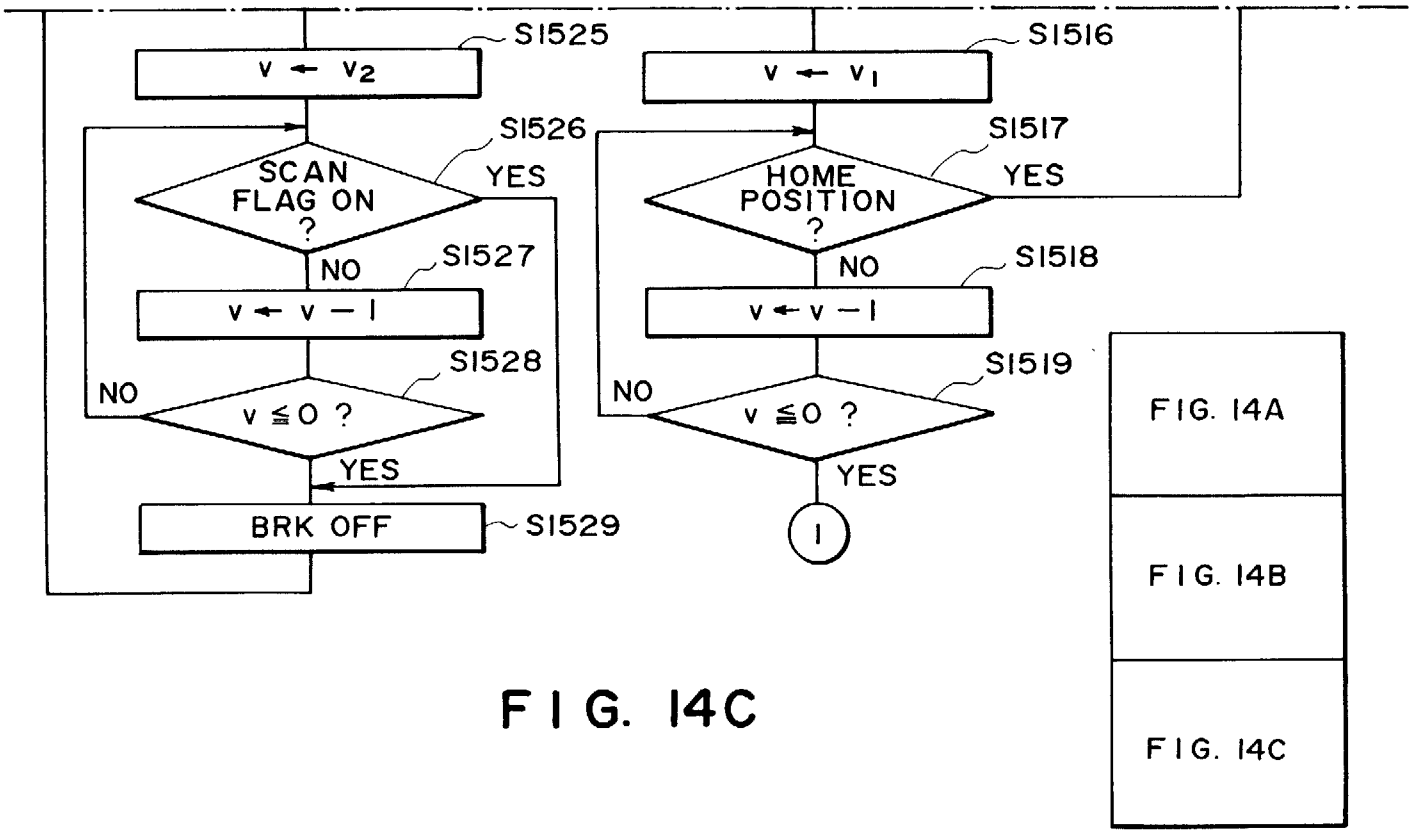
FIGS. 14, 14A, 14B, and 14C show the flow chart of the original scan system.
Figure 14A:
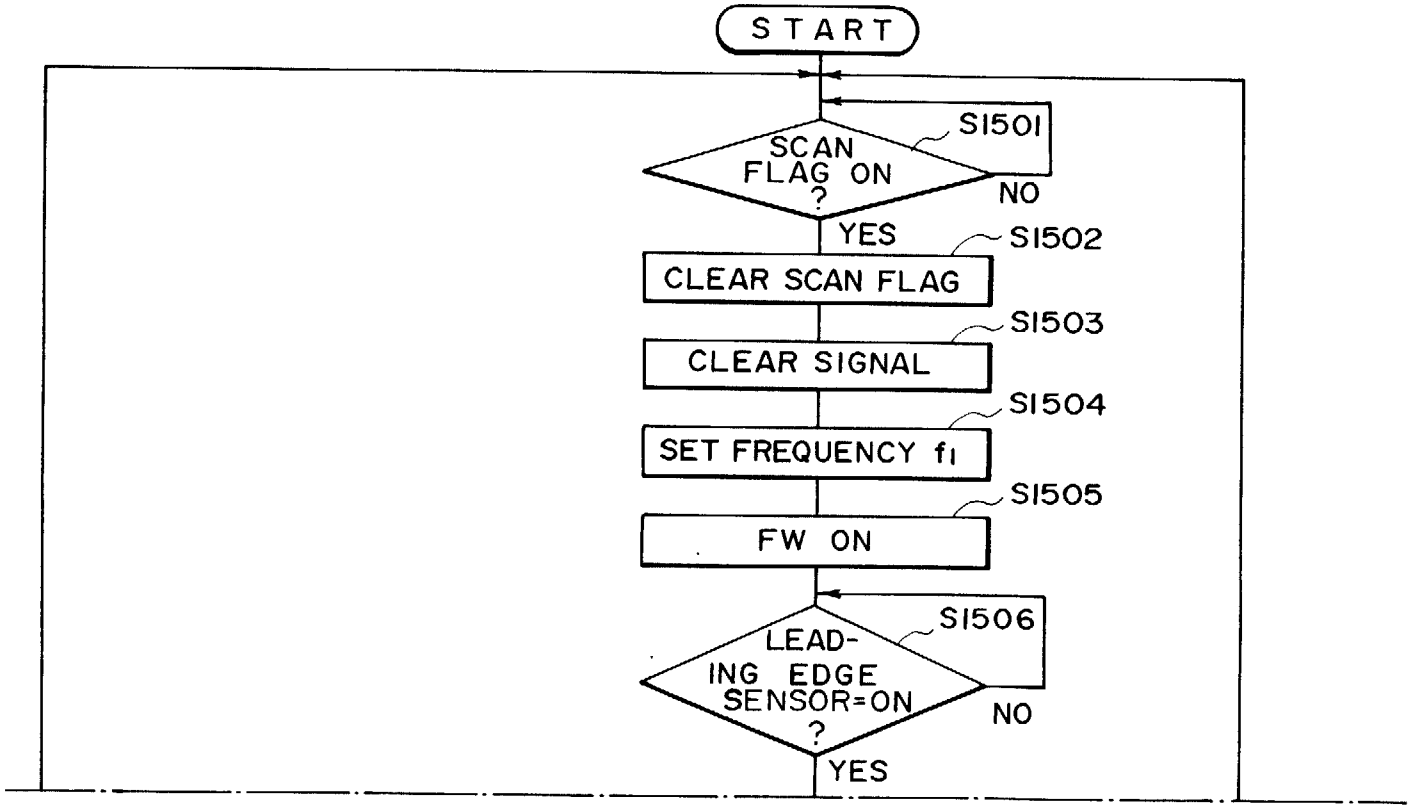
Figure 14B:
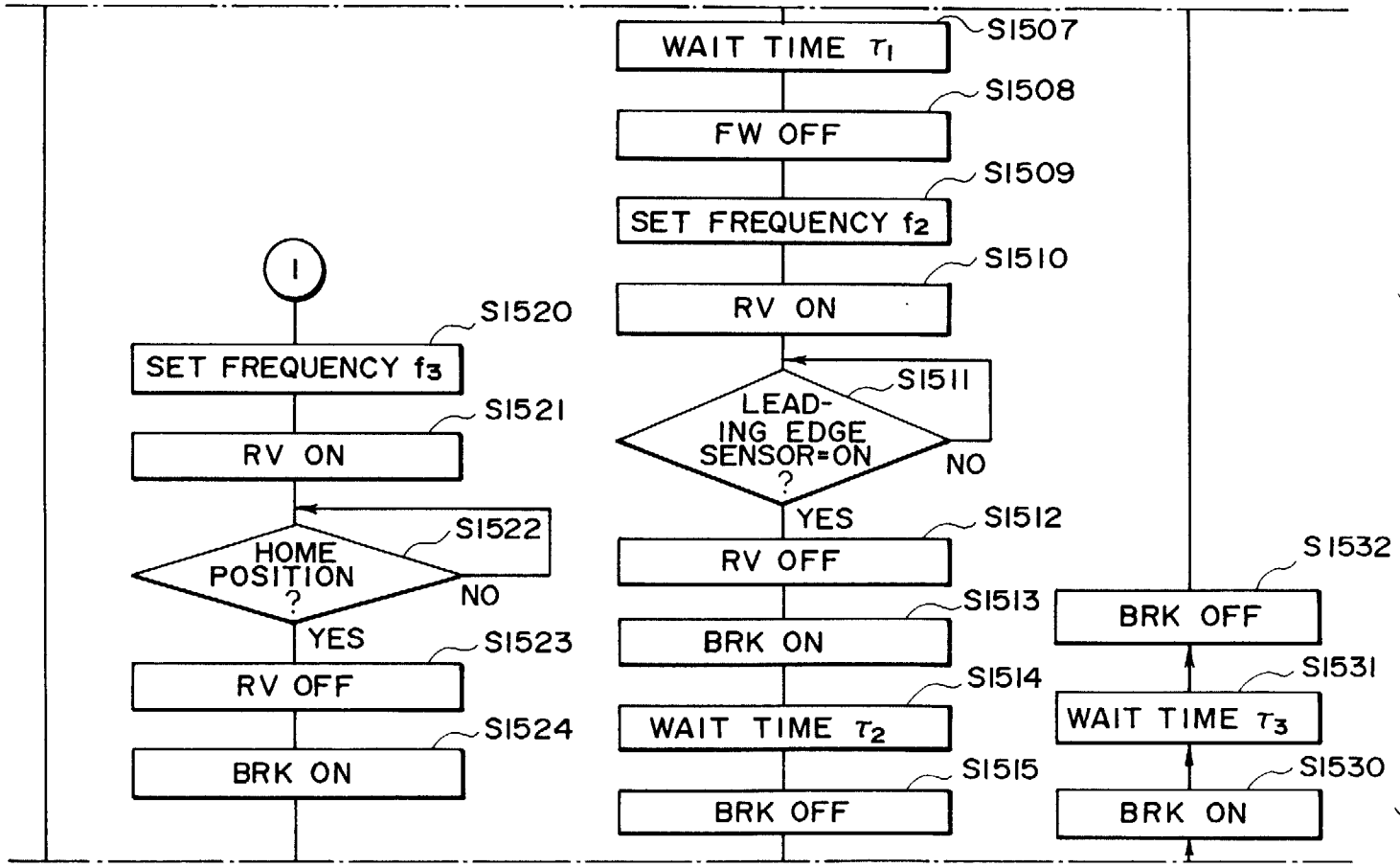

FIG. 14 shows a flow chart of an example of the control program of the original scan optical system carried out by the processor PROC1.

When execution is started, at step S1501, the program waits until the scan flag Sf becomes switched on, and when the scan flag Sf is switched on, the program proceeds to step S1502. This is set at a point of time whereat the copying paper has been moved to the position of the paper sensor 126 in front of the resist roller 125 by the paper supply system control program. That is, actuation of the optical scan system is effected when the preparation for the start of copying has been completed. At step S1502, the scan flag Sf is cleared to show that the request for original scan has been accepted At step S1503, the signals of the scan system are all cleared. That is, the ports B0, B1 and B2 are set to "0" to clear all of the forward signal FW, the reverse signal RV and the brake signal BRK.

At step S15J4, in order to scan the original at a speed corresponding to the magnification change rate, setting of the programmable oscillator 214 is effected so that a signal of a frequency corresponding to this speed is put out from the port CO. More specifically, the frequency setting port CO of the programmable oscillator s allotted to the address 4AH of the I/O port area and a value f1 set at the address C3H of the global address by CPU 210 is written thereinto, whereby setting of the programmable oscillator is accomplished. At step S1505, the port B0 is set to "1", whereby an instruction to start forward movement is put out to the scan motor controller 230. At step S1506, the program waits until the leading edge sensor 110 becomes switched on, whereafter at step S1507, the program waits for a time $\tau 1$ during which scanning is effected by an amount corresponding to the length of the original, and at step S1508, the forward signal is turned off. The time $\tau 1$ is pre-written into the address C6H of the global address by CPU 210. At step S1509, a value is set at the address 4AH of the area of the I/O port so that a frequency f2 corresponding to the speed during reverse movement is provided, and at step S1510, the reverse signal RV is turned on to thereby start reverse movement. Thereafter, at step S1511, it is monitored that the leading edge sensor 110 is switched on, and when the leading edge sensor is switched on, brake control is started so that the scan optical system may not overrun and collide At step S1512, the reverse signal RV is turned off, and at step S1513, the brake signal BRK is turned on to apply the brake. At step S1514, the program waits for a time $\tau 2$, and at step S1515, the brake signal BRK is turned off, whereafter the scan system is moved reversely by inertia. Hereupon, at step S1516, a predetermined number of times $\nu l$ is substituted into a register $\nu$ and steps S1517, S1518 and S1519 are repeated over this number of times. This register $\nu$ may use any of the exclusive memory areas of the processor PROC1 and the addresses 01H to 05H of the local address. Thus, at step S1518, the register $\nu$ is decremented by 1 each and at step S1519, it is judged that the value of the register $\nu$ becomes 0, and then the program returns from step S1519 to step S1517. At step S1517, the home position sensor 111 is monitored and, when it is switched on, the program proceeds to step S1530 even if the value of the register $\nu$ has not become 0. At step S1530, the brake is applied and after a time $\tau 3$, at step S1532, the brake signal is turned off and the program returns to step S1501. When the scan system does not return to the home position even if the value of the register $\nu$ has become 0, the program proceeds to step S1520.

At step S1520, the programmable oscillator 214 is set so that a frequency f3 is put out to move the scan system reversely at a low speed, and at step S1521, the reverse signal RV is turned on. At step S1522, the program waits until the scan system comes to the home position, and at step S1523, the reverse signal RV is turned off. Then, at step S1524, the brake signal BRK is turned on, and at step S1525, the register $\nu$ is initialized by a predetermined number of times $\nu 2$, and at steps S1527 and S1528, the register $\nu$ is decremented and step S1526 is repeated until the value of the register $\nu$ becomes 0. Step S1526 is for checking whether the scan flag Sf has been switched on, and when the scan flag has been switched on, the program leaves this loop and proceeds to step S1529. At step S1529, the brake signal BRK is turned off and the program returns to step S1501, whereafter the above-described control is repeated. The processing of step S1524 to step S1529 is an example of the algorithm for applying the brake for a maximum time determined by $\nu 2$ and immediately starting the scanning when an instruction for starting the scanning has again come within that time As described above, the programs of the paper supply system and the original scan system are prepared independently of each other, and the program of CPU 210 is made such that the times $\beta 3$, $\beta 4$ and $\tau 1$ determined by conditions such as the magnification change rate and the size of the copying paper and the flag Uf indicating the set frequency value f1 and the selection of the paper supplier, i.e., the upper or lower cassette, are set and that the number of copies is set to the number N of residual copies. If the leading addresses of the programs of the paper supply system and the original scan optical system are set at the respective program counters of the parallel processors, these will be parallel-processed. Therefore, the control of which responsiveness is required, such as the timing at which the resist roller starts to be rotated after the leading edge sensor has been switched on, can also be accomplished without delay, and the burden of CPU 210 is greatly reduced.

As described above, the parallel processor controller is coupled to CPU through the dual port RAM and the control of I/O is effected by the individual parallel processors and those of the delay time, the number of times, the controlled object, etc. which are varied by the operator's operation or the like have their values calculated by the CPU and fetched to the processors through the dual port RAM to control the instrument, whereby a plurality of parallel controls of high response speed can be accomplished. Thus, the circuit which has heretofore required a plurality of microprocessors for responsiveness can be constructed of one chip, which means a reduced cost. Moreover, the overhead of the data exchange between chips which has heretofore resulted from the use of a plurality of chips and the overhead for the change-over of the program for the parallel processing in the fashion of software are eliminated and the microprocessors can be efficiently utilized Further, respective control programs are prepared with logical parallel operations as parallel processes, whereby the programs can be smoothly made and moreover, the respective programs operate without overhead and therefore, skillful programming for high-speed response becomes unnecessary and development of programs becomes easy. This leads to the possibility of greatly reducing the cost of development.

[Second Embodiment]

Figure 15:
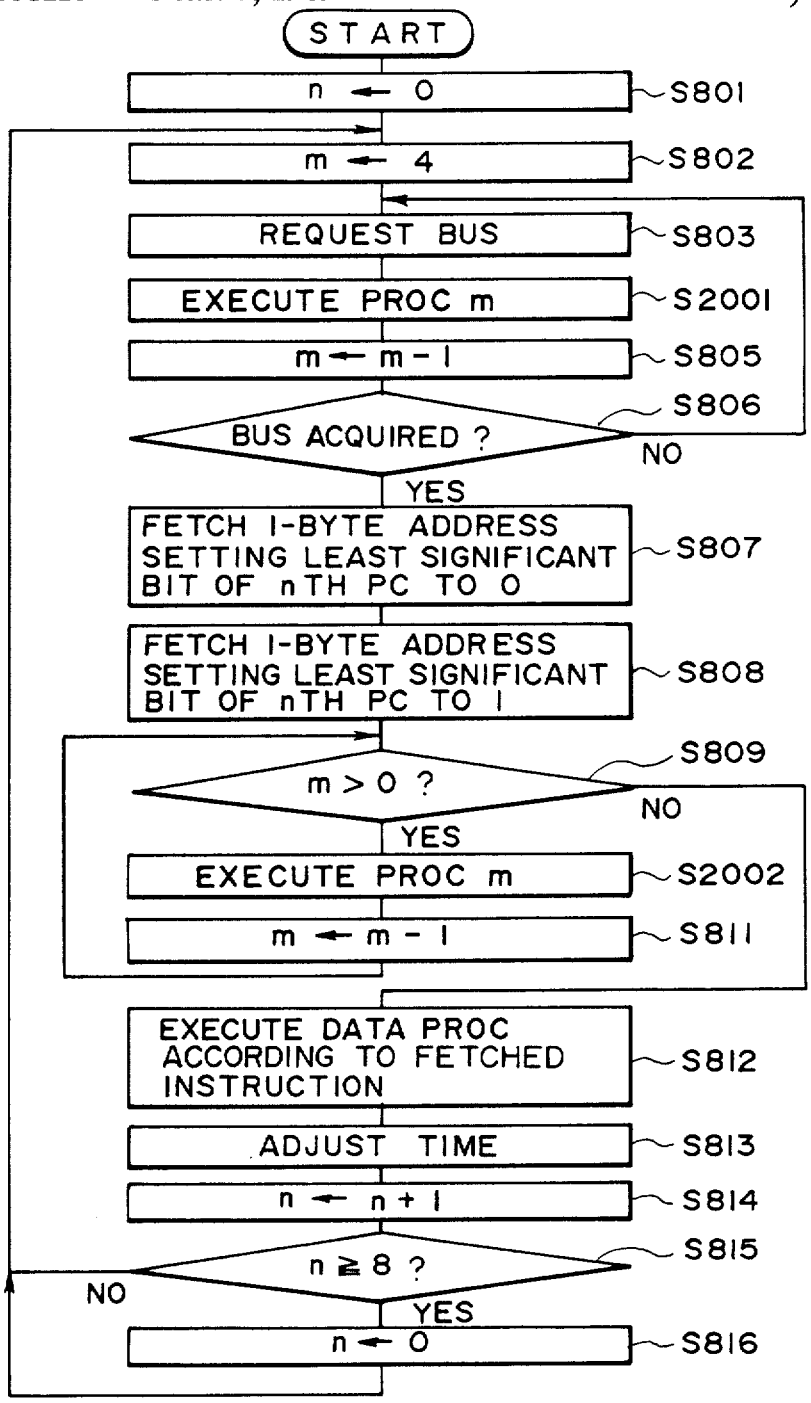
FIG. 15 shows the flow chart of another embodiment of the present invention.

FIG. 15 shows a flow chart of another embodiment of the present invention. In this chart, steps S2001 and S2002 are used instead of the chart steps S804 and S810 of FIG. 8. The processes m of steps S2001 and S2002 are definite forms of processing which can be executed without accessing ROM 203 and RAM 202 through the external bus 204. By the respective pairs of steps S2001, S805 and steps S2002, S811, processing 4, processing 3, processing 2 and processing 1 are executed relative to the processing of the nth processor of steps S802 to S815. That is, when the instruction fetch of the processor is thus effected, the timing utilizing the external bus interface 413 is adjusted and while the actual instruction fetch is being waited for, the processing which does not use the external bus 204 can be executed to enhance the processing capability.

Figure 16:
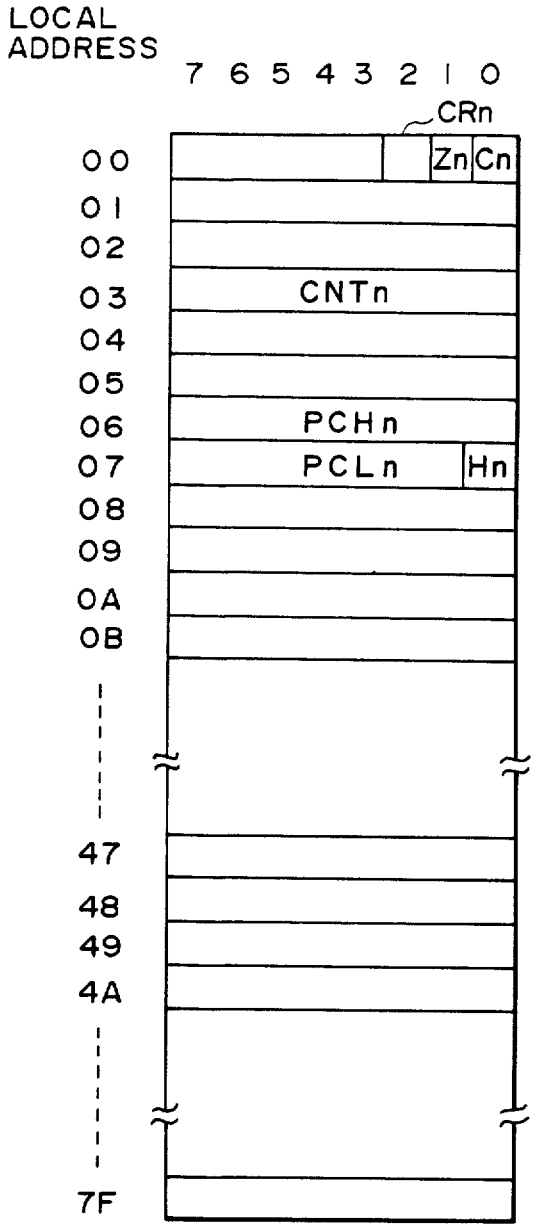
FIG. 16 shows a memory address.
Figure 17:
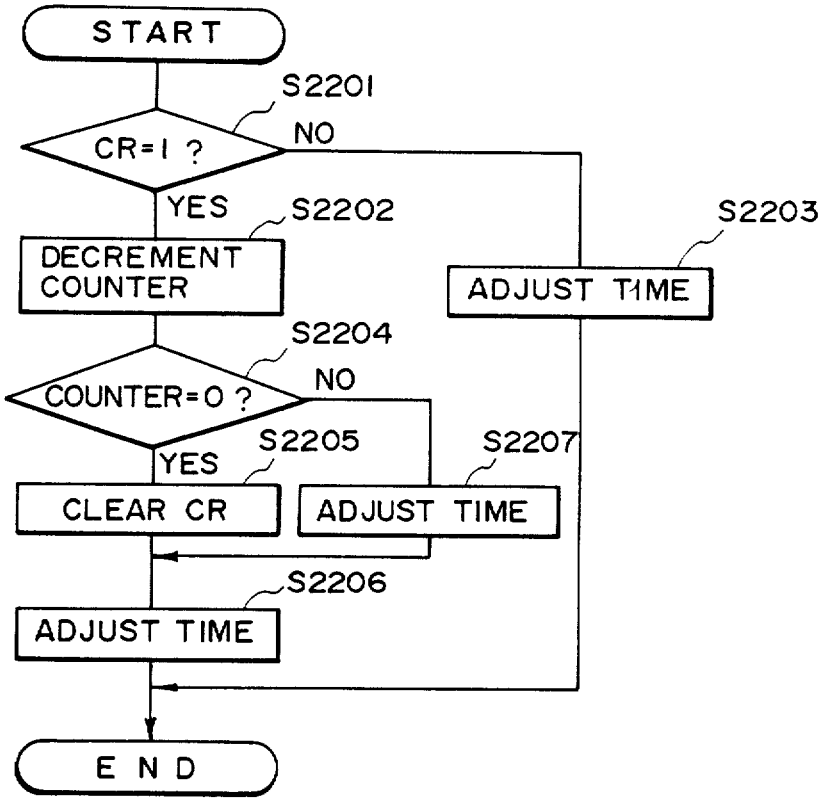
FIG. 17 shows the detailed processing program of the processing m of FIG. 15.

For example, as shown in FIG. 16, the second bit of the address 00H of the local address is allotted as a counter control flag CRn and the address 03H of the local address is allotted as a counter. One of the processes m is executed as the processing according to the flow chart of FIG. 17 by the parallel processor controller 412.

At step S2201, the second bit of the address 00H of the local address of the processor n is watched. That is, if the second bit of the address (80H $+8\times n$) of the global address is "1", the program proceeds to step S2202, and if said second bit is "0", the program is terminated via step S2203. Step S2203 is a processes for ensuring the same time is required whatever this processing may be, and is for ensuring 1 $\mu$ sec to be required, for example, from the start till the termination. Steps S2206 and S2207 are for likewise ensuring, for example, 1 $\mu$ sec. is be required even if any branching-off is effected Step S2202 decrements the counter by 1. In the case of the processor n, this counter is the RAM at the address (80H $+8\times n+3$) of the global address At step S2204, when the decremented result is 0, the program proceeds to step S2205, and when the decremented result is not 0, the program proceeds to step S2207. At step S2205, once the counter is decremented to clear the aforementioned CRn, the decrementing operation is terminated and the countdown is stopped.

When the control as described above is effected, in the program a of each processor, the initial timer value is substituted into the address 03H of the local address and subsequently, the bit CRn is set to "1", whereby thereafter, the timer function can be realized simply by monitoring the bit CRn becoming "0". Where there are eight processors and execution is effected for a fixed time of 8$\mu$ sec per instruction, timer decrement is carried out every 64 $\mu$ sec.

Figures 18, 18C:
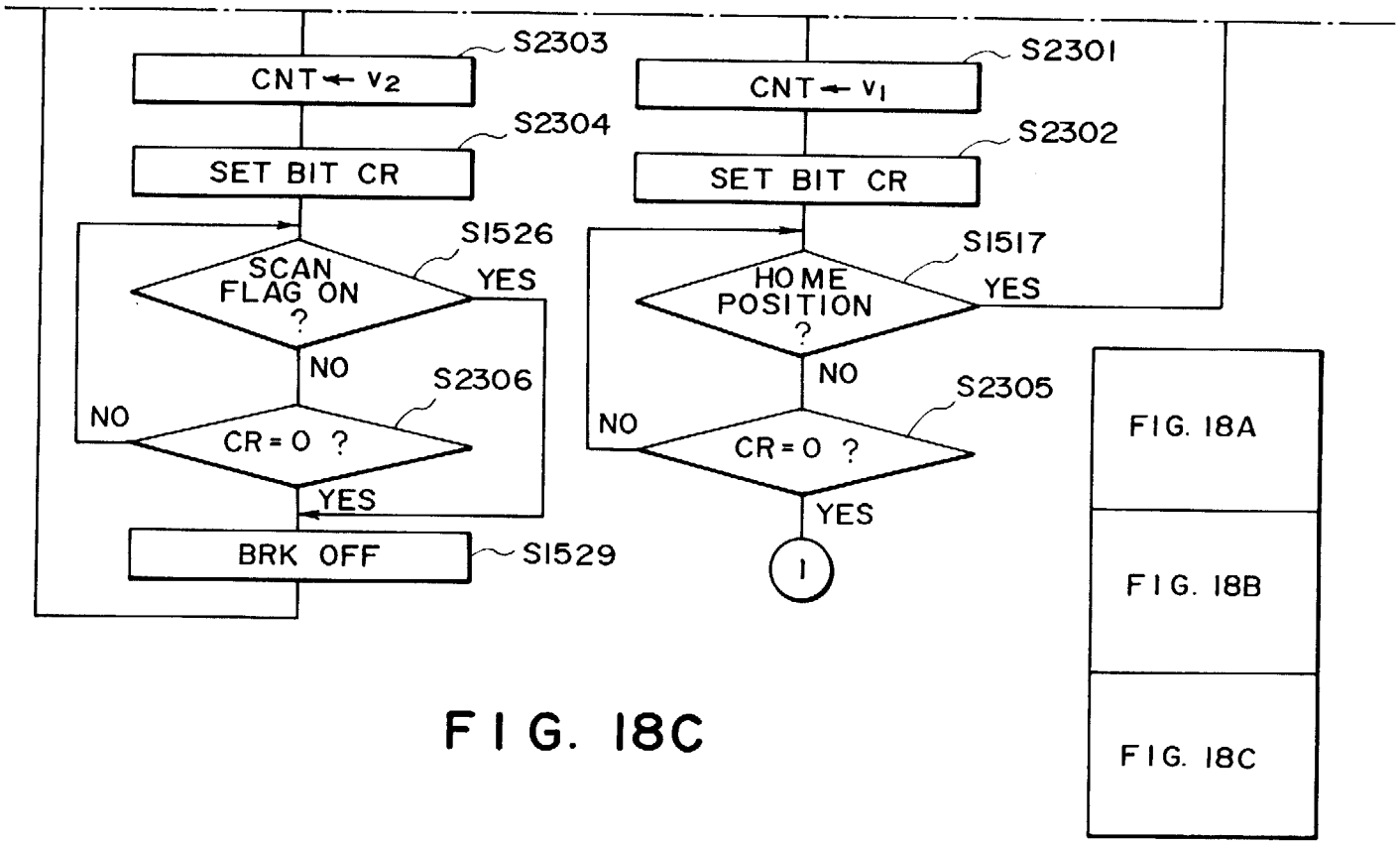
FIGS. 18, 18A, 18B, and 18C show the flow chart of the original scan system of another embodiment.
Figure 18A:
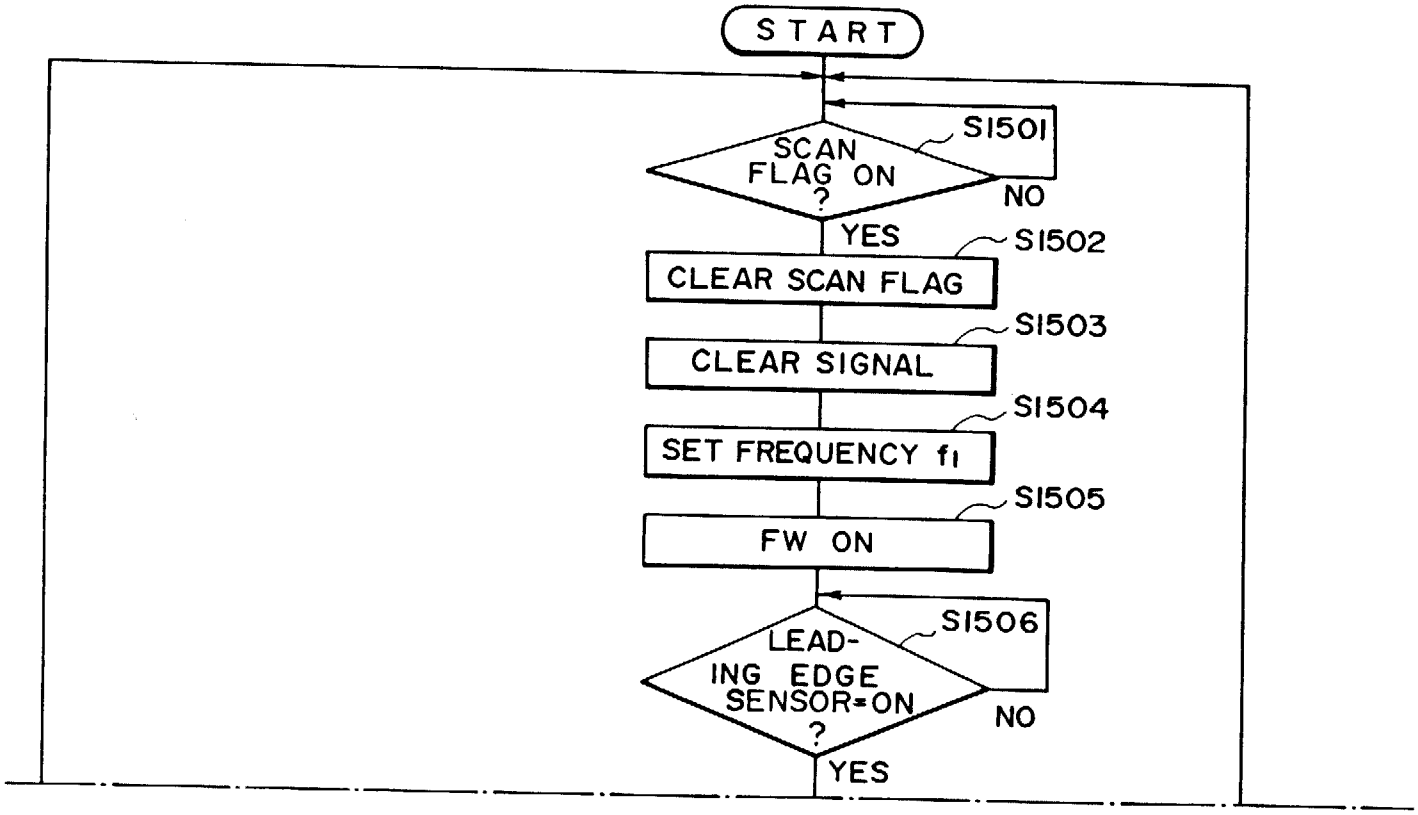
Figure 18B:
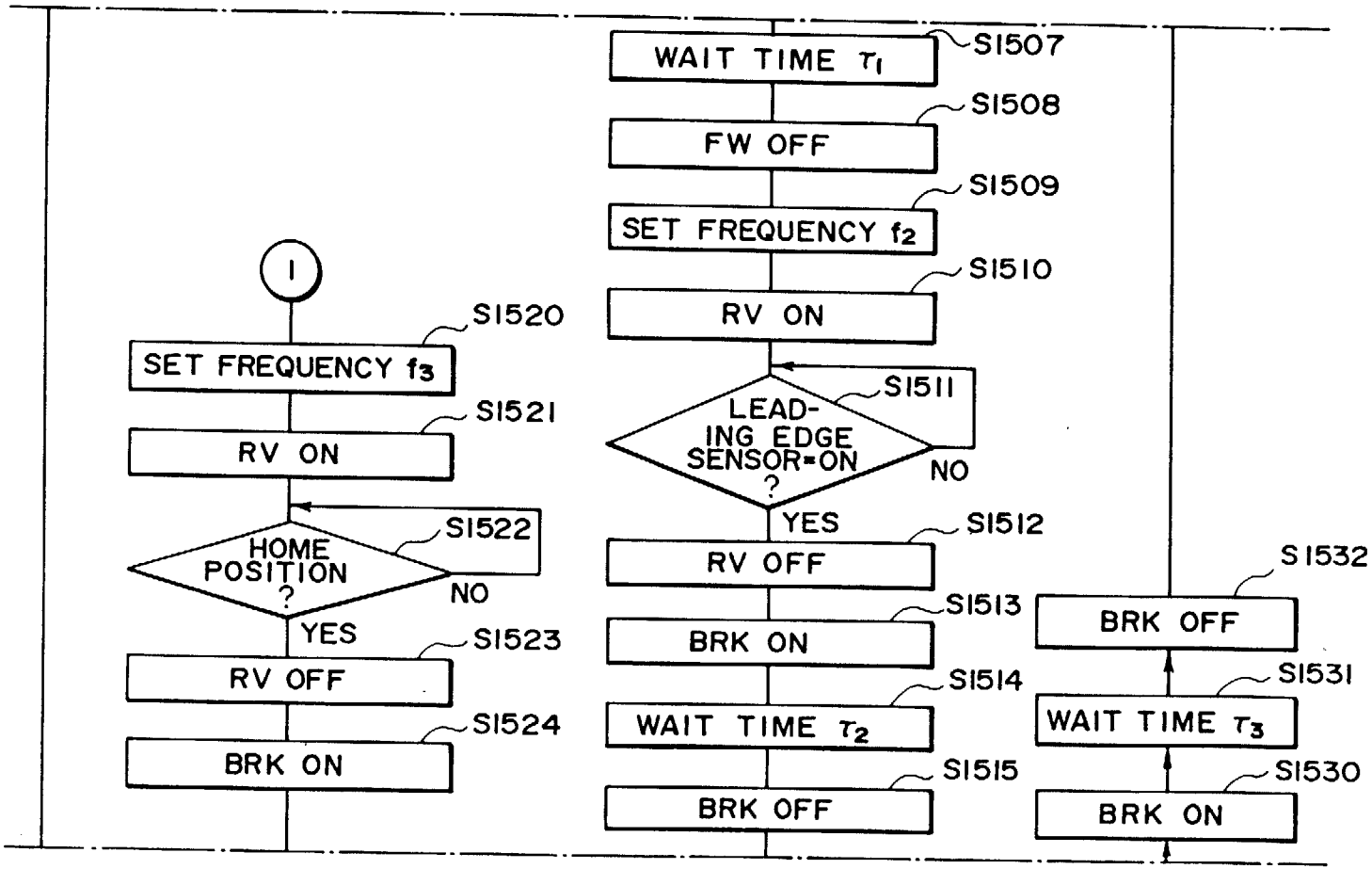

For example, the aforedescribed program of the original scan system can be changed as shown in FIG. 18(*c*).

That is, steps S2301, S2302 and steps S2303, S2304 are used in place of the steps S1516 and S1525 of FIG. 14. At step S2301, the number of times V1 is set as the initial value of the counter, and at step S2302, the counter movement instructing bit CR is set and count-down is started every 64 $\mu$ sec. Likewise, at step S2302, the number of times V2 is set as the initial value of the counter, and at step S2304, the bit CR is set. At steps S2305 and S2306, whether the bit CR is 0 is judged, and when the bit CR is not 0, the program returns to the next step at which the bit CR has been set, and the work is repeated until the bit CR becomes 0.

By doing so the counter decrement of steps S1518 and S1528 of the conventional program becomes unnecessary. Moreover, even if a step is added between step S2302 and step S2305, it becomes unnecessary to change the value of the number of times V1. In the previous embodiment, the time obtained by multiplying the required time for the repetition of steps S1517, S1518 and S1519 by the number of repetition times V1 is the maximum time and therefore, in order that the maximum time may be the same by adding a step therebetween, it has been necessary to change the value of the number of times V1. In contrast, in the present embodiments the counter is decremented every predetermined period of time independently of the steps and therefore, such a consideration becomes unnecessary and correction of the program becomes easy.

[Third Embodiment]

Figure 19:
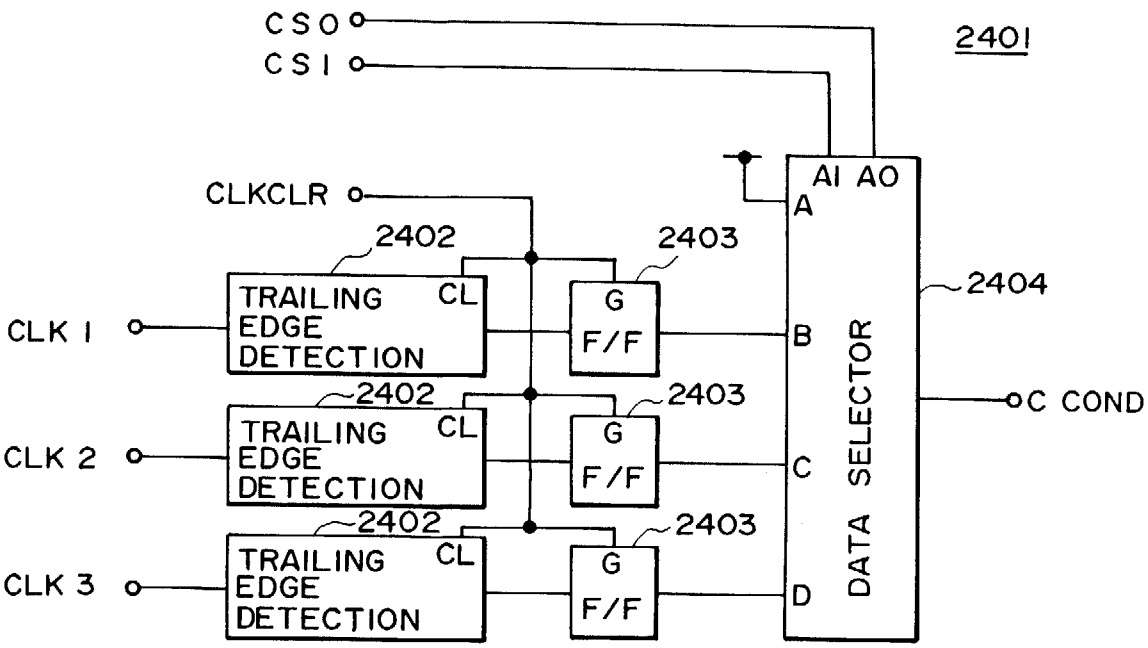
FIG. 19 is a diagram of an external clock input circuit.

Still another embodiment will hereinafter be described. FIG. 19 shows an example of the external clock input circuit 2401 additionally contained in the microcomputer 401. Three trailing edge detecting circuits 2402 receive as inputs external clocks from terminals CLK1, CLK2 and CLK3 added to the microcomputer 401. Each trailing edge detecting circuit 2402 puts out "1" when it detects the trailing of the external clock after an initializing signal CLKCLR becomes 1 and is cleared, and remains "0" during the time that there is no trailing. This output is connected to the input of each flip-flop 2403. The flip-flops 2403 hold until the initializing signal CLKCLR becomes 1 and the flip-flops receive the output values of the edge detecting circuits 2402 as inputs and the next initializing signal CLKCLR becomes 1. A data selector 2404 selects one of inputs A, B, C and D by the values of selection signals CS0 and CS1, and puts it out as a signal CCOND. For example, when the signals CS1 and CS0 are 00, A is selected and the signal CCOND becomes 1. Also, when the signals CS1 and CS0 are 01, B is selected, and when there is the trailing of the external clock signal CLK1, the signal CCOND becomes 1, and when there is no trailing of said external clock signal, the signal CCOND becomes 0.

Figure 20:
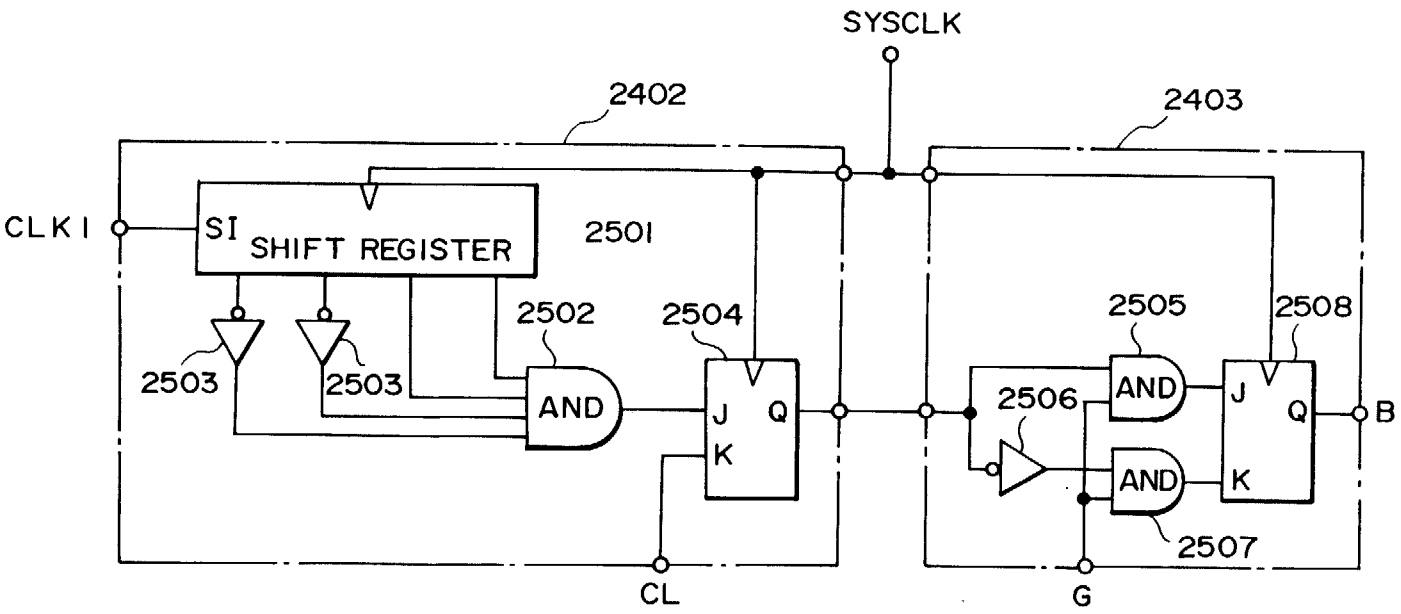
FIG. 20 is a diagram of a trailing edge detecting circuit.

The trailing edge detecting circuits 2402 and the flip-flops 2403 can be realized by a circuit as shown, for example, in FIG. 20. This system is an example of the synchronization type, and it samples data by the utilization of the fundamental clock or the like of the microcomputer and detects the time-serial trailing of the sampled data. The external clock signal is input to the serial input terminal SI of a 4-bit parallel output shift register 2501. The shift register 2501 shifts the data successively by a system clock SYSCLK. A 4-input AND gate 2502 directly receives as inputs two older shifted bits of the shift register 2501, and two newer shifted bits are connected to the other two inputs of the AND gate 2502 through an inverter 2503. Accordingly, the 4-input AND gate 2502 assumes 1 when the external clock becomes 1, 1, 0 and 0 at four continuous timings of the system clock SYSCLK. By the condition that the two same levels continue in this manner, chattering is prevented and moreover, detection of the trailing edge is accomplished stably. The output of the 4-input AND gate 2502 is connected to the J terminal of a JK flip-flop 2504 and the clock is connected to the system clock SYSCLK and therefore, the edge detection signal is latched at the next timing and the output of the JK flip-flop 2504 becomes 1. This signal provides the inputs of the flip-flops 2403, and is connected to the other terminal of an AND gate 2505 having a gate G as one input and to an inverter 2506. Another AND gate 2507 has the output of the inverter 2506 and the gate G as inputs, and the output thereof is connected to the K terminal of a JK flip-flop 2508. Also, the output of the AND gate 2505 is connected to the J terminal of the JK flip-flop 2508. Further, the clock terminal of the JK flip-flop 2508 is connected to the system clock SYSCLK. The clear terminal CL of the trailing edge detecting circuit 2402 is connected to the K terminal of the JK flip-flop 2504. The clear terminal CL and the gate G are connected together outside, and the initializing signal CLKCLR is applied thereto. One application timing of the initializing signal CLKCLR is synchronized with one period of the system clock. By setting the initializing signal CLKCLR to 1, when the output of the 4-input AND circuit 2502 is 0, the JK flip-flop 2504 is cleared, and when the output of the 4-input AND circuit 2502 is 1, the JK flip-flop is cleared when its output immediately before that point of time is 1, and the JK flip-flop 2504 is set to 1 when its output immediately before said point of time is 0. Accordingly, the omission of the edge detection depending on the application period of the initializing signal CLKCLR can be prevented. Also, by the AND gates 2505 and 2507 having the gate G as their input, the JK flip-flop 2508 can be made to hold the edge detecting state immediately before this in synchronism with the initializing signal CLKCLR, and can hold the data until subsequently the initializing signal CLKCLR becomes 1.

Figure 21:
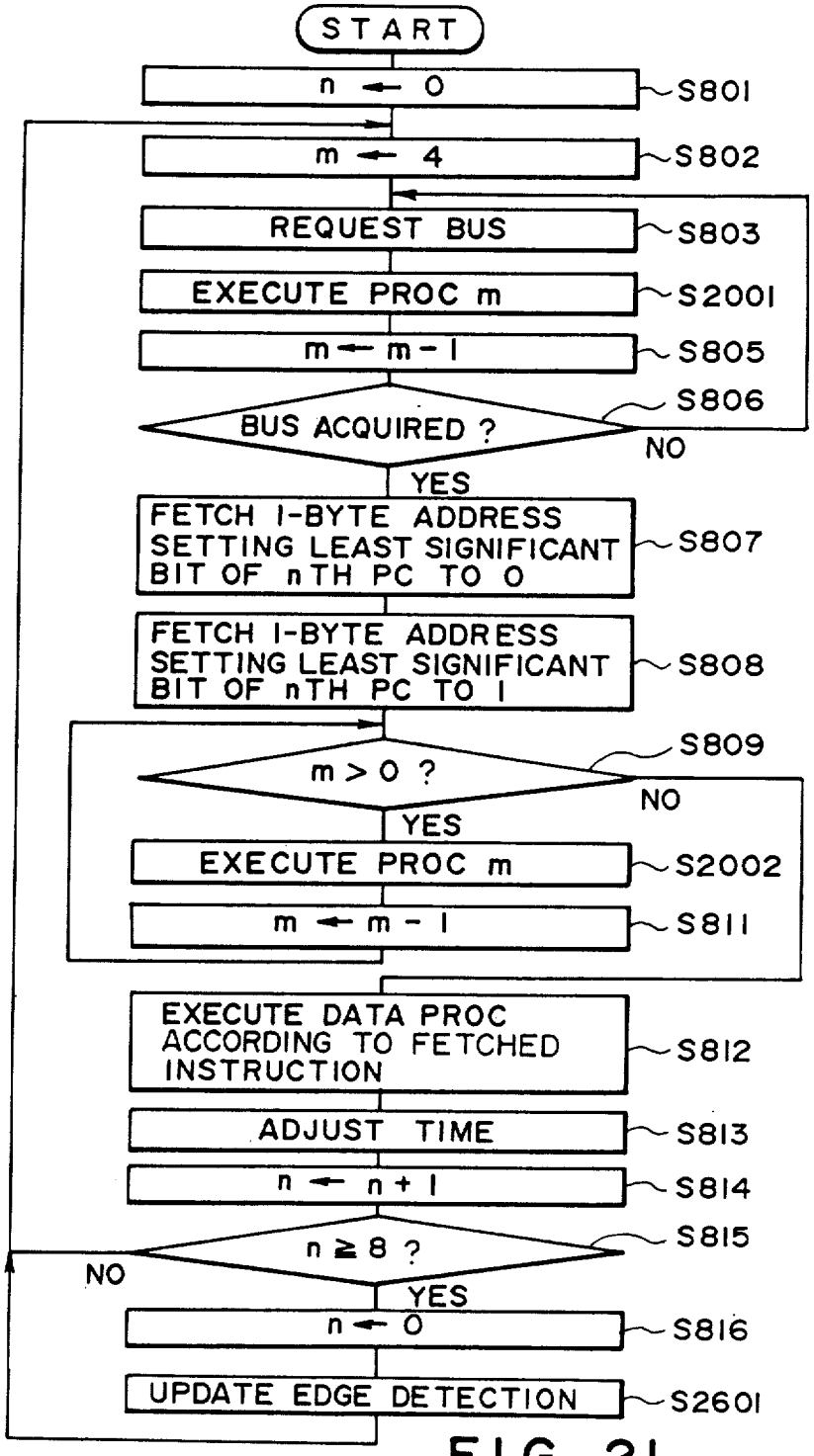
FIG. 21 shows the flow chart of another embodiment of the present invention.

In the microcomputer to which is added the trailing edge detecting means as described above, the control of the selection signals CS0 and CS1 and the check of the detection signal CCOND are effected by the parallel processor controller 412. The flow chart in this case is shown in FIG. 21. That is, step S2601 is added next to step S816, and each time the processor number n makes one round, the initializing signal CLKCLR is set to 1 in synchronism with the system clock, and 0 clearing of the edge detection and the latching of the edge detection result immediately before it are effected. By doing this, during the processing of processor 0 to processor 7 until step S2601 is subsequently executed, the result of the trailing edge detection of the external clock during the period during which the processing of processor 0 to processor 7 immediately before this is effected can be examined by the selection signals CS0 and CS1 being controlled and the signal CCOND being input.

Figure 22:
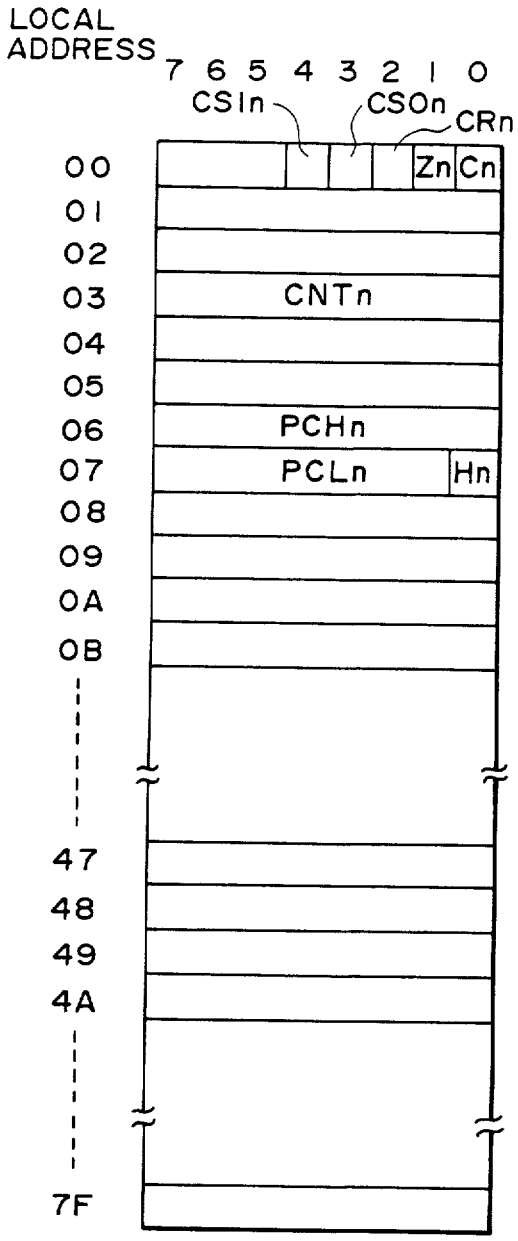
FIG. 22 shows the memorial address of the embodiment of FIG. 21.
Figure 23:
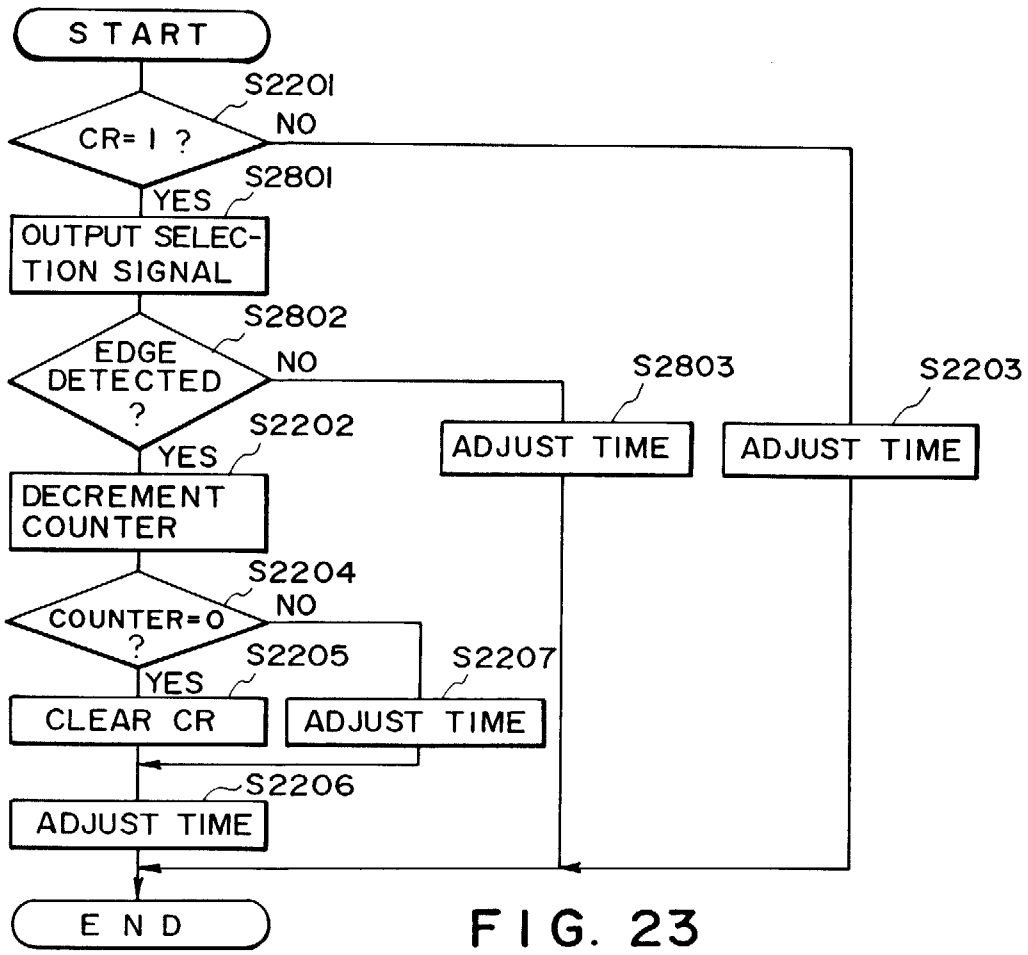
FIG. 23 shows the detailed processing program of the processing m of FIG. 21.

As shown in FIG. 22, external clock selection flags CS0*n* and CS1*n* are allotted to the third and fourth bits, respectively, of the address 00H of the local area for each processor n, and the counter decrementing process is changed as shown in FIG. 23. That is, when CR is 1 at step S2201, the program proceeds to step S2801, and the values of the external clock selection flags CS1*n* and CS0*n* are sent as selection signals CS1 and CS0, respectively, to the data selector 2404, and at step S2802, the edge detection signal CCOND is read and, if the value thereof is 1, the program proceeds to step S2202, at which the counting-down process is effected, and if said value is not 1, time adjustment is effected at step S2803

Figure 24:
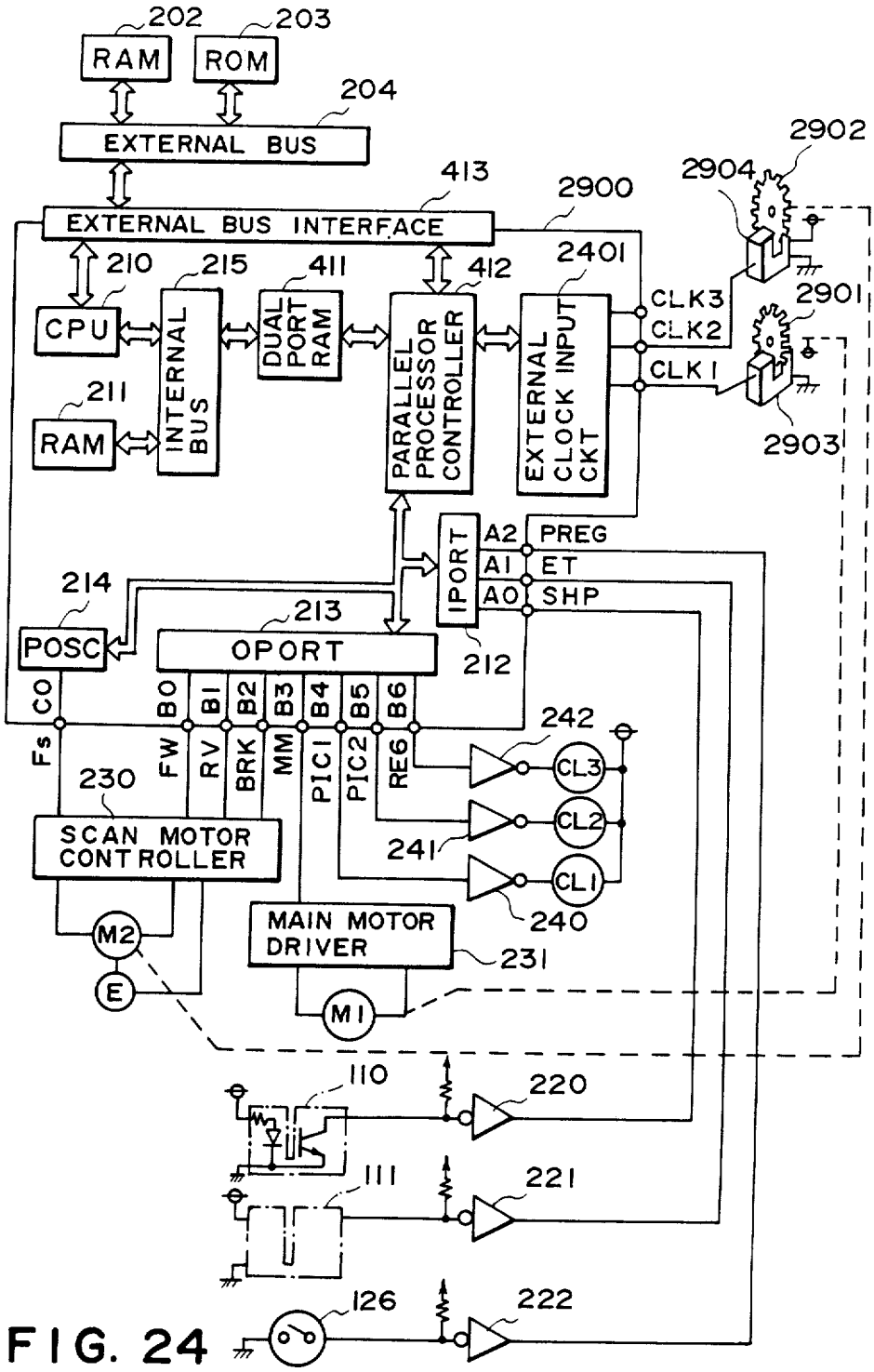
FIG. 24 is a control block diagram of the copying apparatus.

Thereupon, in the program of each processor, the counter becomes utilizable not only as a count-down timer but also as a counter of the external clock. For example, in the previously described embodiment, the original scan system and the paper conveying system are driven by motors M2 and M1, respectively, but in the program, the length of the original scan and the distance of movement of the copying paper are converted into an operation time on the assumption that the speeds of revolution of the motors M2 and M1 are maintained constant, and processing such as delaying is effected. In contrast, in the present embodiment, as shown in FIG. 24, clock disks 2901 and 2902 are connected to shafts driven by motors M1 and M2, respectively, and photointerrupters 2903 and 2904 are installed so that by the rotation of the slits of the clock disks 2901 and 2902, rectangular waves corresponding to the speeds of rotation thereof are put out, and those outputs are connected to the external clock terminals CLK1 and CLK2, respectively, of a microprocessor 2900 containing the external clock input circuit 2401 of the present embodiment therein. Moreover, for example, in the control program of the original scan system, the time adjustment with respect to the length of scan and the count-down of the counter are effected by the external clock CLK2, and in the control program of the paper supply system, the time adjustment with respect to the length of movement of the copying paper can be effected by the use of a counter which counts down by the external clock CLK1 and thus, program control which is not affected by the fluctuation of the revolutions of the motors M1 and M2 becomes possible As described above, according to the first, second and third embodiments of the present invention, it becomes possible to use a control microcomputer having a plurality of subprocessors to effect excellent control in which the control of one process of the original scan system, the paper supply system, etc. is allotted to each of the subprocessors and the respective processes are exclusively controlled to thereby greatly reduce the time delay. Further, the sequence control programs regarding the processes in charge operate independently of each other and therefore are not affected by the processing of the other steps of the operation. In the past, the program was complicated as by using a technique such as interruption processing to improve the responsiveness and the period of development of the program was increased, but in the present invention, it becomes possible to make the control of each process into a small group of programs and making the program modular can be expedited and moreover, the period of development can be greatly shortened and it becomes possible to make a program which is relatively free of errors.

Also, according to the second and third embodiments, the parallel processor controller is coupled to the CPU through the dual port RAM and the parallel processors are provided with independent timer mechanisms, respectively, whereby it has become possible to easily cause the individual parallel processors to execute general processing even during the waiting time.

Further, by the provision of the signal selecting means for the count timing of the timer mechanisms provided in the individual parallel processors, the pulse signal of a frequency corresponding to the operation of the instrument such as the number of revolutions of the motor can be changed over by the signal selecting means for the count timing, and a program conforming to this timing can be prepared and executed as the program of each of the individual parallel processors and as a result, the correction of the program can be made unnecessary even for a change of speed or the like of the operation of the instrument.

[Introducing Portion of a Fourth Embodiment]

A description will hereinafter be given of still another embodiment of the copying apparatus control using a microcomputer of the aforedescribed architecture.

Figure 25:
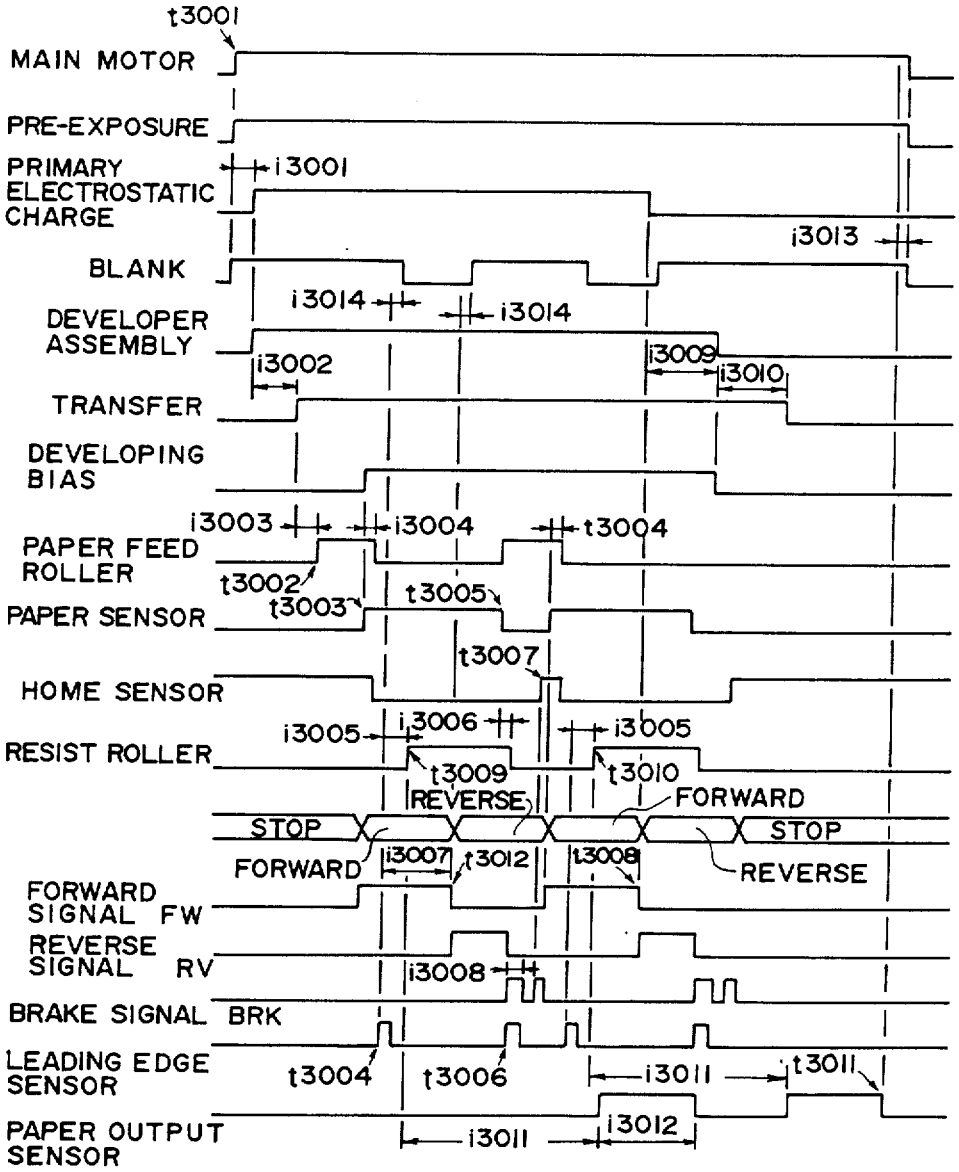
FIG. 25 shows the control timing of the copying apparatus.

FIG. 25 is a timing chart showing the control procedure of the copying apparatus. In this embodiment, there is shown the control timing at which two-sheet copying is effected.

In the timing chart, the outputs of pre-exposure, primary electrostatic charge, blank, developer assembly, transfer and developing bias correspond to the input of a paper output sensor. Although the I/O port is not clearly specified in FIG. 24 which illustrates the present embodiment, a microcomputer 2900 is endowed with an output port equivalent to the output port 213, and like the output ports B4, B5 and 6 which drive clutches CL1, CL2 and CL3, respectively, the apparatus may be designed as to drive respective controlled parts through a buffer and ON-OFF control may be effected. On the other hand, as regards the paper output sensor, for example, a microswitch or the like may be mounted on the paper discharging portion of FIG. 2 and, like the paper sensor 126, may be connected to the input port through an input buffer.

The procedure of the copying apparatus of the present embodiment will hereinafter be described.

When a copy start button is depressed at time t3001 to start the copying operation, the main motor is started and the pre-exposure, and blank are turned on, and in a predetermined time i3001, the primary electrostatic charge is turned on and rotation of the developer assembly is started. Further, in a predetermined time i3002, the transfer charge is turned on. Still further, in a predetermined time i3003, the paper feeding operation is permitted to start.

Where paper supply is to be effected from the lower cassette 122, the port B is set to "1" at time t3002 and the clutch CL2 is engaged, whereby the paper feed roller 124 is rotated to pick up a sheet of copying paper. At time t3003, the paper is detected, whereby the original scanning is started and the developing bias is applied. In a predetermined time i3004, the port B5 is set to "0" and the paper feed roller 124 is stopped. During this time i3004, the copying paper arrives at the resist roller 125 and waits for the start of the rotation of the resist roller 125. At time t3004, the leading edge sensor 110 indicates that it has scanned the leading edge of the original, and at this time t3004, it is known that the leading edge of the original has been imaged on the photosensitive drum 108. In a time i3005 which is the time when this imaged portion rotates to the transfer position, minus the time required from after the resist roller has been rotated until the copying paper arrives at the transfer position, the port B6 is set to "1" and the clutch CL3 is engaged to thereby start rotation of the resist roller 125.

After the lapse of a predetermined time i3006 from the time t3005 when the copletion of the passage of the paper has been detected by the paper sensor, the port B6 is set to "0" and rotation of the resist roller 125 is stopped.

Where a plurality of copies is to be produced as in the present example, the feeding of the next sheet of paper is started from the time t3005 and the above-described control is repeated.

On the other hand, the original scanning is controlled by supplying to the scan motor controller 230 a signal of a frequency corresponding to the scanning speed from the port CO and the forward signal FW, the reverse signal RV and the brake signal BRK from the ports B0, B1 and B2, respectively.

When forward movement is to be effected, the velocity of forward movement is determined by the then copying magnification and therefore, the programmable oscillator 214 is set so as to effect oscillation of a frequency corresponding thereto, whereafter the reverse signal RV and the brake signal BRK is set to "0" and the forward signal FW is set to "1", and then scanning is started. After the lapse of a time i3007 during which the scan system moves forward by an amount corresponding to the length of the original after the leading edge sensor has detected the leading edge of the original, the forward signal is set to "0" and the velocity of the reverse movement is set in the programmable oscillator 214, and the reverse signal is set to "1". When the leading edge sensor 110 has sensed the leading edge position, that is, at time t3006, the reverse signal is set to "0" and the brake signal BRK is set to "1" for a predetermined time i3008. Thereafter, the original scan system is moved reversely by inertia and the brake signal BRK is set to "1" at time t3007 when the scan system has been returned to the home position by the home position sensor 111. Then the brake signal BRK is set to "0" to produce the second sheet of copy, whereafter the velocity of forward movement is set to and the forward signal FW is set "1", and then the above-described control is repeated.

At time t3008 when the original scanning for the last sheet of copying paper is terminated, the primary electrostatic charge is turned off and in a predetermined time i3009, the developer assembly and the developing bias are turned off, and further, in a predetermined time i3010, the transfer is turned off. On the other hand, the paper output sensor is turned on in a predetermined time i3011 after the time t3009 when rotation of the resist roller has been started, because the leading edge of the copying paper is conveyed to the paper discharge port, and is turned off in a time i3012 which is determined by the length of the copying paper. Likewise, the leading edge of the second sheet of copying paper arrives at the paper discharge port in the predetermined time i3011 after the time t3010 when rotation of the resist roller has been started. In a predetermined time i3013 after the time t3011 when all sheets of paper have been discharged, the main motor, the pre-exposure and the blank exposure are turned off.

The blank exposure is for applying a light to the area outside the range in which the surface of the original is imaged to thereby prevent excess toner from adhering to the drum, and the blank exposure is turned off in a time i3014 during which the drum is rotated to the blank exposure position after the time t3004 when the leading edge of the original has been imaged on the drum. The blank exposure is again turned on in the time i3014 after the time t3012 when the trailing edge of the original has been imaged on the drum, whereby blanking is effected. This takes place each time the copying by each sheet of copying paper is executed.

Figure 3:
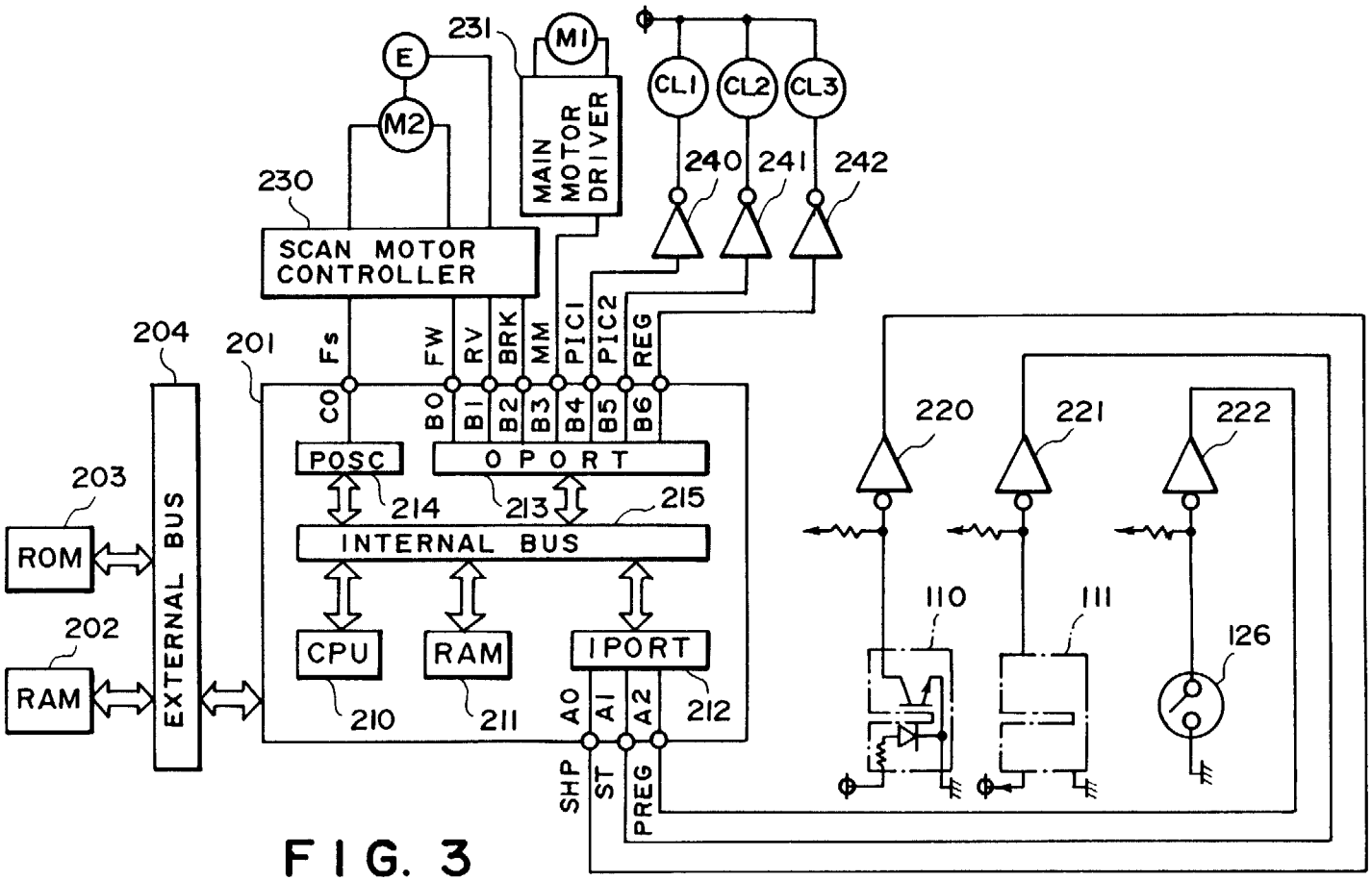
FIG. 3 PRIOR ART
FIG. 3 is a diagram of the control circuit of a copying apparatus according to the prior art.
Figure 4:
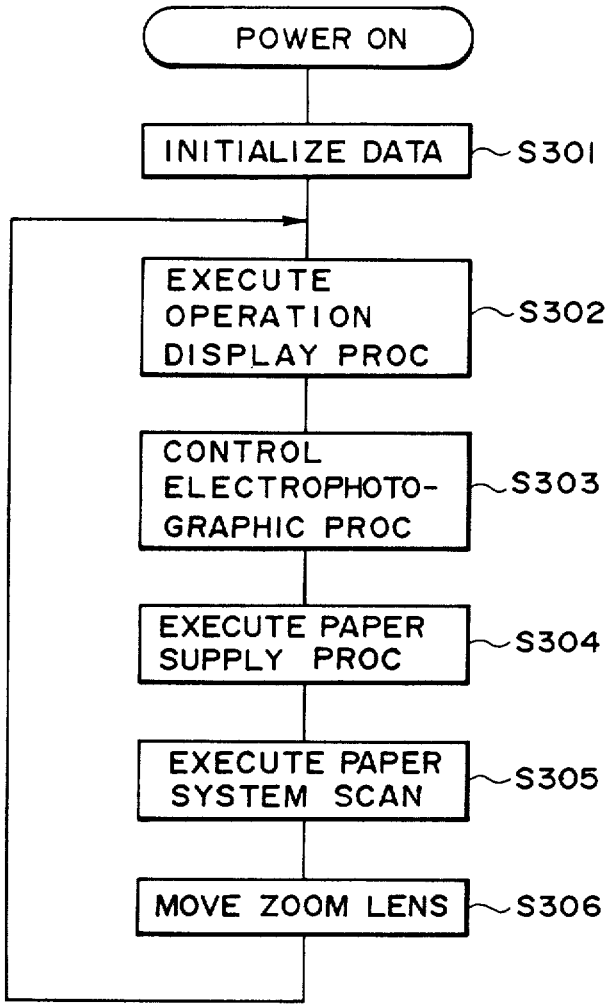
FIG. 4 PRIOR ART
FIG. 4 shows an example of the control program of the copying apparatus according to the prior art.

What has been described above is the considerably simplified procedure of the essential portions for the actual control of the copying apparatus, but it is still complicated. Particularly, where continuous copying by a plurality of copying sheets is to be effected, a plurality of copying sheets are present in the copying apparatus and independent control is effected for each of those copying sheets and therefore, the sequence control program therefor becomes complicated. Moreover, as the copying speed of the copying apparatus is increased, the allowance range of the delay in response becomes smaller and it becomes difficult to cope with it by the processing as shown in FIG. 3.

So, in a fourth embodiment which is an improvement over the previously described first to third embodiments, it is an object to provide the control device of an image forming apparatus in which an operation control unit is allotted to each sheet of recording paper to thereby simplify the making of the program and fine control and monitoring is possible for each sheet of recording paper.

[Fourth Embodiment]

In the present embodiment, the abovedescribed sequence control is roughly divided into pre-processing, copy processing and post-processing. In the copy processing, a subprocessor is allotted to the one-sheet copying process to thereby effect control. That is, a certain subprocessor is designed to effect monitoring of the feeding of copying paper, the original scanning, the development, the transfer, the fixation and the discharge of the copying paper If such a control method is employed, the program may be written by paying attention to the one-sheet copying procedure and as for the rest, some exclusive processings for avoiding the mutual interference with the copy processing of another succeeding sheet of paper may simply be provided, and if the same program is allotted to a plurality of subprocessors, a continuous copy by a plurality of copying sheets can be produced A specific example of it will now be described with reference to the flow charts of FIGS. 26A–26D.

Figure 26A:
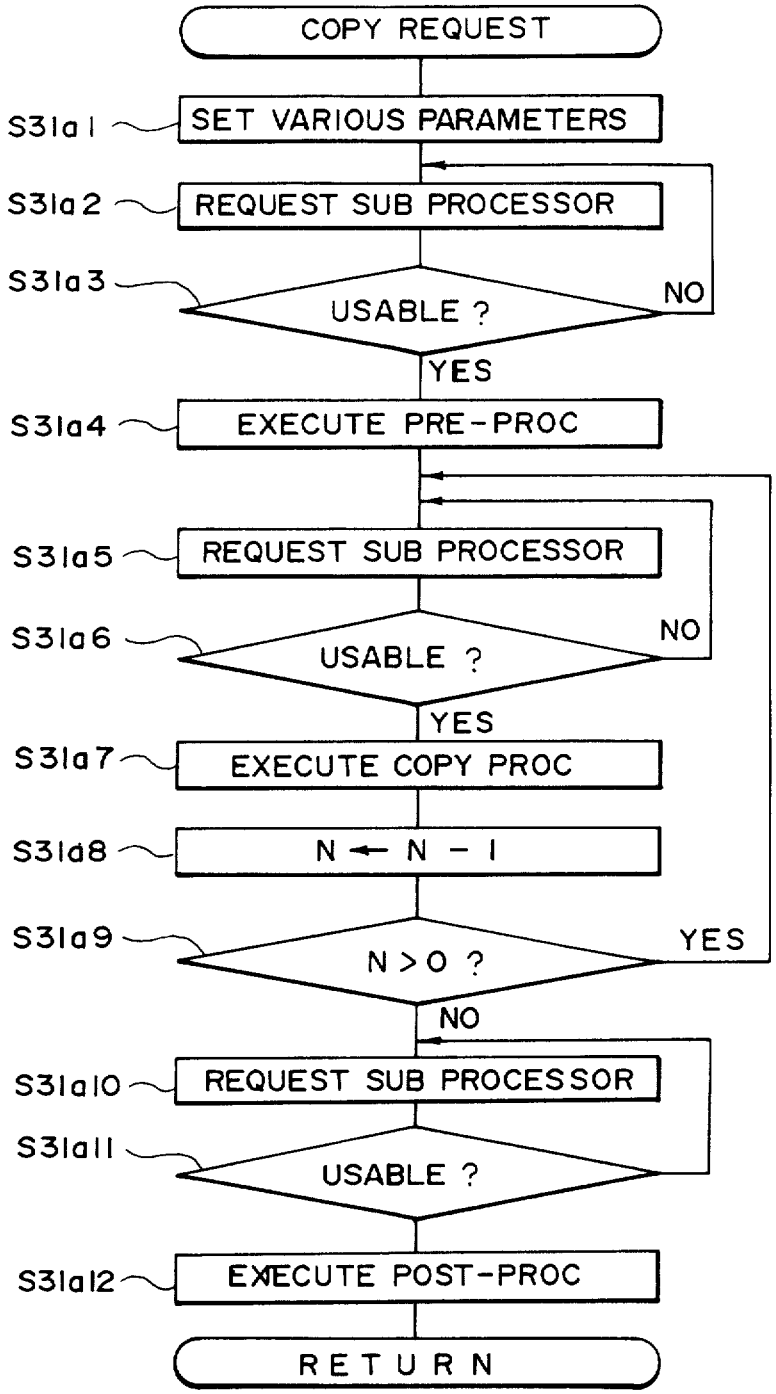
FIG. 26A shows a copy request processing flow chart.
Figure 26B:
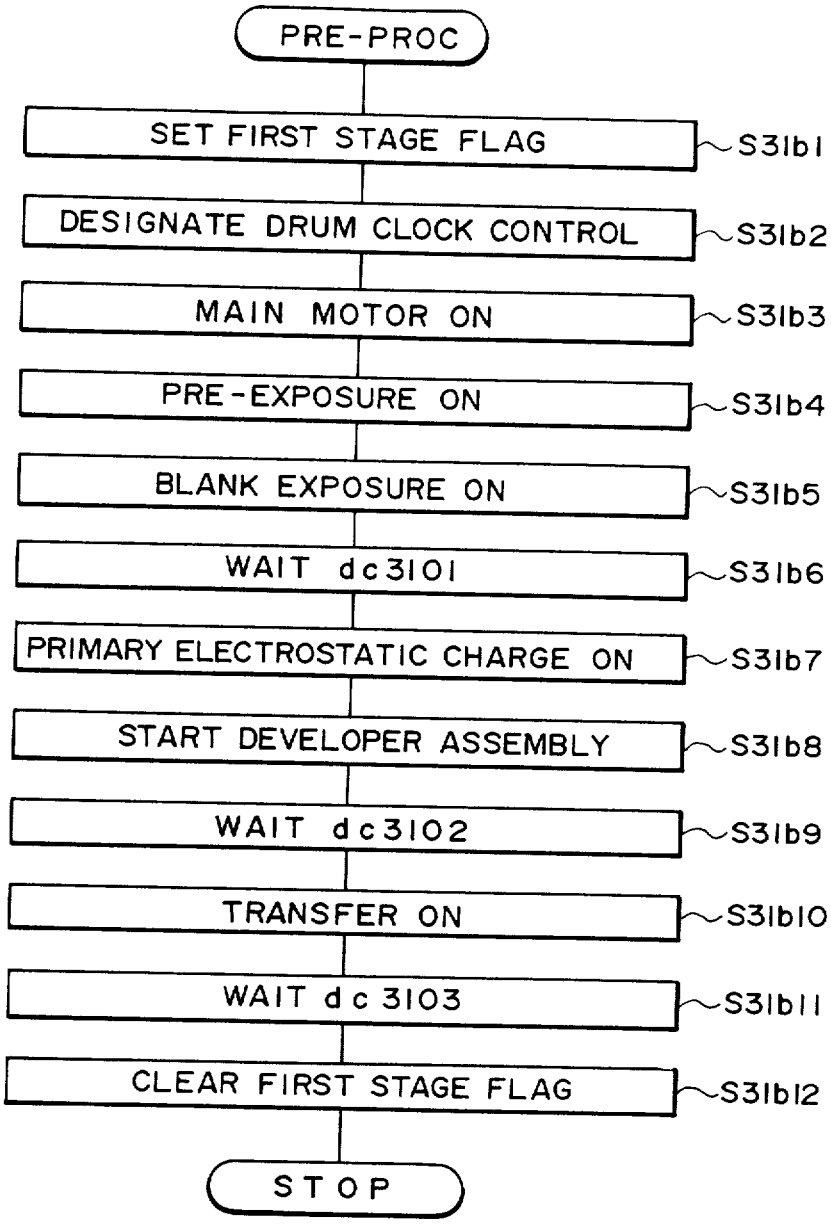
FIG. 26B shows a pre-processing flow chart.
Figures 3, 26C:
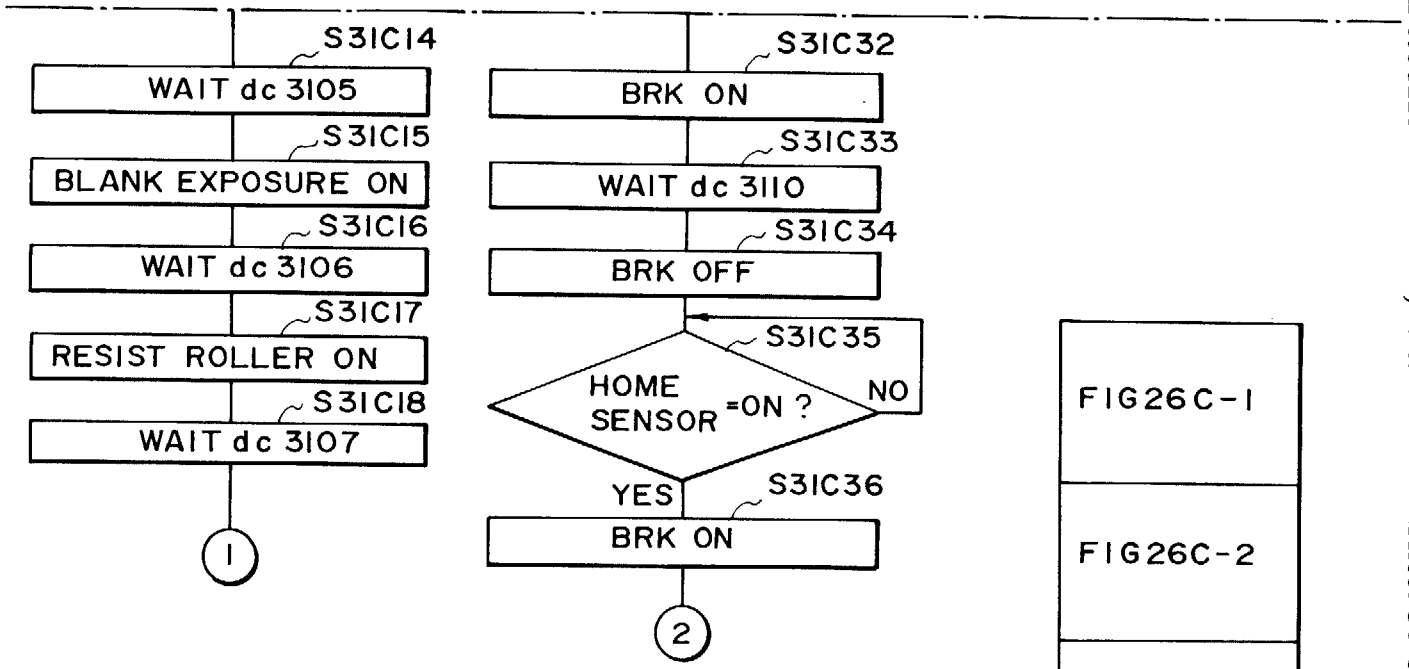
Figure 26C:
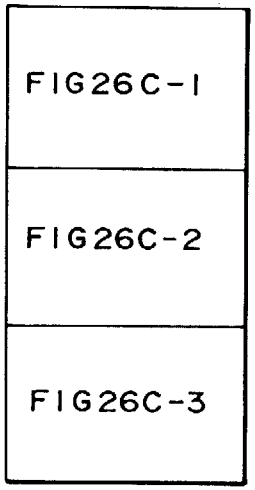
Figures 1, 26C:
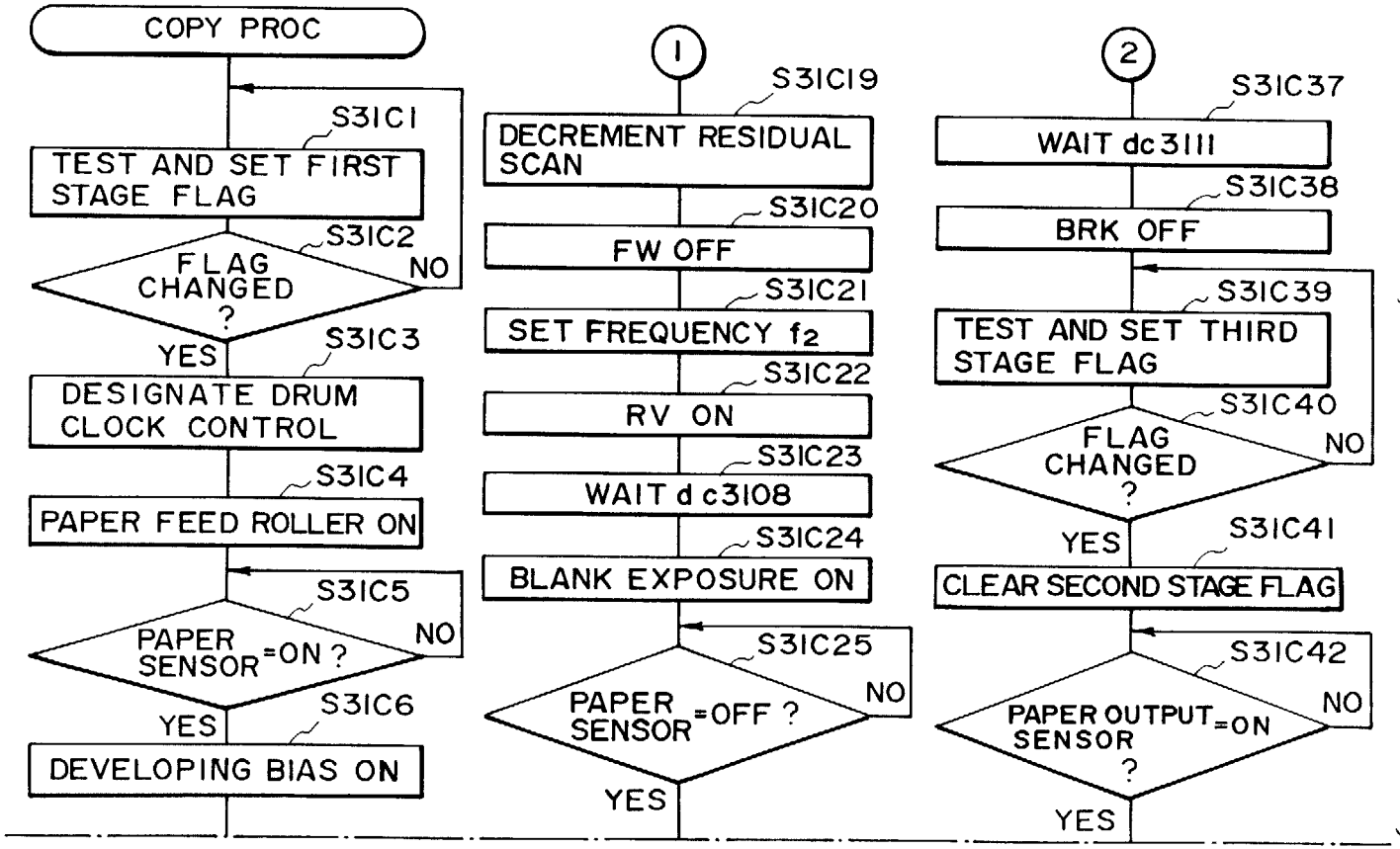
Figures 2, 26C:
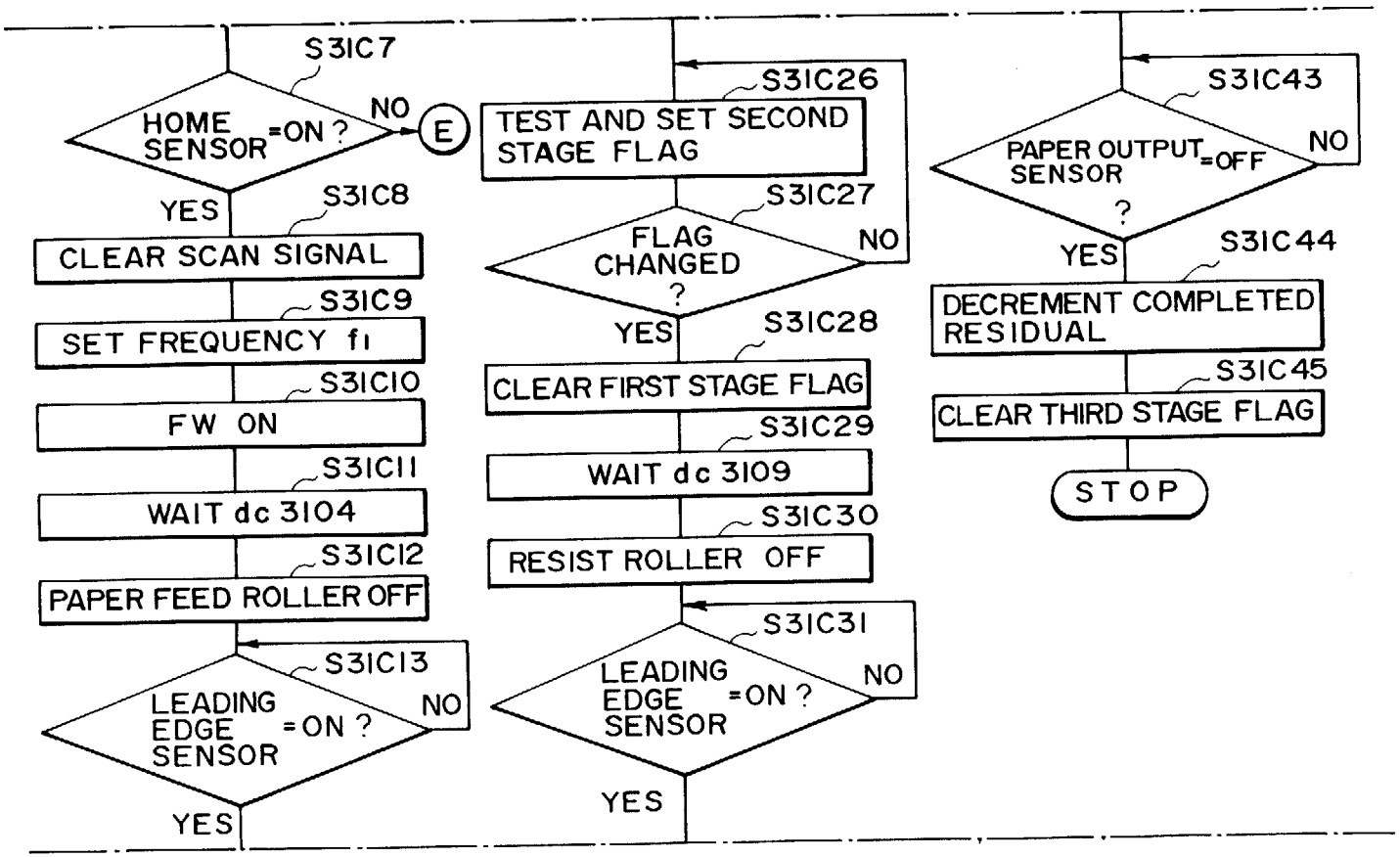
Figure 26D:
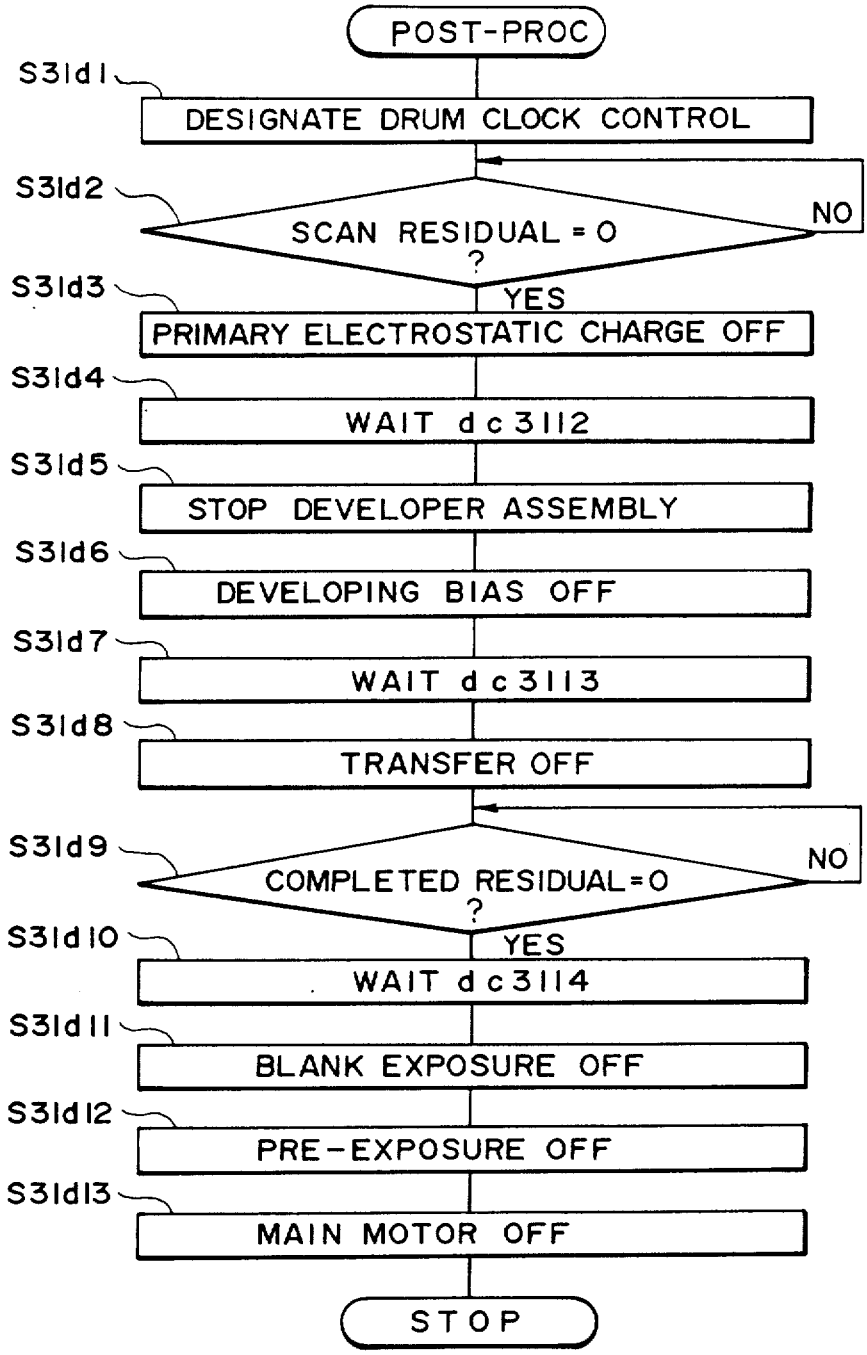
FIG. 26D shows a post-processing flow chart.

FIG. 26A shows an example of the routine for actuation of the copy sequence, and more specifically, it shows the program of CPU 210, and FIGS. 26B–26D show examples of the routine actuated by CPU 210, and more specifically, they show the programs of respective subprocessors which are the parallel processors imaginarily realized by the parallel processor controller 412.

Figure 27:
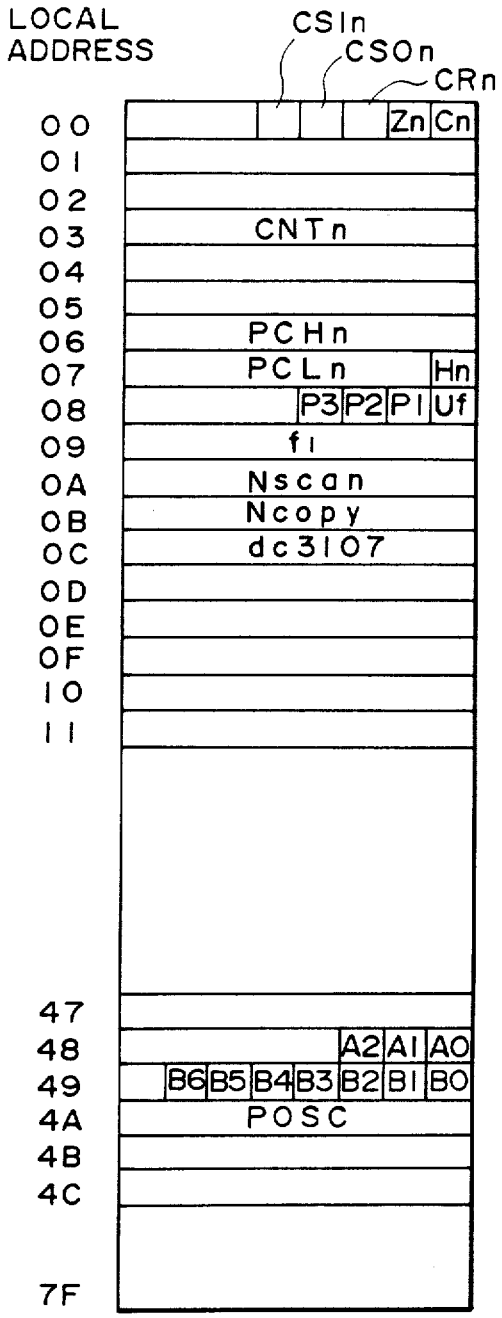
FIG. 27 shows a memory address used for the processing of FIGS. 26A–26D.

The copy request program of FIG. 26A is called when, for example, the start key of the copying apparatus is depressed. At step S31*a*1, in accordance with various conditions decided at that point of time, parameters required in the programs of the parallel processors actuated in the following are determined in the memory space of the dual port RAM 411. The memory space is initialized as shown, for example, in FIG. 27.

At step S31*a*2, processors which are now out of service are found out from among those of the parallel processors to which a program can be dynamically allotted. Assuming that, for example, four processors, i.e., processor No. 0 to processor No. 3, are dynamically allotted, the least significant bits of the address 07H of the local addresses of subprocessors No. 0, No. 1 and No. 2 are successively retrieved and, where the bit is "1", it is seen that processors No. 0, No. 1, No. 2 and No. 3 are out of service. Steps S31*a*2 and S31*a*3 are repeated until the processors which are out of service are found out by the judgment of step S31*a*3. The time when this loop has been gone through is the time when a processor which is out of service could be detected, and at step S31*a*4, the pre-processing program is allotted to the detected processor. Specifically, when, for example, processor No. 1 has been judged as being out of service, the entry address of the pre-processing program is stored into the addresses 06H and 07H of the local address. Thus, processor No. 1 of the parallel processors begins to execute the pre-processing.

The program then proceeds to step S31*a*5. Steps S31*a*5 and S31*a*6 are of the same contents as steps S31*a*2 and S31*a*3, respectively, and repeat the loop until a processor which is out of service can be acquired, whereupon the program proceeds to step S31*a*7. At step S31*a*7, the entry address of the copy processing program which corresponds to each copying sheet is substituted into the program counter of each acquired subprocessor. At step S31*a*8, the preset number N of copies is decremented to check the number of uncompleted copies allotted to the processor, with respect to N, and at step S31*a*9, the processes of step S31*a*5 and so on are repeated until N becomes equal to 0.

Thus, copy processing up to a maximum of 1000 sheets can be accomplished. This is because, after the completion of the pre-processing, the processor to which the pre-processing has been allotted is put out of service and therefore, thereafter the copy processing is allotted to that processor and this can be executed.

When the copy processing for the designated number of sheets has been allotted at step S31*a*9, the program proceeds to step S31*a*10. Steps S31*a*10 and S31*a*11 are the processes for acquiring the processor which is out of service, like steps S31*a*2 and S31*a*3, and likewise, at step S31*a*12, the post-processing program is executed by the acquired processor.

When the actuation routine described above is to be executed by CPU 210, the copy request processing is actually executed as a task under a real time operating system, and when the processing becomes unutilizable at steps S31*a*3, S31*a*6, S31*a*11, etc., the control is abandoned, and if the design is made such that the control is once abandoned after the actuation of the parallel processors at steps S31*a*4, S31*a*7, S31*a*10, etc., the load of CPU 210 can be dispersed and the processing over the details of the conventional sequence can also be greatly reduced in load as compared with a case where it is effected by CPU 210.

Each program actuated by CPU 210 will now be described. FIG. 26B is a flow chart of the pre-processing program. At step. S31*b*1, flag P1 is set. This is a flag for noting the synchronization between programs in parallel-processing with a processor allotted for each sheet of copying paper. At step S31*b*2, a designation is made such that the count timing of the timer is controlled by a drum clock which is an external clock, and more specifically, CS1*n* is set to "0" and CS0*n* is set to "1". Steps S31*b*3, S31*b*4, S31*b*5, S31*b*7, S31*b*8, S31*b*10 and S31*b*12 are for setting clearing the output ports corresponding to respective objects of control, and steps S31*b*6, S31*b*9 and S31*b*11 are for delaying the control outputs. For example, at step S31*b*6, a drum clock time dc3101 into which the delay time i3001 in FIG. 25 has been converted is stored into the counter CNTn (the address 03 of the local address), a timer start bit CRn is set and a check is continued until CRn is cleared, whereafter the change-over to the next step is effected. dc3102 is a drum clock time into which the delay time i3002 has been converted, and dc 3103 is a drum clock time into which the delay time i3003 has been converted.

FIG. 26C is a flow chart of the copy processing program in which a subprocessor is allotted to each sheet of copying paper and which is executed thereby.

Steps S31*c*1 and S31*c*2 are steps for rating synchronization and at these steps, the paper feeding operation is prevented from starting until the pre-processing is completed and the succeeding fed sheet of paper is prevented from overlapping the immediately preceding sheet of copying paper. Actually, this is effected by the use of a test and set instruction or the like. The test and set instruction checks the state of the bit immediately before an object bit as soon as the object bit is set. This is effected at step S31*c*1, and when the bit immediately before said object bit is "0" at step S31*c*2, the program proceeds to step S31*c*3, and when it is not so, step S31*c*1 and so forth are repeated. Step S31*c*3 is the same as the step S31*b*2 of FIG. 26B. At step S31*c*4, flag Uf is checked and if it is "1", the paper feed roller for the upper cassette starts to be rotated, and if it is "0", the paper feed roller for the lower cassette starts to be rotated. For example, if flag Uf is "1", the port B4 is set to "1". At step S31*c*5, a check is effected until the paper sensor 126 is switched on, and when the leading edge of the copying paper is detected, the developing bias is turned on at step S31*c*6, and the original scan position is confirmed at step S31*c*7. When the original scan system is not at the home position, it is defined as an error. At step S31*c*8, all the control signals of the scan system are cleared. More specifically, the ports B0, B1 and B2 are set to "0". At step S31*c*9, a frequency f1 is set in the programmable oscillator. For example, in the present embodiment, the adjustment of the frequency of the programmable oscillator is allotted to I/O-2 and therefore. f1 is stored into the address 4A of the local address. On the other hand, the frequency f1 is determined by the original scanning speed and therefore is determined by the magnification change rate at the point of time whereat the copy key is depressed, and is calculated by CPU 210 and is set as a parameter in a common memory area (local address 09H).

At step S31*c*10, the forward signal is turned on and the original scanning is started, and at step S31*c*11, the program waits for the delay time i3004 of FIG. 26B. This is executed in a manner similar to the step S31*b*6 of FIG. 26B. That is, dc3104 is a drum clock time into which the delay time i3004 has been converted. At step S31*c*12, the paper feed roller is switched off. Thereafter, at step S31*c*13, the program waits until the original scan system comes to the leading edge portion of the original, whereafter at step S31*c*14, the program is delayed, and at step S31*c*15, the blank exposure is turned off to thereby prevent the original imaged on the drum surface from being erased dc3105 is a drum clock time into which the delay time i3014 has been converted.

Thereafter, at step S31*c*16, the program is delayed till a time i3005, and at step S31*c*17, the resist roller starts to be rotated to thereby cause the leading edge of the copying paper to coincide with the leading edge of the original image on the drum at the transfer station At step S31*c*18, the program is delayed for a time i3007. That is, this determines the original scan range and is initially set by CPU 210. At step S31*c*19, the number of residual scan N scan is decremented. The number of the residual scan is initially set to the number of copies N by CPU 210. At step S31*c*20, the forward movement of the scan system is stopped, and at step S31*c*21, a frequency f2 corresponding to the speed of reverse movement is set in the programmable oscillator, and at stp S31*c*22, the reverse signal is turned on, whereby the original scan system begins to be returned At step S31*c*23, the program waits for a time i3014, and at step S31*c*24, the blank exposure is again turned on to thereby control the original image on the drum so that the portion thereof after the trailing end is made white, At step S31*c*25, the program waits until the paper sensor is switched off, and at steps S31*c*26 and S31*c*27, the synchronizing process is effected as at steps S31*c*1 and S31*c*2 in order to take the synchronization in the paper conveyance to the fixing station. At step S31*c*28, the first process flag is cleared and the feeding of the succeeding sheet of copying paper is permitted to start.

At step S31*c*29, the program waits until the trailing end of the paper leaves the resist roller, and at step S31*c*30, the resist roller is switched off.

At step S31*c*31, the program waits until the leading edge sensor is switched on during the time that the original scan system is moved reversely, and at step S31*c*32, the reverse signal is turned off and the brake signal is turned on, and at step S31*c*33, the program is delayed by a predetermined time i3008, and at step S31*c*34, the brake signal is turned off. At step S31*c*35, the program waits until the scan system is moved back to the home position by inertia, whereupon the brake signal is again turned on to stop the scan system. The program then waits for a predetermined time, whereafter at step S31*c*38, the brake is turned off.

Subsequently, at steps S31*c*39 and S31*c*40, the synchronizing process for avoiding the confusion between the immediately preceding sheet of paper and the succeeding sheet of paper when the paper output check at the paper discharge port is effected is carried out. These steps also are similar to steps S31*c*1 and S31*c*2. At step S31*c*41, the second process flag P2 is cleared to give the succeeding sheet of paper the processing right after step S31*c*21. At steps S31*c*42 and S31*c*43, the discharge of the object paper is confirmed, whereafter at step S31c44, the number of completed residual sheets N copy is decremented, and at step S31c45, the third process flag P3 is cleared to enable the discharge of the succeeding sheet of paper to be checked, thus completing the present processing, and the processor to which this program has been allotted is put out of service.

FIG. 26D is a flow chart of the program for post-processing. At step S31d1, as at step S31b2, the standard of count is adjusted to the drum clock, and at step S31d2, the program waits until the number of residual scan N scan becomes 0. This time corresponds to t3008 of FIG. 25, and is the time when the scanning of the last sheet of paper is terminated. At step S31d3, the primary electrostatic charge is immediately turned off, and at step S31d4, the program waits for a time i3009, and at steps S31d5 and S31d6, rotation of the developer assembly is stopped and the developing bias is turned off. Further, at step S31d7, the program waits for a time i3010, and at step S31d8, the transfer is turned off. At step S31d9, the program waits for the completion of the discharge of all sheets of copying paper and further wits for a predetermined time i3013, whereafter the blank exposure, the pre-exposure and the main motor are turned off by steps S31d11, S31d12 and S31d13.

As described above, a processor is allotted to each sheet of copying paper and the paper feed to the paper discharge are programmed along with the movement of the copying paper, whereby the structure of the program becomes simple and the development period of the control instrument can be remarkably reduced and thus, the development cost can be greatly reduced.

[Fifth Embodiment]

Figure 28:
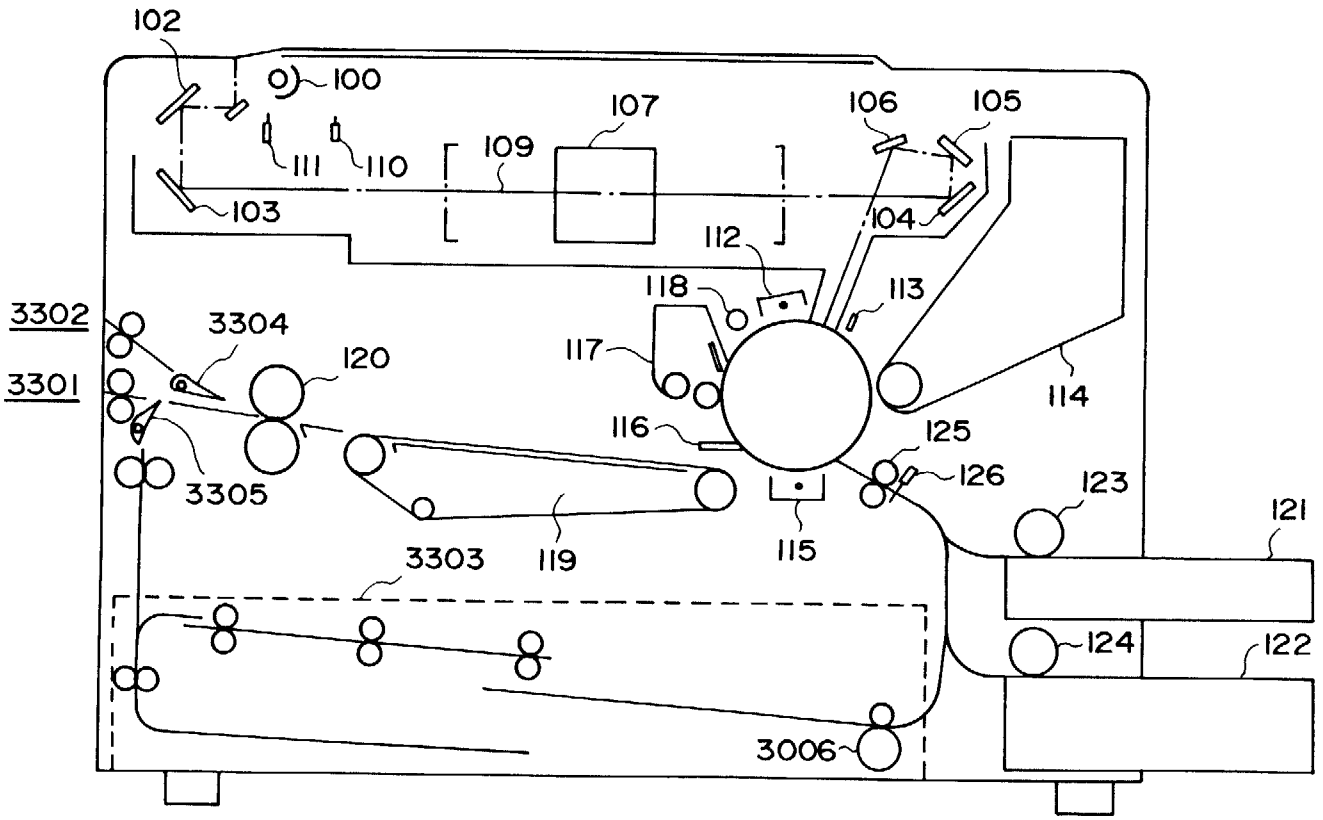
FIG. 28 is a cross-sectional view of a copying apparatus according to still another embodiment of the present invention.

FIG. 28 shows an embodiment in which, in addition to a conventional paper output port 3301, a second paper output port 3302 and a paper reversing and refeeding mechanism 3303 for reversing copying paper to effect both-side copying are added to the copying apparatus shown in FIG. 2. Flow charts in a case where such a copying apparatus is controlled are shown in FIGS. 29A and 29B.

In the present embodiment, the copy request processing and the post-processing are basically similar to those in FIGS. 26A and 26D. But in the setting or the like of the parameter at step S31a1, it is necessary to add the information necessary for the routines of FIGS. 29A and 29B to be operated.

Figure 29A:
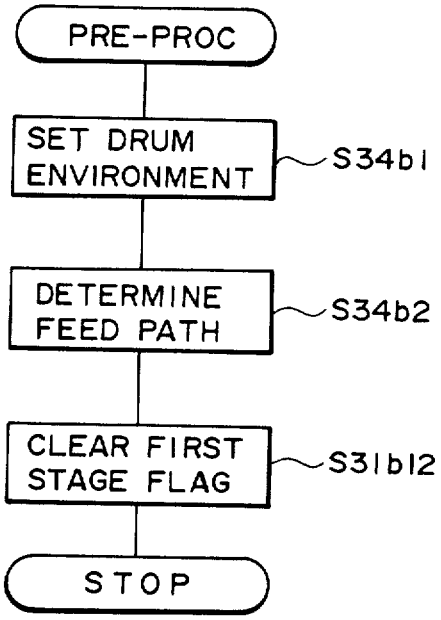
FIGS. 29A and 29B show the pre-processing flow chart and the copy processing flow chart, respectively, of the FIG. 28 embodiment.
Figure 30:
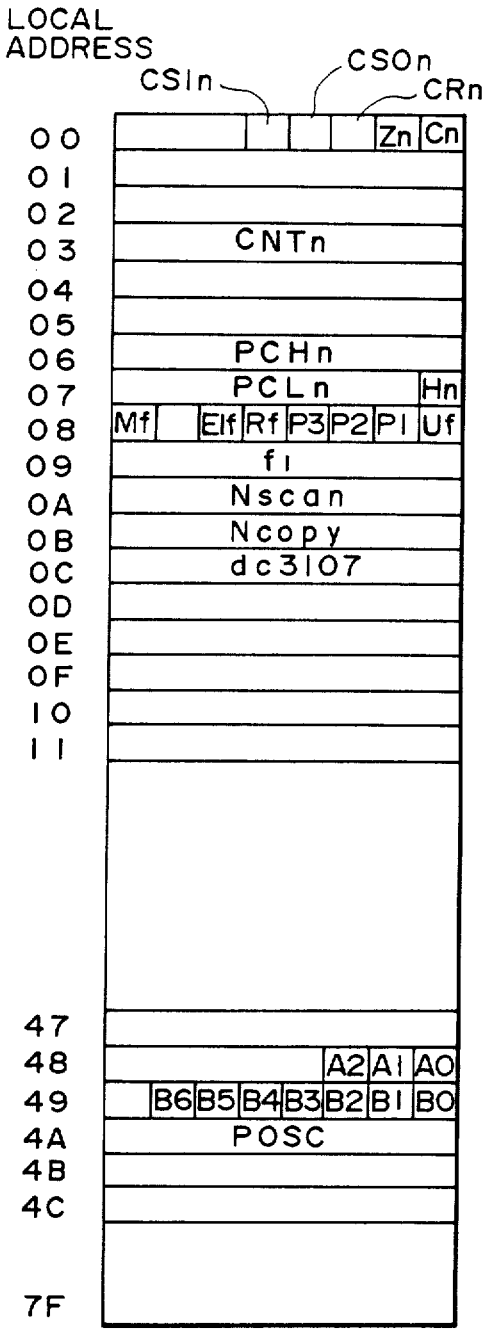
FIG. 30 shows a memory address.
Figure 31:
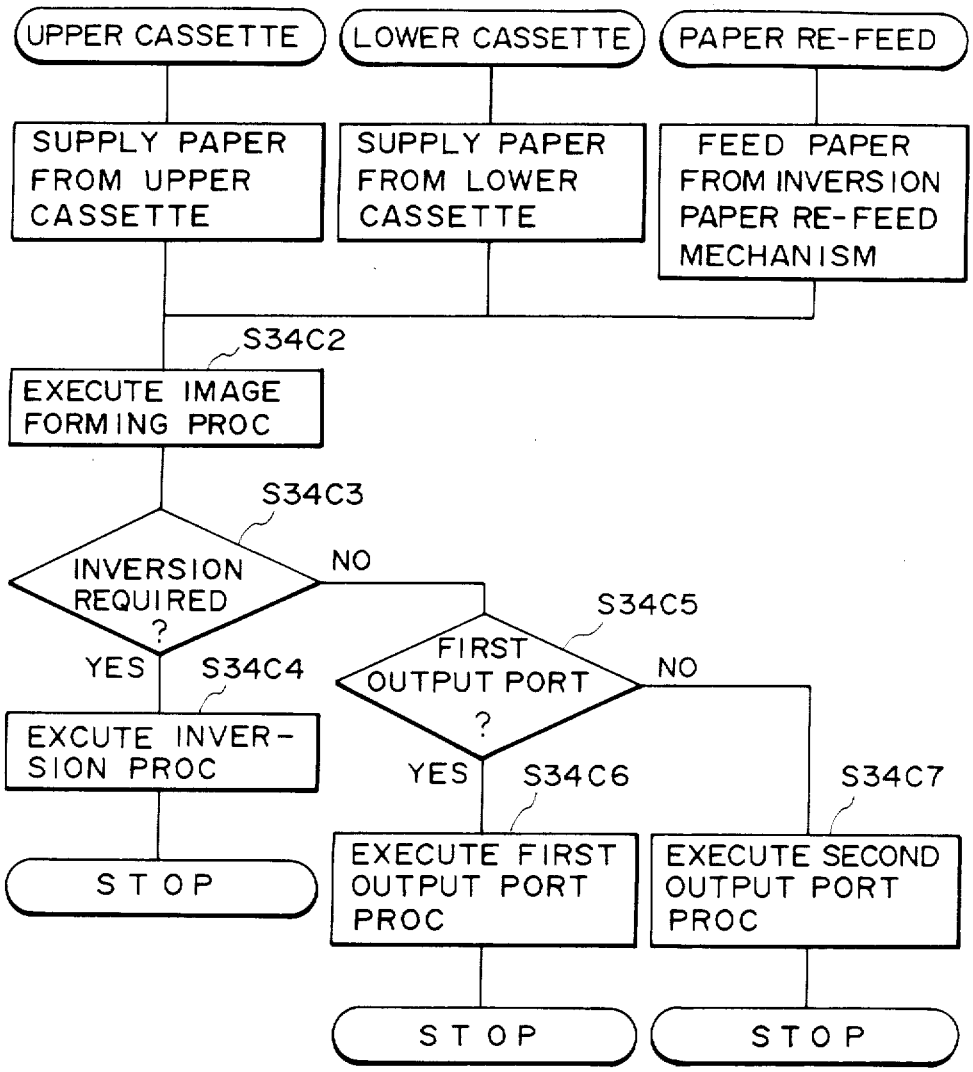
FIG. 31 shows a processing program conforming to the paper supply position and the paper output port.

FIG. 29A shows the pre-processing program. Step S34b1 is for controlling the start of the operations of the various mechanisms of the electrophotographic process, and corresponds to steps S31b1 to S31b11. Step S34b2 is the processes for determining the feed path in accordance with a parameter initially set by CPU 210 as shown in FIG. 30. More specifically, this step effects control such that when a reversing flag Rf is "1", both guides 3304 and 3305 are raised so that the copying paper may be conveyed by the reversing and refeeding mechanism 3303, and when the reversing flag Rf is "0", the guide 3305 is lowered, and when a first paper output flag E1f if "1", the guide 3304 is raised, and when the first paper output flag E1f is "0", the guide 3304 is lowered, whereby the paper output port is provided by the first paper output port 3301 or the second paper output port 3302.

Figure 29B:
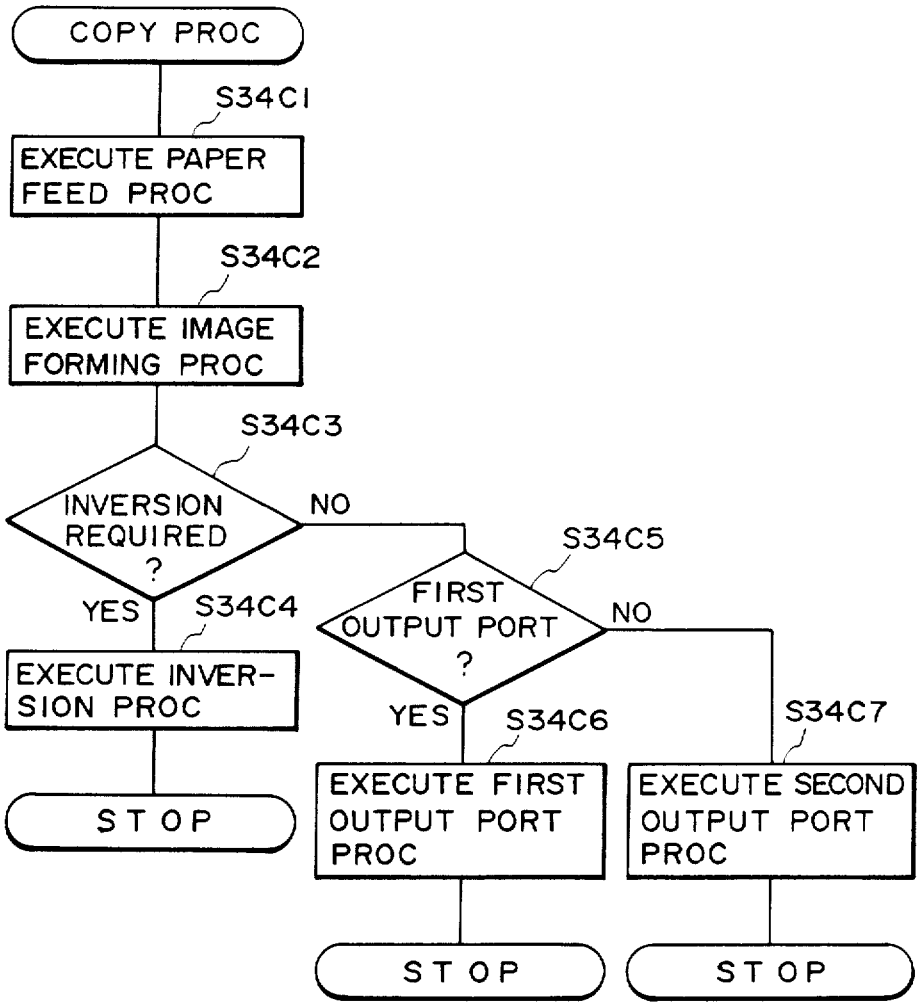

FIG. 29B shows the copy processing program in the present embodiment. Step S34c1 is basically similar to steps S31c1–S31c6, but differs from the latter in that the selection of the paper feed rollers at step S31c4 is such that when a paper re-feeding flag Mf is "1", the paper feed roller 3006 is selected and when the paper re-feeding flag Mf is not "1", the object of paper feeding is determined as at step S31c4. Step S34c2 is similar to steps S31c7–S31c38, and thereafter, at steps S34c3 and S34c5, the supply source of the copying paper is checked by the reversing flag Rf and the first paper output flag E1f and correspondingly thereto, the program branches off to the processes of steps S34c4, S34c6 and S34c7. The first paper output port processing of step S34c6 corresponds to steps S31c38–S31c45. Likewise, the second paper output port processing is executed at step S34c7, and the control of the paper reversing and re-feeding mechanism is executed at step S34c4.

With the above-described construction, the program can be made in conformity with the paper feed path and programming conforming to the actual movement of the object can be accomplished and therefore, misprogramming can be greatly reduced.

If, as shown in FIG. 30, a plurality of entry addresses of the copy processing are prepared and the design is made such that by the destinations of paper feed, the program starting positions of the subprocessors are determined at the step S31a7 in the copy processing, a program better conforming to paper feed can be made, and this leads to reduced misprogramming and reduced development cost.

Also, in the present embodiment, jam detection can be realized in the same program. This is because a subprocessor is allotted to each sheet of copying paper and that subprocessor controls the feeding of that sheet of paper and therefore, by the utilization of the fact that the maximum arrival time from a certain paper sensor to the position of the next paper sensor is definite, detection of a jam can be simply rendered as when the paper cannot yet be detected even if that time has elapsed. Of course, this also holds true for the time during which the paper at a paper sensor changes from present to absent.

Figure 32:
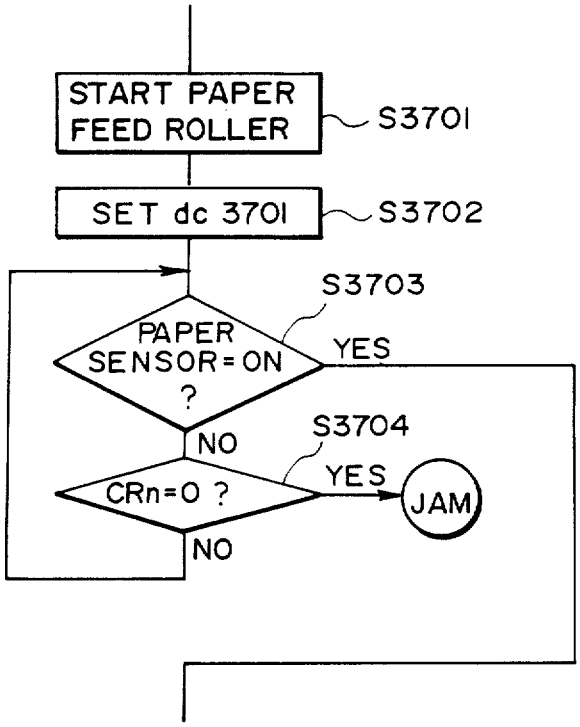
FIG. 32 shows a jam detection program.

For example, the steps S31c4–S31c5 of FIG. 26C may be changed as shown in FIG. 32. That is, at step S3701, the paper feed roller starts to be rotated and subsequently, a drum clock time dc3701 into which the time required for the leading edge of the paper to arrive at the paper sensor plus some surplus has been converted is substituted into the internal timer CNTn (the address 3 of the local address at step S3702, and a timer starting flag CRn is set. At step S3703, the arrival of the leading edge of the paper is examined, and if there is no paper there, the timer starting flag CRn is examined at step S3704. If the timer starting flag CRn has become "0", it is seen that the time when the paper should have arrived is exceeded and therefore it is judged as a jam, and the program branches off to the processes therefor. If not so, step S3703 and so forth are repeated.

By inserting the jam check routine as described above into the paper sensor judging portion, jam detection easily becomes possible.

Moreover, detection of each sheet can be accomplished and therefore, what sheet has jammed at what position can also be appropriately judged.

Figure 33:
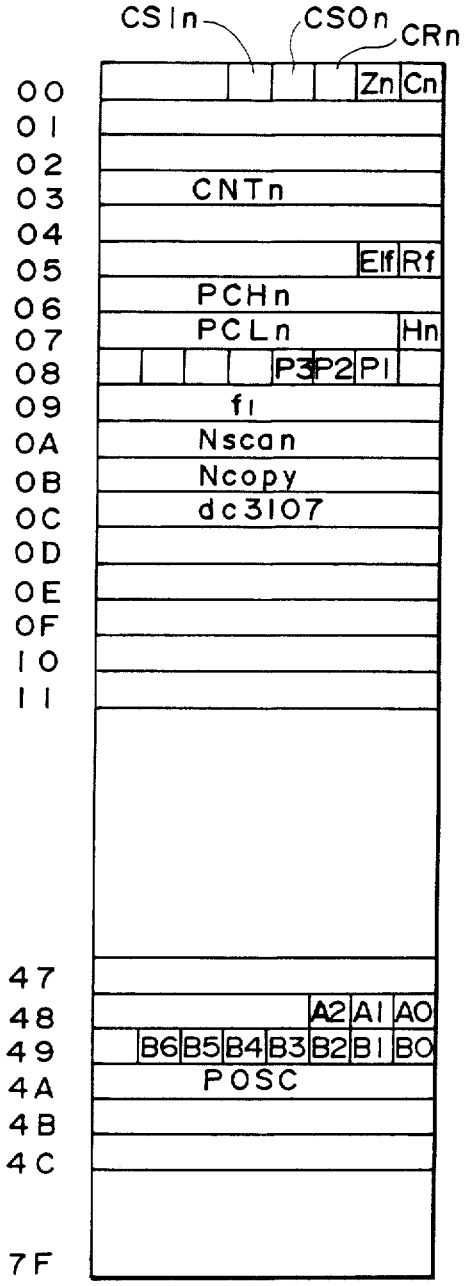
FIG. 33 shows a memory address.
Figure 34:
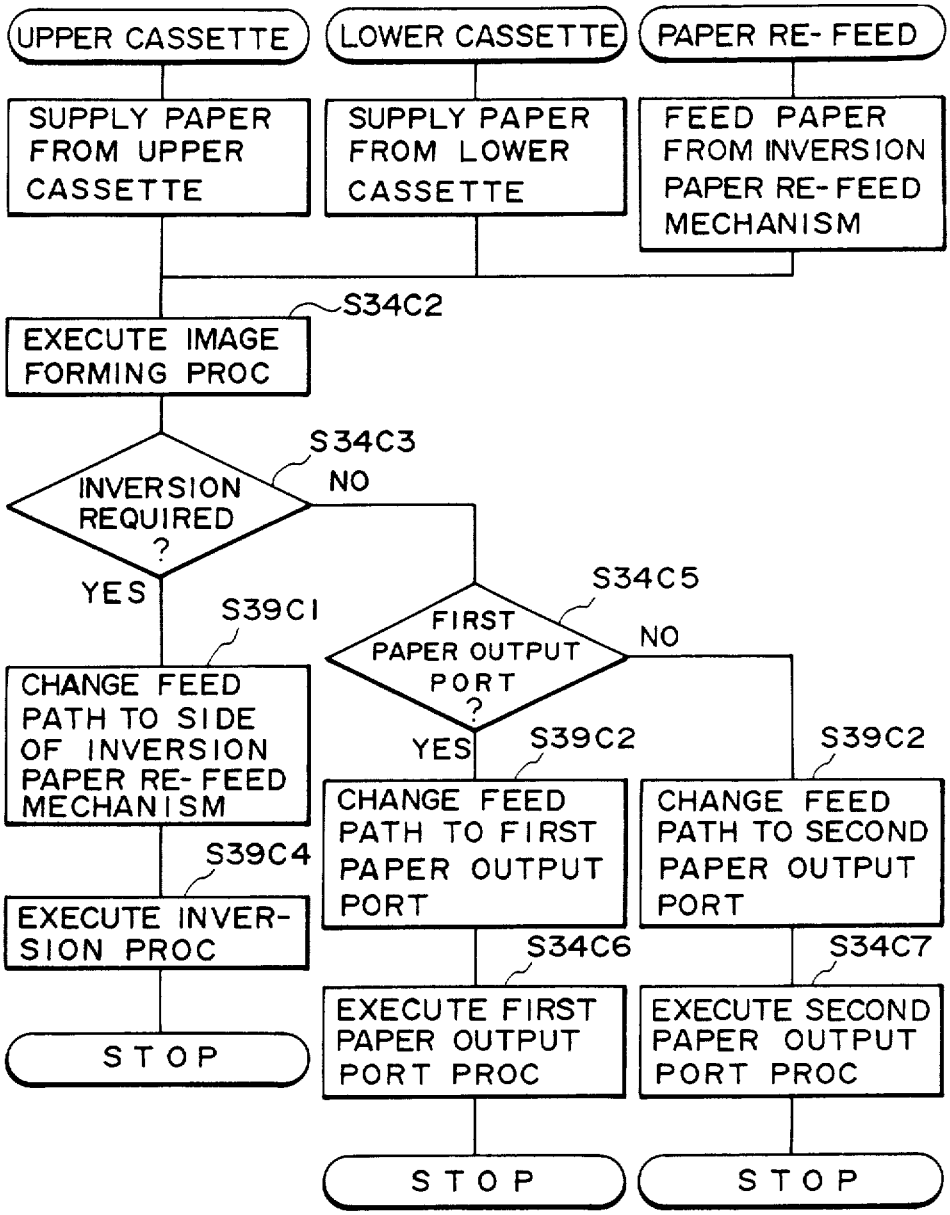
FIG. 34 shows a program for changing the path.

The foregoing fourth and fifth embodiments have been described with respect to a case where the paper feed path is fixed when the copying operation is performed continuously. However, according to the present embodiment, in executing the copy processing in CPU 210, the parameter of the information regarding the paper feed path is written not into the common memory area of the dual port RAM 411 (the addresses 08H–47H of the local address), but into the local area of the subprocessor to be actuated, whereby a copying operation in which the paper feed path differs from sheet to sheet can be simply realized For example, as shown in FIG. 33, in the copy request processing, CPU 210 sets the reversing flag Rf and the first paper output flag E1*f* at the address 05H of the local address of the subprocessor in charge of the copy processing, the entry address of the copy processing conforming to the source of paper feed is stored into the program counter (the addresses 07 and 08 of the local address), the copy processing is executed as shown in FIG. 34, and the operation of changing the path is executed in the copy processing. That is, at step S39*c*1, guides 3304 and 3305 are controlled so that the copying paper is fed to the inversion paper re-feed side, and at step S39*c*2, the guides are controlled so that the copying paper is fed to the first paper output port, and at step S39*c*3, the guides are controlled so that the copying paper is fed to the second paper output port.

As described above, an operation control unit (subprocessor) effects monitoring and control for each sheet of paper from when it is fed until it is discharged and therefore, programming becomes simple and moreover, fine control and state monitoring can be accomplished and thus, both improved performance and reduced development cost have become realizable.

<Sixth Embodiment>

A sixth embodiment will hereinafter be described with reference to FIG. 35 and so on.

[Description of the Circuit Block of the Copying Apparatus (FIG. 35)]

Figures 1, 35A:
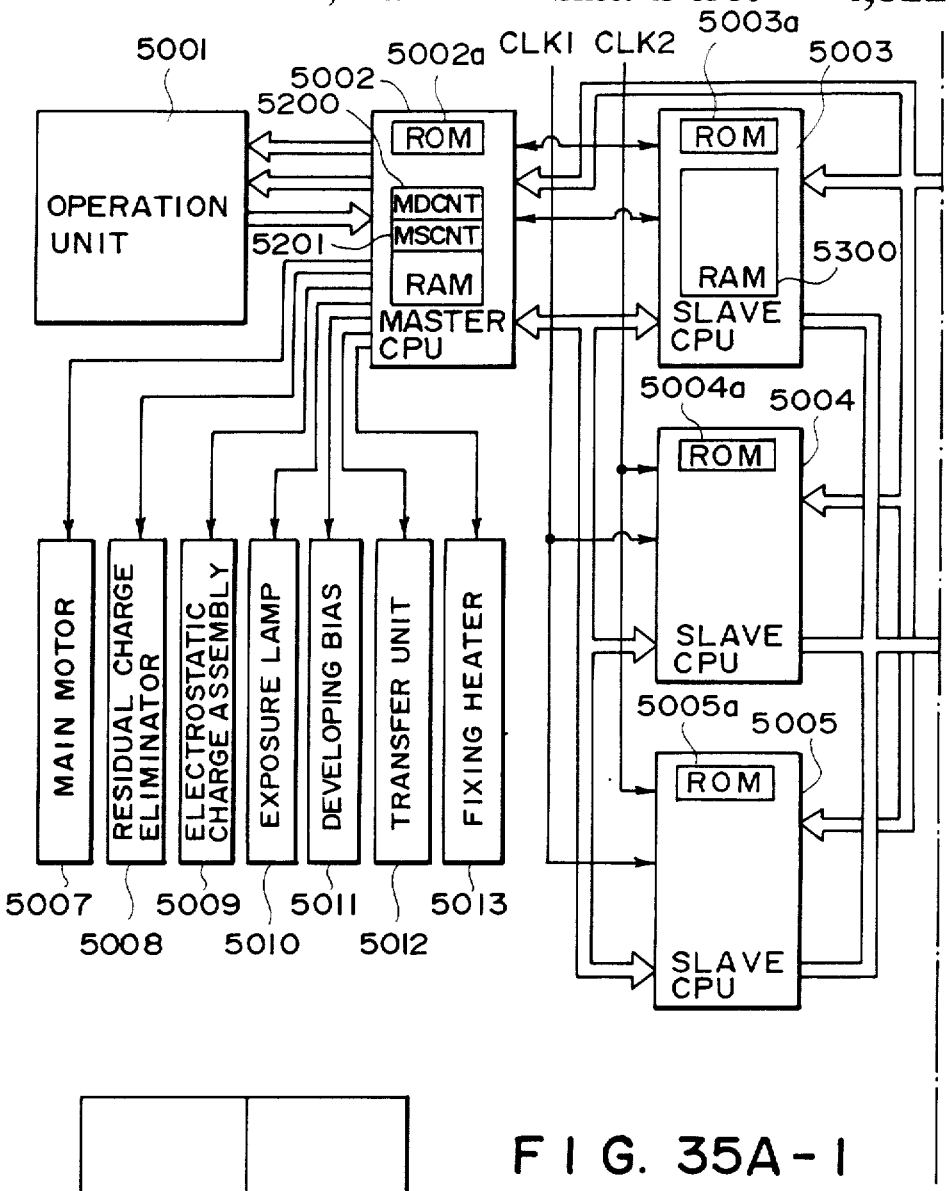
Figure 35A:
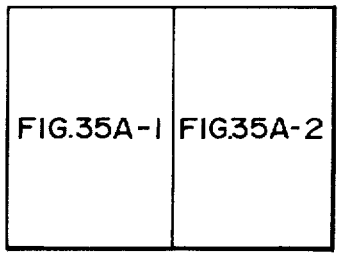
Figures 2, 35A:
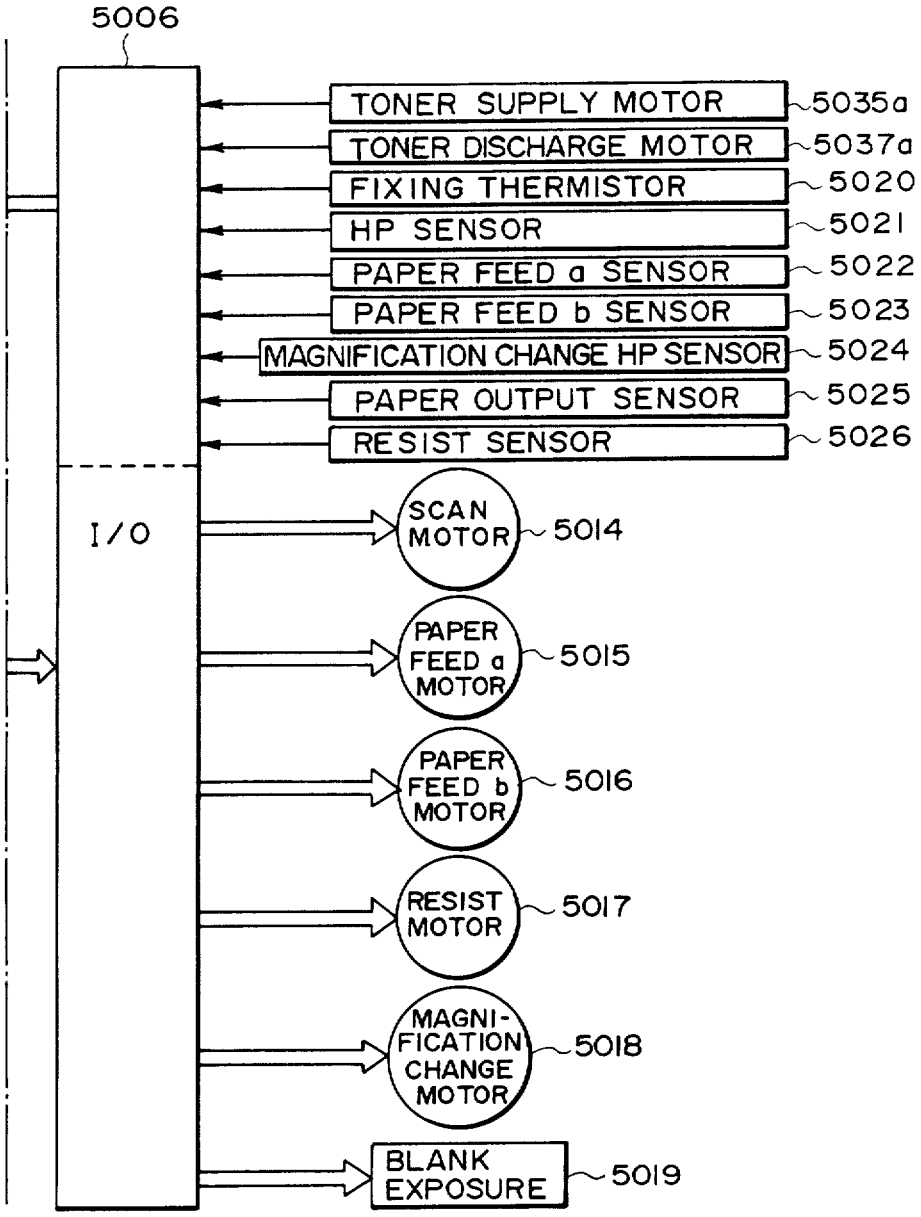
Figure 35B:
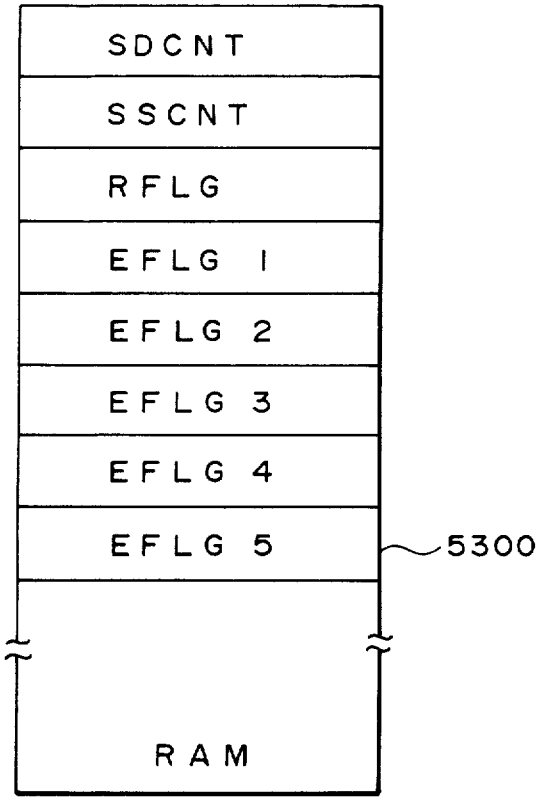
FIG. 35B are shows the construction of the RAM of a slave CPU.

First, FIGS. 35A-1 and 35A-2 are block diagrams showing the circuit construction o the copying apparatus according to a sixth, embodiment of the present invention. In FIG. 35A-1, reference numeral 5001 designates an operation unit comprised of various input keys and a display portion, and reference numeral 5002 denotes a master CPU for making up the whole. The master CPU 5002 contains a control program, data, etc. in ROM 5002*a*. Reference numerals 5003–5005 designate slave CPUs which are in charge of the control of the load. The same control program is contained in ROMs 5003*a*-5005*a* and controls a common I/O group 5006 (FIG. 35A-2). This I/O group 5006 is controllable by the master CPU 5002 and the slave CPUs 5003–5005.

Reference numerals 5007–5013 denote groups of loads directly controlled by the master CPU 5002, reference numeral 5007 designates a main motor, reference numeral 5008 denotes a residual charge eliminator, reference numeral 5009 designates an electrostatic charge assembly, reference numeral 5010 denotes an exposure lamp, reference numeral 5011 designates a developing bias, reference numeral 5012 denotes a transfer unit, and reference numeral 5013 designates a fixing heater.

Reference numeral 5014 (FIG. 35A-2) denotes a scan motor for scanning an optical system, reference numerals 5015 and 5016 designate paper feed motors for driving a paper feed roller, reference numeral 5017 denotes a resist motor for driving a resist roller, reference numeral 5018 designates a magnification change motor for driving a zoom lens, and reference numeral 5019 denotes blank exposure for erasing the leading and trailing ends and the side.

Reference numeral 5020 designates a fixing thermistor for detecting the temperature of a fixing device, reference numeral 5021 denotes an HP sensor for detecting the home position (HP) of the optical system, reference numerals 5022 and 5023 designate paper feed sensors for detecting the presence or absence of paper in paper supply cassettes. The number of the paper feed sensors corresponds to the number of the paper supply cassettes, and is two in this embodiment. Reference numeral 5024 denotes a magnification change HP sensor for correcting the absolute position of the zoom lens, reference numeral 5025 designates a paper output sensor for detecting the output of recording paper, and reference numeral 5026 denotes a resist sensor for detecting whether paper is accurately fed out from a paper supply station to a resist roller. Reference character 5035*a* designates a toner supply sensor for detecting the amount of toner in a developing device, and reference character 5037*a* denotes a toner discharge sensor for detecting the amount of discharged toner in a cleaner unit.

CLK1 designates a drum clock in synchronism with the rotation of a photosensitive drum, and CLK2 denotes a scan clock in synchronism with the scanning of the optical system. Both of CLK1 and CLK2 are connected to the master CPU 5002 and the slave CPUs 5003–5005.

[Description of the Schematic Construction of the Copying Apparatus (FIG. 36)]

Figure 36:
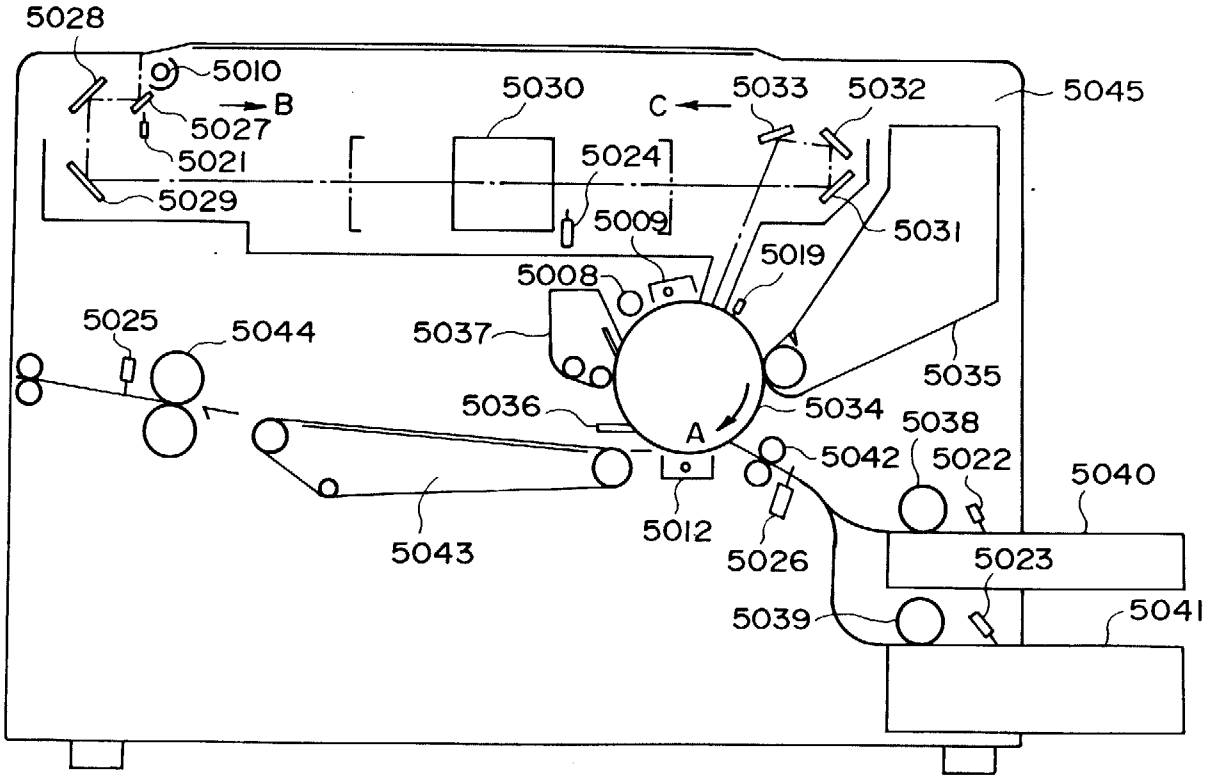
FIG. 36 is a schematic cross-sectional view of a copying apparatus.

FIG. 36 is a schematic cross-sectional view of the copying apparatus and in this Figure, members identical to those in FIG. 35 are given identical reference numerals.

An original is slit-exposed by the exposure lamp 5010 which is the original illuminating means, and the image of the original is formed on the photosensitive drum 5034 by the zoom lens 5030. The then reflected light from the original is directed to the photosensitive drum 5034 via a first mirror 5027, a second mirror 5028, a third mirror 5029, the zoom lens 5030, a fourth mirror 5031, a fifth mirror 5032 and a sixth mirror 5033.

At this time, in accordance with the rotation of the photosensitive drum 5034 in the direction of arrow A, the exposure lamp 5010 and the first mirror 5027 are moved in the direction of arrow B. At one-half of the movement velocity of the exposure lamp 5010 and the first mirror 5027, the second mirror 5028 and the third mirror 5029 are moved in the direction of the same arrow B. This is for making the length of the optical path constant. After the exposure lamp 5010 and the first mirror 5027 have scanned by an amount corresponding to the length of the original, they begin to move in the direction of arrow C and arrive at the HP sensor 5021, whereby they are stopped, or during continuous copying, these operations are repeated.

By the above-described operation, an electrostatic latent image is formed on the photosensitive drum 5034 electrostatically and is charged by the electrostatic charge assembly 5009, and then is developed by the developing device 5035. Sheets of paper are fed one by one from a paper supply a cassette 5040 or a paper supply b cassette 5041 by the paper feed a roller 5038 or the paper feed b roller 5039, and the image is transferred, by the transfer unit 5012, onto transfer paper registered by the resist roller 5042. Thereafter, the transfer paper having the image transferred thereto is separated from the photosensitive drum 5034 by a separator 5036, and is conveyed by a conveyor 503 and the toner transferred onto the transfer paper is fixed by the fixing device 5044, whereafter the transfer paper is discharged out of the apparatus.

[Description of the Timing of the Copying Apparatus (FIG. 37)]

Figure 37:
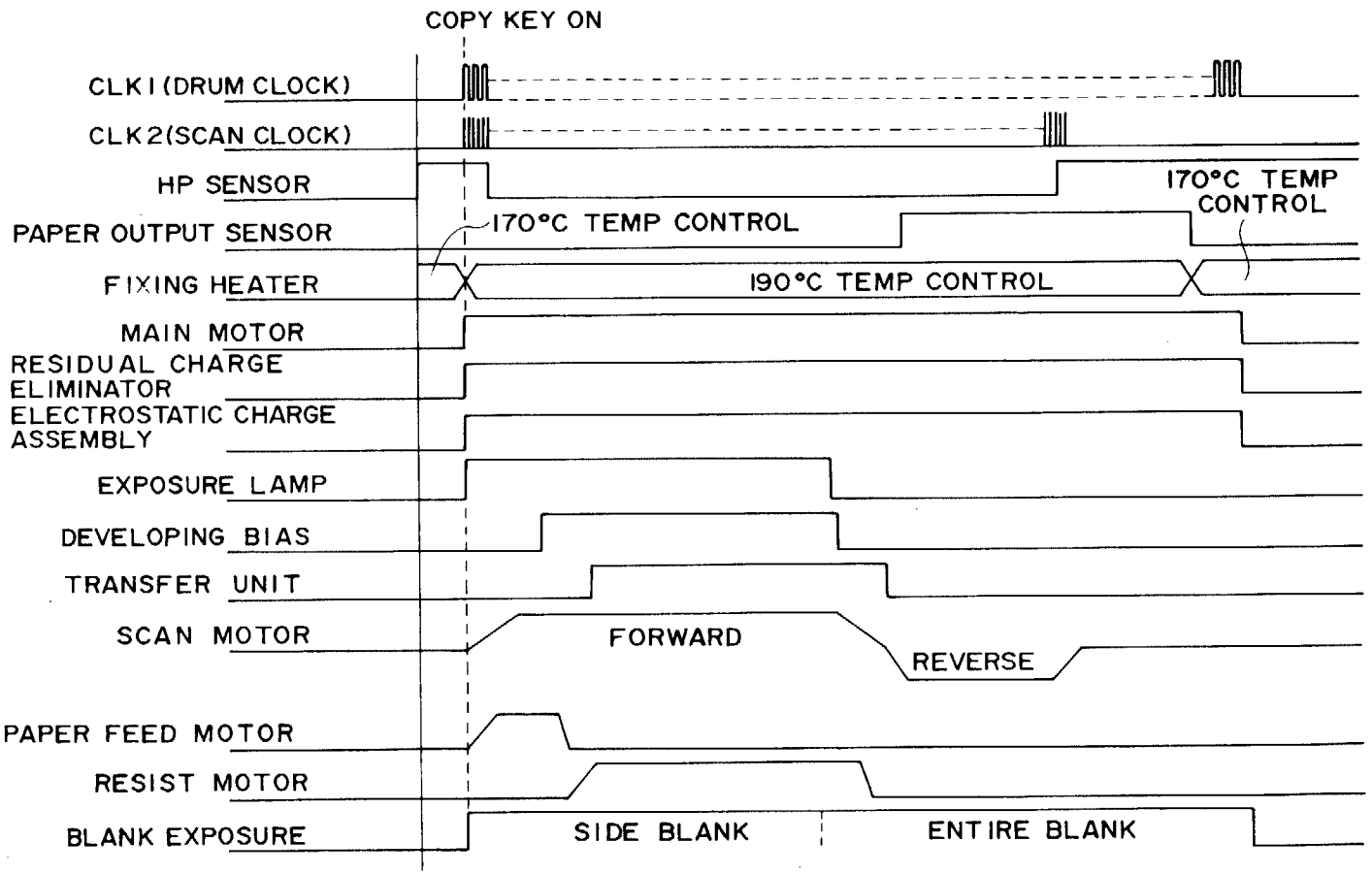
FIG. 37 is a timing chart showing ON and OFF of loads in a predetermined mode.

FIG. 37 is a timing chart showing the controlled state of the copying apparatus. This timing chart is that during one sheet copying.

In FIG. 37, the various motors and the blank exposure are described at a flat level, but in any case, these show the timings and differ from the actual controlled state.

By the copy key of the operation unit 5001 being depressed, the outputting of the drum clock CLK1 and the scan clock CLK2 is started and the reciprocal movement by the scan motor 5014 is executed, and when the return to the home position is again confirmed by the HP sensor, the scan clock CLK2 is stopped. Also, by the transfer paper being discharged out of the apparatus after the image is transferred onto and fixed on the transfer paper, the outputting of the drum clock CLK1 is stopped.

[Description of the Operation of the Master CPU (FIG. 38) (FIGS. 42–44)]

Figure 38:
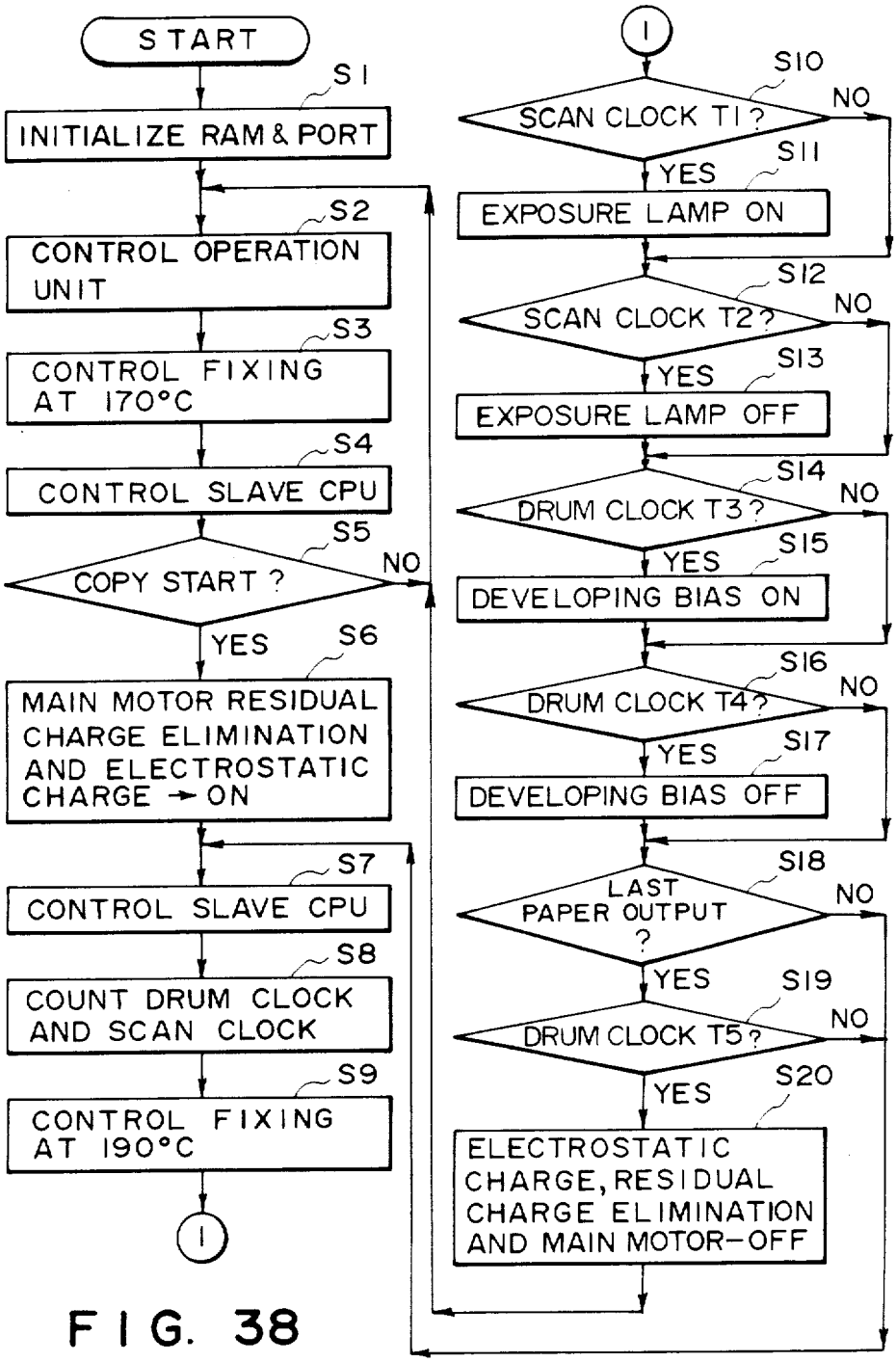
FIG. 38 is a main flow chart showing the processing of a master CPU.

FIG. 38 is a flow chart of the control program contained in the ROM 5002*a* of the master CPU 5002.

When a main switch is closed, the execution is started. First, at step S1, the RAM and PORTs of the master CPU 5002 are initialized, and at step S2, control of the operation unit 5001 is executed. This is for checking the keys on the operation unit 5001, effecting appropriate display in accordance with the change of the mode which will later be described, and displaying an abnormality or the like of the machine.

Step S3 is a step at which the fixing device 5044 is controlled to a proper temperature, say, 170° C. during the waiting period, and 190° C. during the copying period, by temperature information obtained from the fixing thermistor. Step S4 is for controlling the slave CPU 5003, the slave CPU 5004 and the slave CPU 5005, and at this step during which the program is waiting, mode numbers 0–4 shown in FIG. 42 are successively allotted to the slave CPUs 5003–5005, and a check of the state of the machine and control of the machine are executed.

Figure 43:
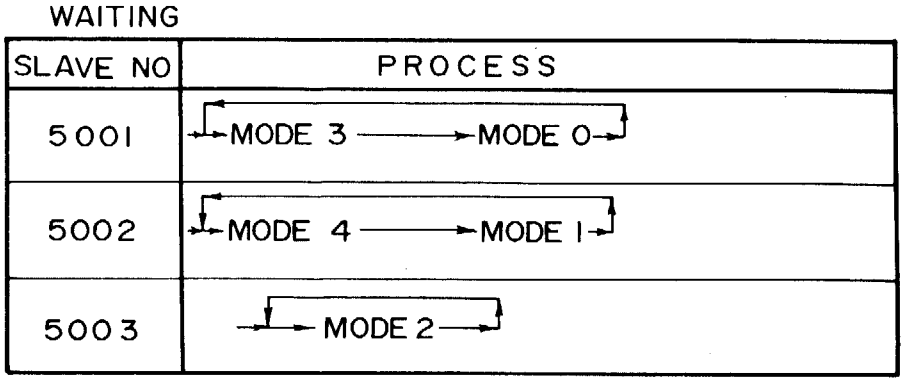
FIG. 43 shows the mode shift of the slave CPU during the waiting.

The flow during this waiting is shown in FIG. 43. In this Figure, the numbers of the slave CPUs and the mode numbers are written as being restricted, but this is not restrictive. Also, as regards the shift from one mode to another mode, in the present embodiment, the shift is shown as taking place when there is no abnormality, but again, the shift may take place, for example, in each particular processing block. Thus, of course, the response to abnormality becomes quicker and accordingly, this shift from one mode to another mode is not restricted to the present embodiment.

At step S5, whether copying should be started is judged, and when there is no problem in the conditions of the machine or the operation unit and the copy key is in its depressed position, the program proceeds to the next step S6, and when the copy key is not in its depressed position or when there is a problem in the conditions, the program returns to step S2. At step S6, the main motor 5007, the residual charge eliminator 5008 and the electrostatic charge assembly 5009, which are loads of which the timing control is not effected, are switched on, and at step S7, control of the slave CPU 5003 to the slave CPU 5009 is executed.

Figure 44:
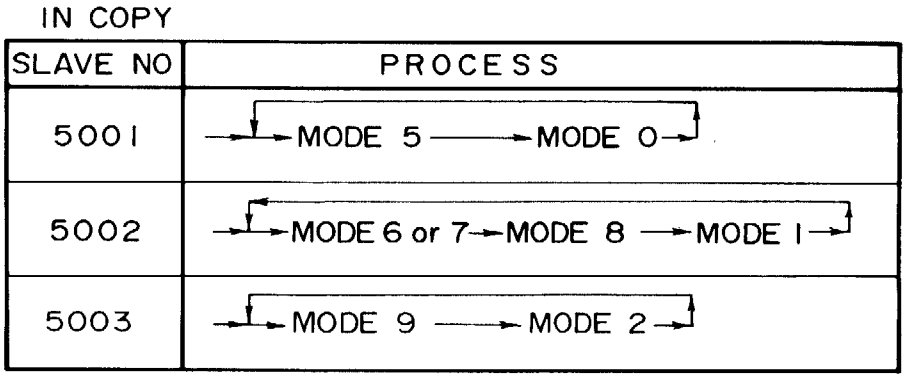
FIG. 44 shows the mode shift of the slave CPU during the copying.

At the present step during which copying is taking place, the mode numbers 0–9 shown in FIG. 42 are successively allotted to the slave CPU 5003 to the slave CPU 5005, whereby a check of the state of the machine and control of the machine are executed. The flow during this copying is shown in FIG. 44. Again in FIG. 44, the numbers of the slave CPUs and the mode numbers are written as being restricted, but this is not restrictive.

Next, at step S8, the drum clock CLK1 and the scan clock CLK2 are counted, and these values are referred to at the subsequent steps. In the present embodiment, each time the clocks CLK1 and CLK2 are input, the drum clock counter MDCNT and the scan clock counter MSCNT of the RAM of the master CPU 5002 are incremented, and are cleared at a predetermined timing and at the same time, subtraction or the like of the number of copies is effected. This means that, as will be described later, a part of the operation unit, for example, the number of copies or the copy stop key is also controlled.

At step S9, the fixing device 5044 is controlled to a proper temperature, say, 190° C. by temperature information obtained from a fixing thermistor 5020. At step S10, the scan clock CLK2 is checked, and when the value of MSCNT becomes T1, the program proceeds to step S11, at which the exposure lamp 5010 is turned on.

Likewise, at step S12, the scan clock CLK2 is checked, and when the value of MSCNT is T2, the program proceeds to the next step S13, at which the exposure lamp 5010 is turned off. Thus, the exposure lamp 5010 remains turned on for $(T2-T1)\times$(period of the scan clock).

Likewise, at step S14, the count number of the drum clock CLK1 is checked and, when the value of MDCNT becomes T3, the program proceeds to step S15, at which the developing bias 5011 is turned on. At step S16, when MDCNT indicating the count value of the drum clock CLK1 assumes T4, the program proceeds to step S17, at which the developing bias 5011 is turned off. Here, $T1<T2<T3$.

Step S18 is for checking by the paper output sensor 5025 whether the last sheet of paper has been output, and if the last sheet of paper has not been output, the program returns to step S7 and the above-described operation is repeated, and if the final sheet of paper has been output, the program proceeds to step S19, at which the drum clock CLK1 is checked, and when the count number is T5 ($T4<T5$), The program proceeds to the next step S20, at which the electrostatic charge assembly, the residual charge eliminator and the main motor are turned off, and the program again returns to step S2, at which the program waits.

[Description of the Operation of the slave CPUs (FIGS. 39A–39B and FIGS. 42–44)]

FIGS. 39B–39I are the main flow charts of the control programs contained in the ROMs 5003*a*–5005*a* of the slave CPUs 5003–5005. The contents of the ROMs 5003*a*–5005*a* are similar to one another and therefore, herein, a description will be given of the slave CPU 5003.

When a main switch, not shown, is closed as in the case of the master CPU 5002, execution is started and first, at step S30, the RAM and PORT of the slave CPU 5003 are initialized, and at steps S31–S40, which of the modes shown in FIG. 42 is designated is checked. If a mode is designated, a predetermined processing is executed, and after the processing has been terminated or if no mode is designated, whether the copying is taking place is checked at step S41, and if the copying is not taking place, the program returns to step S31, and if the copying is taking place, the program proceeds to step S42.

At step S42, counting of the drum clock CLK1 is effected by the use of SDCNT and the number of copies is checked so that these can be referred to during the other processing. After the termination of this processing, the program returns to step S31 and the above-described operation is repeated. The processing of each mode will now be described.

In the case of mode 0 in which the toner supply is checked, the program proceeds to step S43, at which whether the toner supply sensor 5035*a* is switched on is checked, and if that sensor is not switched on, the master CPU 5002 is informed of the normal state, and then the program proceeds to step S41. If said sensor is switched on, the program proceeds to step S44, at which whether the toner supply sensor 5035*a* is switched on a predetermined number of times (or for a predetermined time) is checked. If the predetermined number of times (or the predetermined time) is not reached, the program proceeds to step S41, and if the predetermined number of times (or the predetermined time) is reached, the master CPU 5002 is informed of abnormality (absence of toner) at step S45. As will be described later, interruption occurs to the master CPU 5002 by the delivery of data from the slave CPUs 5003–5005 to the master CPU 5002, and the master CPU 5002 processes the data from the slave CPUs 5003–5005 in the interruption processing routine.

In the case of mode 1 in which absence of paper is checked, the program proceeds to step S46, at which whether the paper feed a sensor 5022 is switched on is checked, and if the sensor 5022 is not switched on, the master CPU 5002 is informed of normalcy (the paper feed a side) and the program proceeds to step S41. If the sensor 5022 is switched on, the master CPU 5002 is informed of abnormality (absence of paper on the paper feed a side) at step S47, and then the program proceeds to step S48, at which whether the paper feed b sensor 5023 is switched on is checked, and operations similar to steps S46 and S47 are performed.

In the case of mode 2 in which toner discharge is checked, the program proceeds to step S50, at which whether the toner discharge sensor 5037*a* is switched on is checked, and if this sensor 5037*a* is not switched on, the master CPU 5002 is informed of normalcy and the program proceeds to step S41. If the sensor 5037*a* is switched on, the program proceeds to step S51 and whether the toner discharge sensor 5037*a* is switched on a predetermined number of times (or a predetermined time) is checked, and if the predetermined number of times (or the predetermined time) is not reached, the program proceeds to step S41, but if the predetermined number of times (or the predetermined time) is reached, the master CPU 5002 is informed of abnormality (abnormal toner discharge) at step S52.

Figure 39A:
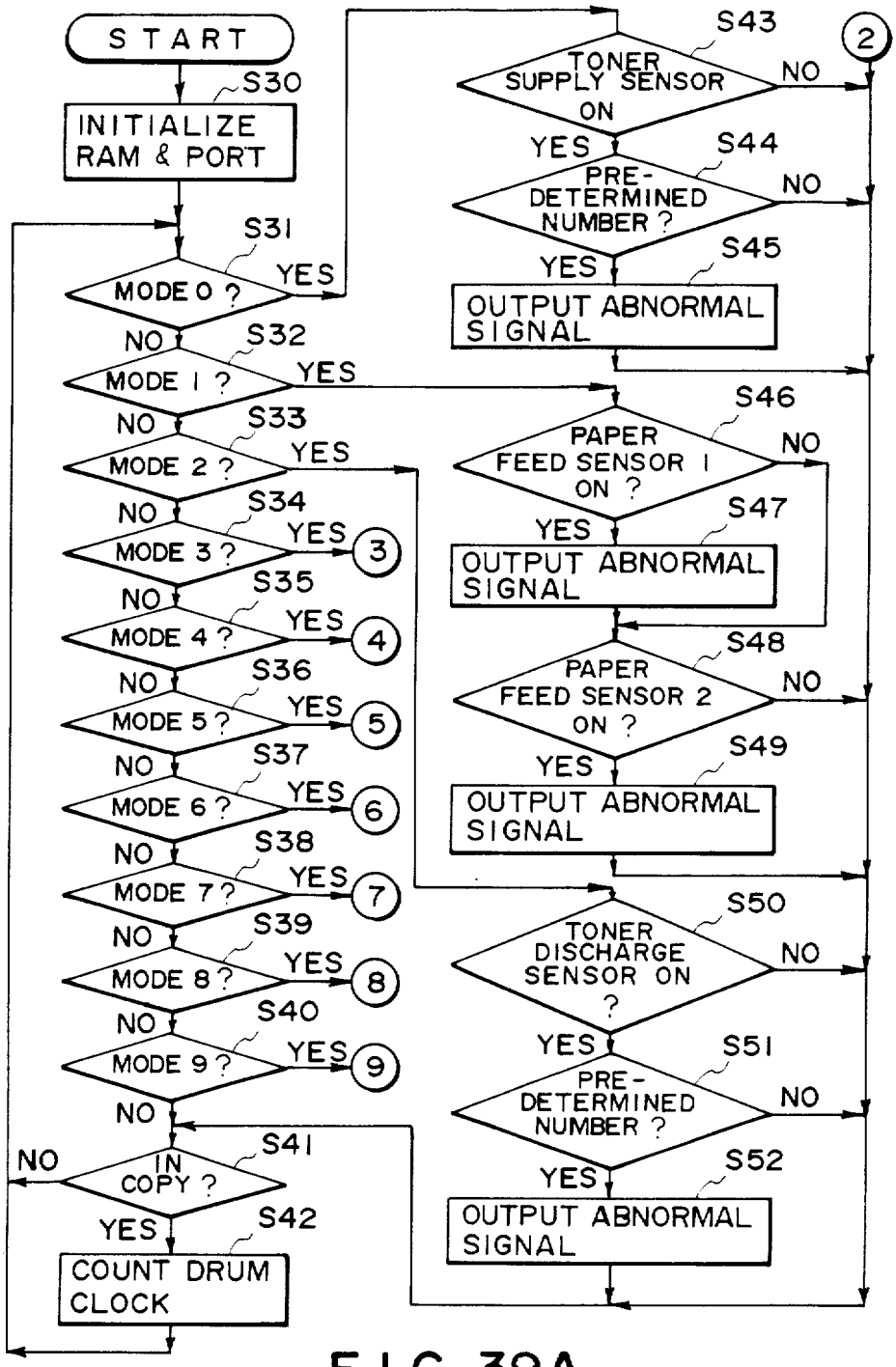
FIGS. 39A to 39H are main flow charts showing the processing of the slave CPU.
Figure 39B:
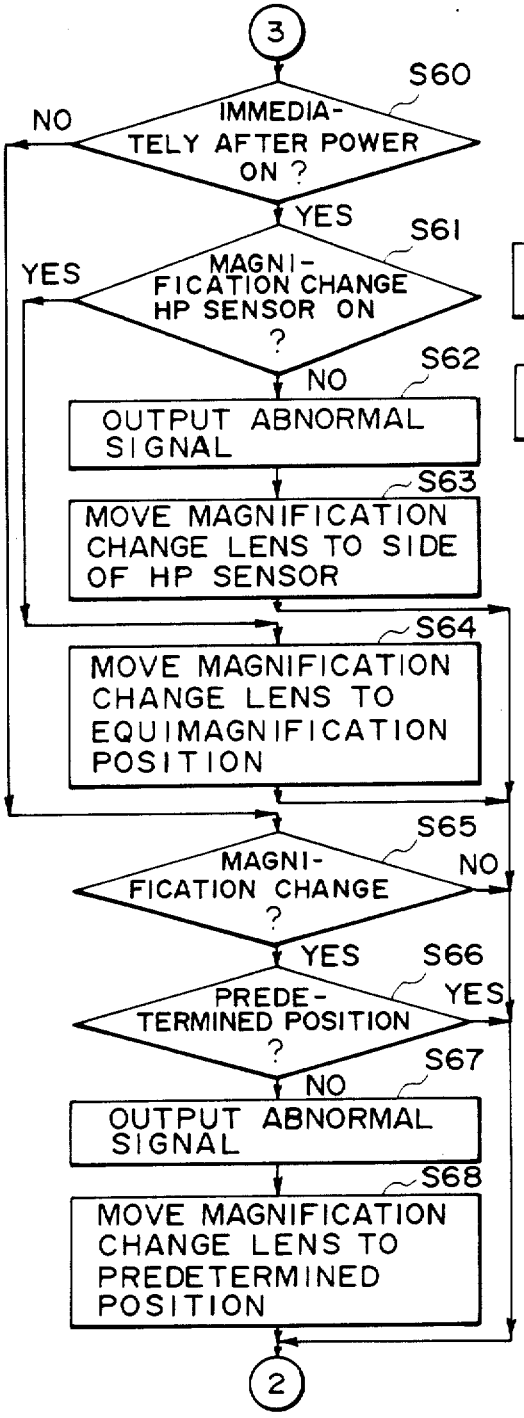

In the case of mode 3 in which the magnification change lens is controlled, the program proceeds to the step S60 of FIG. 39B, and whether it is immediately after the power source is ON is checked. If it is immediately after the power source is ON, the program proceeds to step S61 and whether the magnification change home position sensor 5024 is switched on is checked. If the sensor 5024 is not switched on, the CPU 5002 is informed of abnormality (the magnification change lens being unset) at step S62, and at step S63, the magnification change motor 5018 is driven to move the magnification change lens to the home position side, whereafter the program returns to step S41.

On the other hand, if the magnification change home position sensor 5024 is switched on at step S61, the program proceeds to step S64, at which the magnification change motor 5018 is controlled so that the magnification change lens is moved to the equimagnification position which is the initial set position, and when the magnification change lens arrives at a predetermined position, the master CPU is informed of normalcy. These are the absolute position correcting processes necessary to confirm the absolute position after the main switch has been closed, because the magnification change lens is driven by a stepping motor.

If at step S60, it is not immediately after the closing of the main switch, the program proceeds to step S65, at which whether the magnification has been changed is checked. If the magnification has not been changed, the program returns to step S41, but if there is a request for magnification change, the program proceeds to step S66, at which whether the magnification change lens has been moved to the position of the requested magnification is checked. If the magnification change lens has been moved to said position, the master CPU 5002 is informed of normalcy and the program proceeds to step S41, but if the magnification change lens has not been moved to said position, the program proceeds to step S67 and the master CPU 5002 is informed of abnormality (the movement range of the magnification change lens), and at step S68, the magnification change motor 5018 is driven to move the magnification change lens to a predetermined magnification position.

Figure 39C:
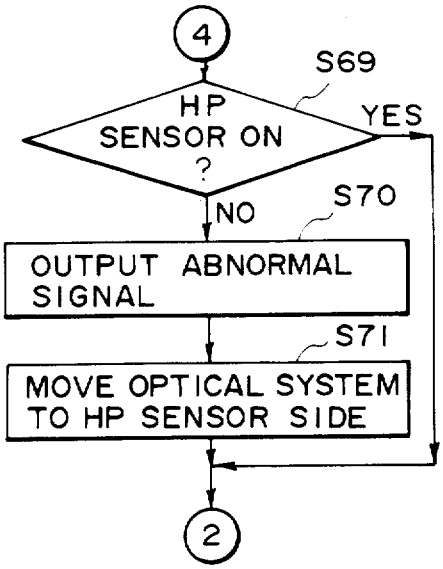

In the case of mode 4 in which the home position of the scanner is checked, the program proceeds to the step S69 of FIG. 39C, at which whether the optical system is detected by the home position sensor 5021 is checked. If the optical system is at the home position, the master CPU 5002 is informed of normalcy and the program proceeds to step S41, but if the optical system is not at the home position, the master CPU 5002 is informed of abnormality (the deviation of the optical system from the home position) at step S70, and at step S71, the scan motor 5014 which is a stepping motor is driven so that the optical system is moved toward the home position sensor 5021.

Figure 39D:
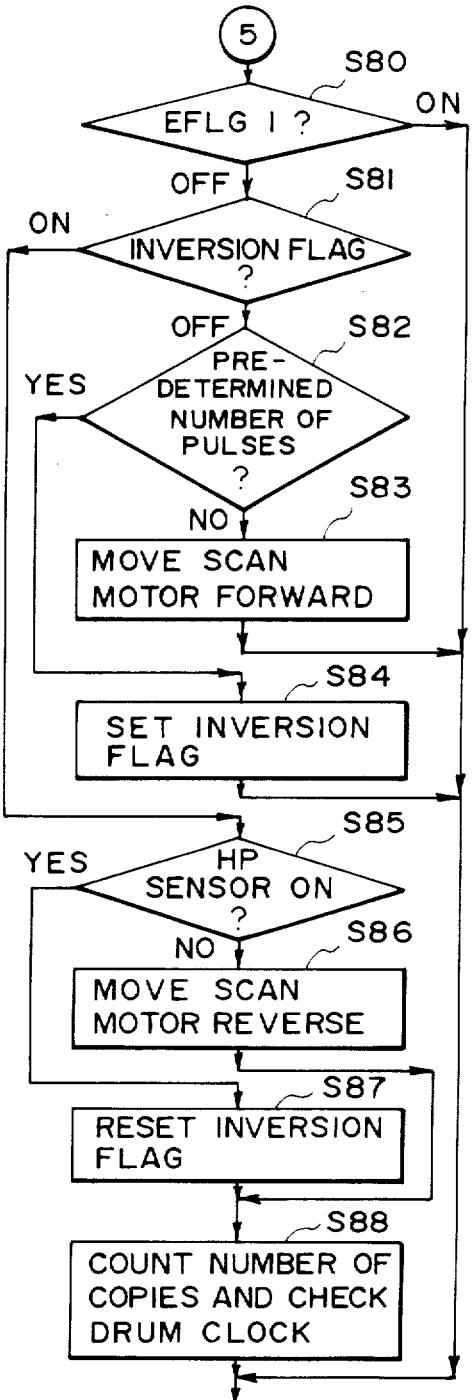

Next, in the case of mode 5 in which the movement of the scanner during the copying is effected, the program proceeds to the step S80 of FIG. 39D, at which the end flag EFLG1 of RAM 300 to be described is checked, and if the end flag EFLG1 is standing, the master CPU 5002 is informed of this and the program proceeds to step S41. If the end flag EFLG1 is not standing, the program proceeds to step S81, at which an inversion flag RFLG to be described below is checked. If the inversion flag RFLG is not standing, the program proceeds to step S82, at which the pulse number corresponding to the distance of movement of the optical system (the driving pulse number of the stepping motor) is checked. If a predetermined pulse number has not been reached, that is, if the optical system has not been moved by a distance equal to the size of the original, the program proceeds to step S83, at which the scan motor 5014 which is a stepping motor is driven for forward movement.

On the other hand, if at step S82, the optical system has been moved over the distance equal to the size of the original, the program proceeds to step S84, at which the inversion flag RFLG is set. Accordingly, the optical system has been moved forward by the processing described hitherto, thus having completed the exposure process.

By the inversion flag RFLG being set at step S84, it is judged at step S81 that the inversion flag RFLG is turned on in the flow of the next processing and therefore, the program proceeds to step S85, at which the mode for renewing the optical system comes.

At step S85, the home position sensor 5021 is checked and, if the optical system has not arrived at the home position, the program proceeds to step S86 at which the scan motor 5014 is driven for reverse movement, whereafter the program proceeds to step S88. Also, if at step 585, the optical system has arrived at the home position, the program proceeds to step S87, at which the inversion flag RFLG is reset. This shows that the reverse movement has been completed and one stroke of the exposure process together with the aforedescribed operation has been terminated.

Subsequently, at step S88, the count value of the number of copies and the drum clock CLK1 are checked and whether the exposure process has been completed is checked, and if the exposure process has not been completed, the program again proceeds to step S41. If the exposure process has all been completed, a completion signal is sent to the master CPU 5002 and the end flag EFLG1 is set, whereafter the program proceeds to step S41.

Figure 39E:
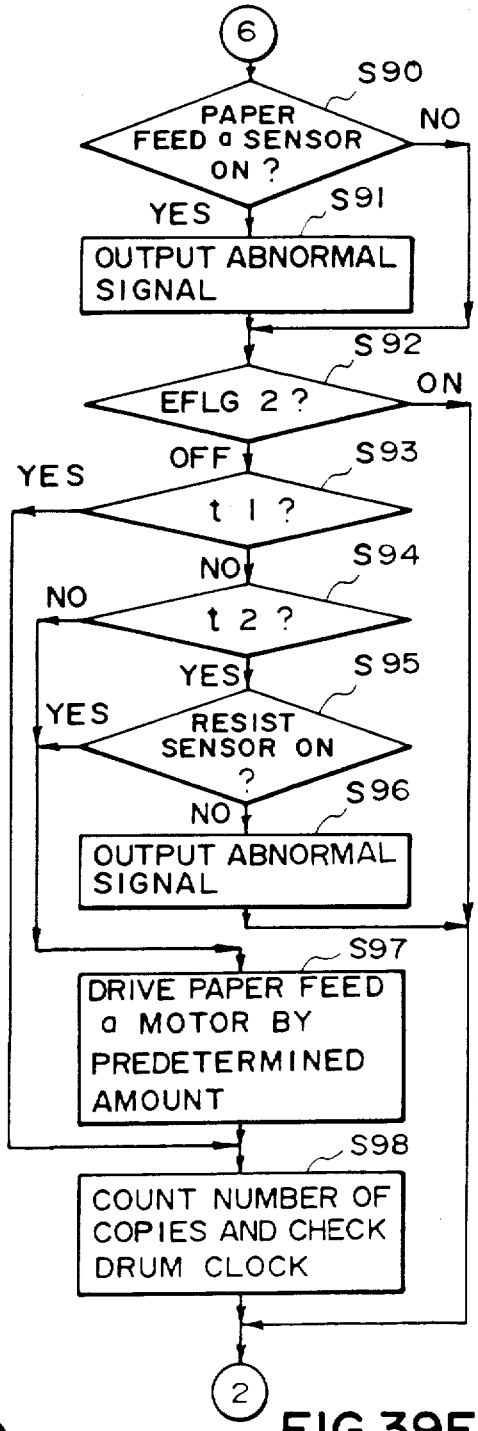

In the case of mode 6 in which the driving of the paper feed a roller 5038 by the paper feed a designation is effected, the program proceeds to the step S90 of FIG. 39E, at which the paper feed a sensor 5022 is checked. If the paper feed a sensor 5022 is not switched on, the program proceeds to step S92, but if the paper feed a sensor 5022 is switched on, the program proceeds to step S91, at which an abnormal signal (absence of paper on the paper feed a side) is sent to the master CPU 5002 and the end flag EFLG2 is set. At step S92, the end flag EFLG2 is checked. If the end flag EFLG2 is set, the master CPU 5002 is informed of it, and the program proceeds to step S41.

If the end flag EFLG2 is not set, the program proceeds to step S93, at which whether a pulse number t1 sufficient for the paper feed a roller 5038 to move the transfer paper by a sufficient distance to the resist roller has been given to the paper feed a motor 5015 is checked.

If this pulse number reaches t1, the program proceeds to step S98, but if the pulse number does not reach t1, the program proceeds to step S94. At step S94, whether a pulse number t2 sufficient for the paper feed a roller 5038 to move the transfer paper over the distance to a resist sensor 5026 installed on this side of the resist roller 5042 has been given to the paper feed a motor is checked. If the pulse number does not reach t2, the program proceeds to step S97, at which the paper feed a motor 5015 is driven, whereafter the program proceeds to step S98. At step S98, the count value of the number of copies and SDCNT WHICH COUNTS THE DRUM CLOCK CLK1 are checked and whether the paper feeding has been completed is examined. If the paper feeding has not been completed the program proceeds to step S41, and if the paper feeding has been completed, the master CPU 5002 is informed of the completion and the end flag EFLG2 is set, whereafter the program proceeds to step S41.

On the other hand, if at step S94, the pulse number reaches t2, the program proceeds to step S95, at which the resist sensor 5026 is checked. If the resist sensor 5026 is not switched on, the program proceeds to step S96, at which the master CPU 5002 is informed of the occurrence of a jam in the paper feed a portion and the end flag EFLG2 is set.

Figure 39F:
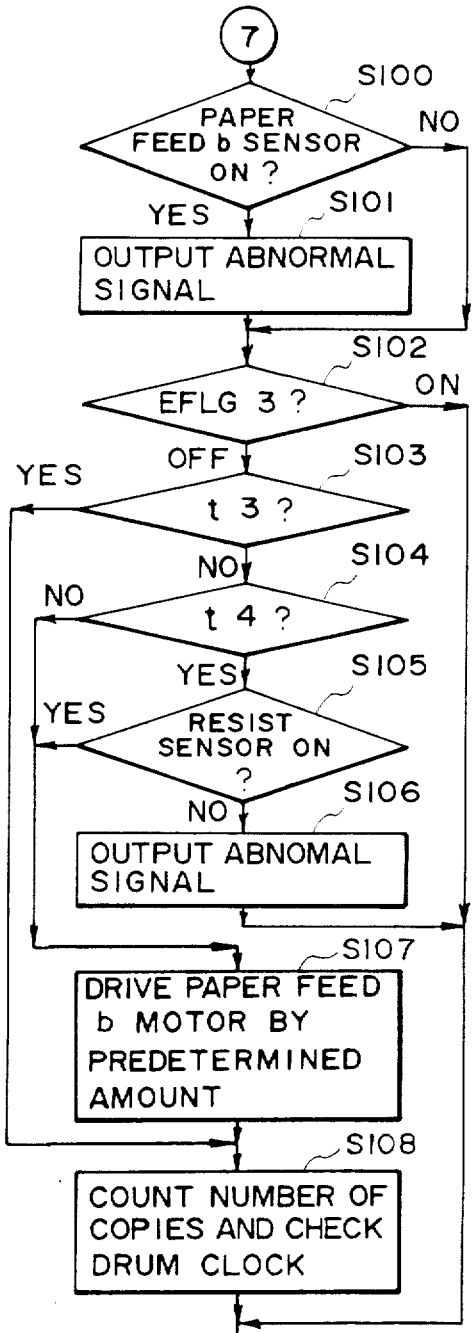

The operation flow chart of mode 7 in which the driving of the paper feed b roller 5039 by the paper feed b designation is likewise effected is shown in FIG. 39F. The operations of steps S100–S108 in this Figure are substantially similar to those of the steps S90–S98 of FIG. 39E and therefore need not be described herein.

Figure 39G:
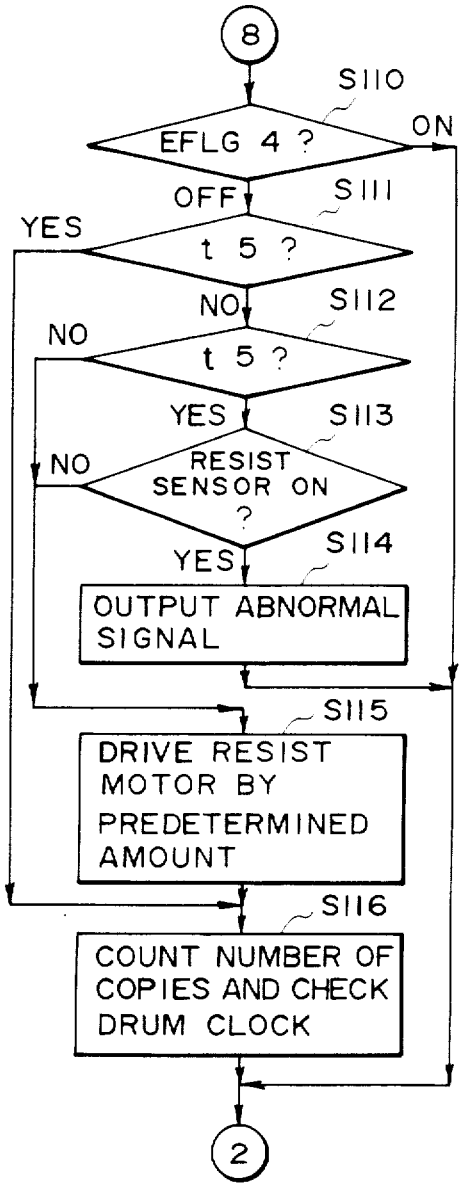

In the case of mode 8 in which the resist roller 5042 is driven, the program proceeds to the step S110 of FIG. 39G, at which an end flag EFLG4 to be described below is checked. If the end flag EFLG4 is standing, the program proceeds to step S41. If the end flag EFLG4 is not standing, the program proceeds to step S111, at which whether the driving pulse number of the paper feed motor 5015 or 5016 has reached t5, that is, whether the amount of feed of the transfer paper is sufficient, is examined. If the pulse number has reached t5, the program proceeds to step S112, and if the pulse number has not reached t5, the program proceeds to step S116.

At step S112, a pulse number t6 corresponding to the sufficient distance for the trailing end of the transfer paper to leave the resist sensor 5026 after the transfer paper has been fed (the driving pulse number of the paper feed motor 5015 or 5016) is checked. If the pulse number has not reached t6, the program proceeds to step S115, and if the pulse number has reached t6, the program proceeds to step S113. At step S113, the resist sensor 5026 is checked and if the resist sensor 5026 is not switched on, the program proceeds to step S115, but if the resist sensor 5026 is switched on, the program proceeds to step S114 and the master CPU 5002 is informed of an abnormality (jam in the resist portion), and the end flag EFLG4 is set and the program proceeds to step S41.

At step S115, the resist motor 5017 which is a stepping motor is driven and at step S116, the count value of the number of copies and the drum clock CLK1 are checked, and whether the resist feeding has been completed is checked, and if the resist feeding has not been completed, the program proceeds to step S41. If the resist feeding has been completed, a completion signal is sent to the master CPU 5002 and the end flag EFLG4 is set, whereafter the program proceeds to step S41.

Figure 39H:
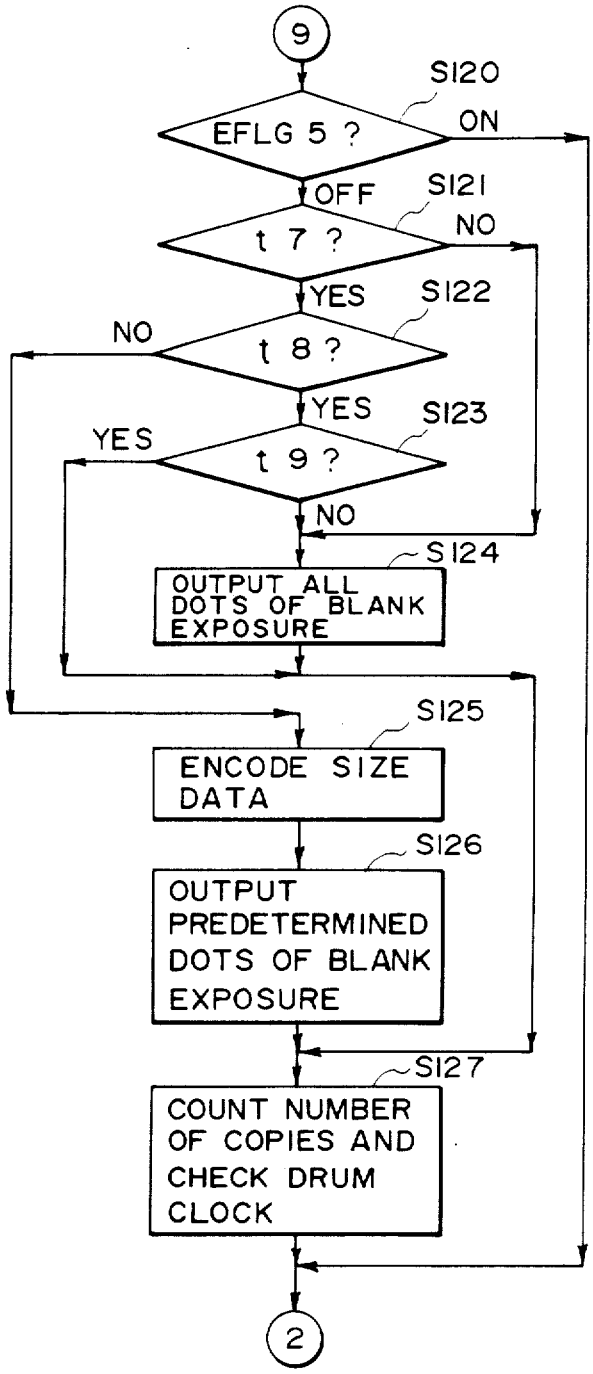

In the case of mode 9 which is a mode in which a 192-dot blank LED is driven, the program proceeds to the step S120 of FIG. 39H, at which the end flag EFLG5 of an end flag RAM 5300 to be described below is checked. If the end flag EFLG5 is turned on, the program proceeds to step S41, and if the end flag EFLG5 is not turned on, the program proceeds to step S121.

At step S121, the content of SDCNT which counts the drum clock CLK1 is checked, and the check of t7 until the count number (drum clock) reaches the leading end of the original is effected. If the count number is less than t7, it does not reach the leading end of the original and therefore, the program proceeds to step S124. If the count number is t7 or more, the program proceeds to step S122 and the check of the time t8 until the count number (drum clock CLK1) reaches the trailing end of the original (less than t8) from the leading end of the original (t7 or more) is effected.

If the count number is t8 or more, the program proceeds to step S123, at which the check of the time t9 until the count number (drum clock CLK1) reaches the trailing end of the original (t8 or more) and SDCNT is cleared is effected. If the count number of SDCNT is t9, the program proceeds to step S127, and if said count number is not t9, the program proceeds to step S124. At step S124, the data for turning on all the dots of the blank exposure is prepared. This is the pre-erasing or post-erasing of the original in the electrostatic latent image on the photosensitive drum.

Thereafter, the program proceeds to step S127. Also, if at step S122, the count number is less than t8, the program proceeds to step S125, at which the size of one of the original and the transfer paper is encoded (it is temporarily encoded because the blank exposure is time-divisionally driven), and at step S126, encoded data is prepared. At step S127, the count value of the number of copies and the drum clock CKL1 are checked and whether the blank exposure has been completed is checked, and if the blank exposure has not been completed, the program proceeds to step S41, and if the blank exposure has been completed, the master CPU 5002 is informed of the completion and an end flag EFLG5 is set, whereafter the program proceeds to step S41.

[Description of the Interruption Routine of Master CPU (FIG. 40)]

Figure 40:
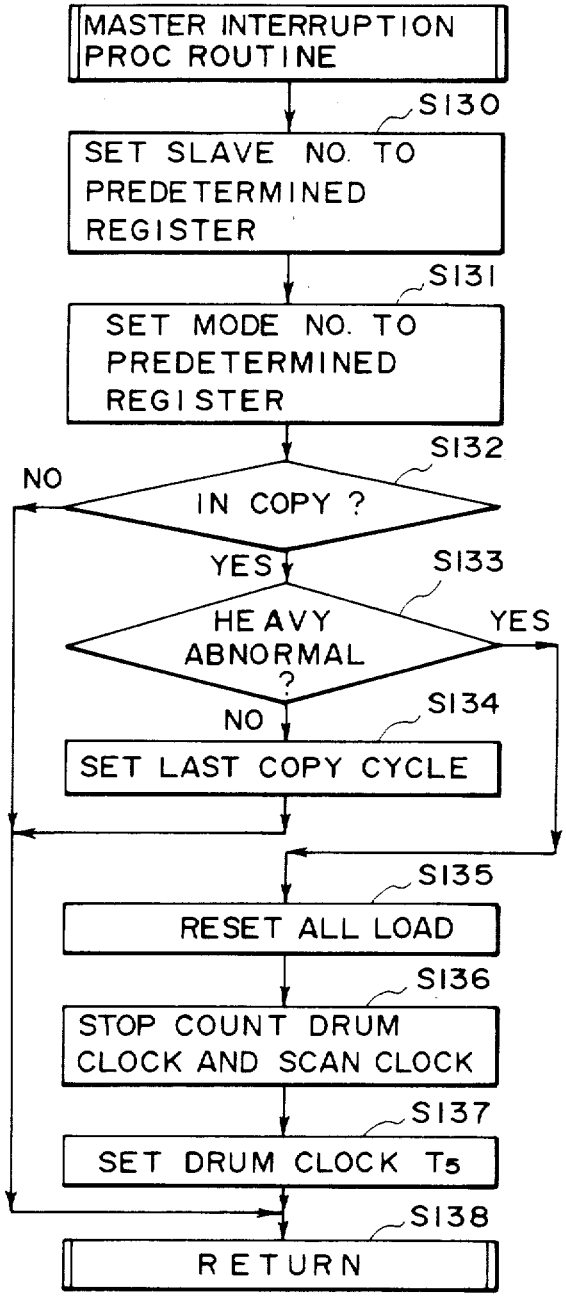
FIG. 40 is a flow chart of the interruption processing routine of the master CPU.

FIG. 40 shows the interruption processing routine of the master CPU 5002, and actuation occurs during the restoration of normalcy from the slave side or during the abnormality.

First, at step S130, which slave has been selected is set to a predetermined register, and at step S131, which mode has been selected is set to a predetermined register. These data are referred to during the operation unit control of the step S2 of FIG. 38, and display the state of abnormality or of restoration of normalcy, and further, at the step S4 of FIG. 38, they stop the mode selection of the slave CPU and others and control them fixedly until normalcy is restored.

Subsequently, at step S132, whether the copying is taking place is checked, and if the copying is not taking place, the program proceeds to step S138, at which the return instruction is executed to terminate the master interruption processing routine. If the copying is taking place, the program proceeds to step S133, at which whether the abnormal state is heavily abnormal is checked If the abnormal state is heavily abnormal, the program proceeds to step S135, and if the abnormal state is lightly abnormal, the program proceeds to step S134, at which the last copy cycle for terminating each process which is being carried out is set, whereafter the program proceeds to the aforementioned step S138.

At step S135, all loads are immediately reset because the abnormal state is heavily abnormal, and at step S136, counting of the drum clock counter MDCNT and the scan clock counter MSCNT is stopped.

At step S137, the value of the drum clock counter MDCNT is set to T5, and by the return instruction of step S138, the master interruption processing routine is terminated.

[Description of the Interruption Routine of the Slave CPUs (FIG. 41)]

Figure 41:
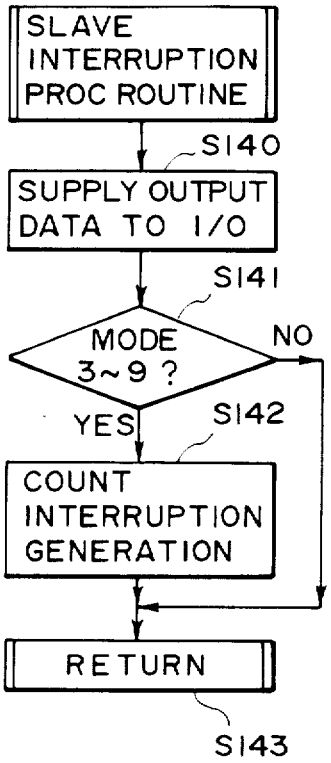
FIG. 41 is a flow chart of the interruption processing routine of the slave CPU.

FIG. 41 shows the interruption processing routine of the slave CPUS. The I/O group 5006 is used in common and therefore, this routine is started by a signal time-divisionally sent as the basic clock of the slave CPUS from the master CPU 5002 to the slave CPUs 5003–5005.

First, at step S140, the output data is put out to the I/O group 5006, and at step S141, the mode is checked and if the mode is one of modes 0–2, the program proceeds to step S143, at which the return instruction for terminating the slave interruption processing routine is executed If at step S141, the mode is one of modes 3–9, the program proceeds to the next step. At step S142, the number of times of the interruption is counted, and by the return instruction of step S143, the slave interruption processing routine is terminated.

Describing in detail the contents proposed in the present embodiment, the clock produced in accordance with the revolution of the main motor, which is the object to be controlled, is input in common to the respective slaves and even as the mode changes, said clock is event-counted, whereby the absolute amount can be known and therefore, it is not necessary to select the operation in synchronism with the flow of sequence upon change-over of the mode or change-over of the slave CPUs, and thus, this construction is very easy to operate.

As described above, according to the sixth embodiment, the master CPU and the slave CPUs are operated by a common clock signal and therefore, highly accurate control becomes possible and high reliability is obtained and also, high-speed parallel processing becomes possible.

Also, the slave CPUs are operated by common software and therefore, the slave CPUs can be made in the same hardware construction.

Although the foregoing first to sixth embodiments have been described with respect to an electrophotographic copying apparatus the present invention is applicable to various image processing apparatuses such as a facsimile apparatus, an image reading scanner and a printer.

According to the present invention, as described above, high-speed and highly reliable control of a plurality of image processing process means becomes possible and at the same time, designing of the program becomes easy.

The present invention is not restricted to the above-described embodiments, but various applications and modifications thereof are possible within the scope of the invention defined in the appended claims.

What is claimed is:

1. A control device for an image processing apparatus comprising:

a central processing unit;

a plurality of operation control units controlled by said central processing unit, for controlling a plurality of process means of said image processing apparatus and operating in parallel;

clock generation means for generating a clock signal;

clock count means provides for each of said plurality of operation control units, for counting the clock signal;

a memory storing therein a program which is executed by said plurality of operation control units; and a program counter provided for each of said plurality of operation control units, for representing an address of said memory, wherein said central processing unit designates a count value of said program counter for each of said plurality of operation control units, and said operation control unit controls said process means on the basis of the count value of each of said clock count means.

2. A control device according to claim 1, wherein said plurality of operation control units control a plurality of steps for controlling the operations of several of said plurality of process means.

3. A control device for an image processing apparatus comprising:

a central processing unit;

a plurality of operation control units controllable by said central processing unit, for controlling a plurality of process means for executing image processing;

an input and output unit for putting out a control signal to control said plurality of process means and receiving as inputs the process state signals from said plurality of process means, said input and output means being controlled by both said central processing unit and said plurality of operation control units; and memory means accessible from both said central processing unit and said plurality of operation control units, wherein said central processing unit controls said input and output unit through said memory means.

4. A control device according to claim 3, wherein said plurality of operation control units operate time-divisionally.

5. A control device for an image forming apparatus for executing image formations successively on a plurality of recording media, comprising:

a central processing unit, and a plurality of operation control units controllable by said central processing unit and operating in parallel, each of said operation control units commonly controlling a plurality of process means in said image forming apparatus to execute the image formations, wherein said operation control unit is allotted to each of said recording media and each of said operation control units effects monitoring-control with respect to the recording medium.

6. A control device according to claim 5, wherein said image forming apparatus starts the image formation on the next recording medium before the image formation on a recording medium is completed.

7. A control device according to claim 5, wherein each of said plurality of operation control units has counter means for counting clocks and clock generating means for generating a clock signal, and a control signal is put out on the basis of the results of the counting of said counter means and the counting of the clock signal generated from said clock generating means.

8. A control device according to claim 5, further comprising memory unit provided in each of said plurality of operation control units for storing therein a control program of each of said operation control units, and wherein each of said memory units stores therein substantially the same control program.

9. A control device according to claim 8, wherein said plurality of operation control units are of substantially the same circuit construction.

10. A control device according to claim 8, wherein said central processing unit puts out control information time-divisionally to said plurality of operation control units on the basis of a clock signal.

11. A control device for an image processing apparatus comprising:

producing means for producing a clock signal synchronized with the process of said image processing apparatus;

a plurality of subcontrol units for controlling a plurality of process means of said image processing apparatus and operating in parallel;

a main control unit for controlling said plurality of subcontrol units; and counter means for counting the clock signals in said main control unit and each of said plurality of subcontrol units, wherein said main control unit and said plurality of subcontrol units effect control on the basis of the count value of said counter means, and said main control unit puts out control information time-divisionally to said plurality of subcontrol units on the basis of another clock.

12. A control device for an image processing apparatus comprising:

a central processing unit;

a plurality of operation control units, controlled by said central processing unit, for controlling a plurality of process means of said image processing apparatus and operating in parallel; and memory means accessible and rewrittable by both of said central processing unit and said plurality of operation control units, wherein communication between said central processing unit and said operation control unit is performed by said memory means.

13. A control device according to claim 12, wherein said plurality of operation control units control a plurality of steps for controlling the operations of several of said plurality of process means.

14. A control device for an image processing apparatus comprising:

a central processing unit;

a plurality of operation control units controlled by said central processing unit, for controlling a plurality of process means of said image processing apparatus;

a plurality of clock generation means for generating a plurality of clock signals respectively having different periods; and count means provided for each of said plurality of operation control units, for counting the clock signals, wherein each of said plurality of operation control units can select the clock signal counted by said count means.

15. A control device according to claim 14, wherein said plurality of operation control units operate time-divisionally.

16. A control device according to claim 14, wherein said plurality of operation control units put out control signals for controlling said respective process means of said image processing apparatus.

* * * * *

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al.

It is certified that error appears in the above-identified patent and that said Letters Patent is hereby corrected as shown below:

COLUMN 1

Line 26, delete "with".

COLUMN 2

Line 53, change "accomplished" to --accomplished by--.

COLUMN 4

Line 7, change "applying" to --apply--;

Line 56, change "debug" to --more--; and

Line 57, change "increased" to --is increased--.

COLUMN 5

Line 58, change "co apparatus" to --copying apparatus--.

COLUMN 6

Line 67, change "reference numeral" to --reference numeral 401--.

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al.

It is certified that error appears in the above-identified patent and that said Letters Patent is hereby corrected as shown below:

COLUMN 9

Line 11, change "step 802," to --step S802,--.

COLUMN 13

Line 53, change "step S15J4," to --step S1504,--; and

Line 58, change "s" to --is--.

COLUMN 15

Line 64, change "processes" to --process--.

COLUMN 16

Line 1, delete "is";

Line 27, change "step S2302," to --S2303--; and

Line 46, change "embodiments" to --embodiment,--.

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al.

It is certified that error appears in the above-identified patent and that said Letters Patent is hereby corrected as shown below:

COLUMN 17

Line 53, change "JK flip-flop" to --JK flip-flop 2504--.

COLUMN 19

Line 50, change "output ports B4, B5 and 6" to --output ports B4, B5 and B6--.

COLUMN 20

Line 25, change "copletion" to --completion--.

COLUMN 23

Line 35, change "rating to "noting"; and

Line 65, change "fore." to --fore--.

COLUMN 24

Line 16, change "erased dc3105" to --erased. dc3105--; and

Line 31, change "stp S31c22," to --step S31c22,--.

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al.

It is certified that error appears in the above-identified patent and that said Letters Patent is hereby corrected as shown below:

COLUMN 25

Line 22, change "wits" to --waits--; and

Line 61, change "if" to --is--.

COLUMN 26

Line 48, change "address" to --address)--.

COLUMN 27

Line 38, change "o" to --of--; and

Line 39, change "sixth," to --sixth--.

COLUMN 28

Line 24, delete "of"; and

Line 25, delete "the".

COLUMN 29

Line 1, change "conveyor 503" to --conveyor 5043--.

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al

It is certified that error appears in the above-identified patent and that said Letters Patent is hereby corrected as shown below:

COLUMN 30

Line 58, change "39A-39B" to --39A-39H--; and

Line 60, change "FIGS. 39B-39I" to --FIGS. 39A-39H--.

COLUMN 33

Line 20, change "step 585" to --step 585,--; and
Line 65, change "WHICH COUNTS" to --which counts--;

Line 66, change "THE DRUM CLOCK" to --the drum clock--.

COLUMN 36

Line 5, change "CPUS." to --CPUs.--;

Line 7, change "CPUS" to --CPUs--; and

Line 66, change "provides" to --provided--.

UNITED STATES PATENT AND TRADEMARK OFFICE

CERTIFICATE OF CORRECTION

PATENT NO. : 4,811,052

DATED : March 7, 1989

INVENTOR(S) : Yamakawa, et al.

It is certified that error appears in the above-identified patent and that said Letters Patent is hereby corrected as shown below:

COLUMN 37

Line 64, change "comprising" to --comprising:--.

COLUMN 38

Line 35, change "rewrittable" to --rewritable--.

FIGURE 11A

Block S1302, change "DCREMENT" to --DECREMENT--.

Signed and Sealed this

Sixth Day of March, 1990

*Attest:*

*Attesting Officer*

JEFFREY M. SAMUELS

*Acting Commissioner of Patents and Trademarks*